United States Patent [19]

Milisavljevic

[11] Patent Number: 5,010,852

[45] Date of Patent: Apr. 30, 1991

[54] HEAT ENGINE

[76] Inventor: Milorad S. Milisavljevic, Gutschstrasse 6/148, Lucerne, Switzerland

[21] Appl. No.: 339,321

[22] Filed: Apr. 14, 1989

[51] Int. Cl.[5] ..... F02B 69/06

[52] U.S. Cl. ..... 123/21; 123/71 R; 123/292; 123/275; 123/41.85; 123/25 P

[58] Field of Search ..... 123/71 R, 79 R, 79 C, 123/25 P, 188, 41.85, 41.77, 41.78, 275, 41.41, 21, 292, 542

[56] References Cited

U.S. PATENT DOCUMENTS 3,826,086 7/1974 Milisavljevic ..... 60/39.62

FOREIGN PATENT DOCUMENTS 0128912 10/1988 European Pat. Off. .
53039 8/1990 Fed. Rep. of Germany .... 123/71 R
051085 3/1922 Sweden ..... 123/71 R
71555 4/1931 Sweden ..... 123/71 R
576069 4/1976 Switzerland .

OTHER PUBLICATIONS

Diesel and Gas Turbine Catalog, vol. Thirty--Three,—1968: p. 385, MB 836 B Maybach-Mercedes-Benz, description p. 60; p. 420 VV/23/23 M.A.N., description p. 60; p. 45 Nordberg—Four Cycle Engine FS-136-HSC, description p. 63; p. 47 Nordberg—Two Cycle Diesel TS 2110, description p. 63.

Autotechnik-1978, Technische Daten und Messwerte: Austin Mini-Kombi MK II, description p. 64.

Chemical Week,—Jul. 30, 1986: "A Cheaper Conversion for Coal", description p. 67.

Fritz A. F. Schmidt: "Verbrennungskraftmaschinen", description pp. 3, 17, 44, 53, 54, 55, 57, 58.

R. Brun: "Science et Technique du Moteur Diesel Industriel et de Transport", Tome I, pp. 315 to 321,—description p. 26.

N. Mestre: "Cours de Force Motrice", Tome II-Machines à vapeur à piston, Turbines à vapeur—pp. 116 to 124,—decription pp. 68 and 74.

G. Lemasson, A. L. Tourancheau, L. Vivier: "Elements de Construction"—production et utilisation de la vapeur,—pp. 67 to 77 and 85/86,—description p. 74;—pp. 69, 73, 77 and 85—description p. 75.

Thermique General, I. Chvetz et al., Editions MIR--Moscou 1969, 2 pp.

*Primary Examiner*—E. Rollins Cross

*Attorney, Agent, or Firm*—Herbert Dubno; Andrew Wilford

[57] ABSTRACT

A multifuel hybrid heat engine having an internal combustion system and an external combustion system wherein a coaxial array of three tappet valves controls the expansion from the external combustion system to the internal combustion system and the drive of the common piston member which cooperates with a working cylinder and another cylinder coaxial therewith and received within the working cylinder. The piston member with its inner and outer pistons cooperates with these cylinders to define not only upper cylinder motors but also lower cylinder motors and air compressors for scavenging the air supply.

15 Claims, 21 Drawing Sheets

HEAT ENGINE

FIELD OF INVENTION

My present invention relates to a reciprocating multifuel, multihybrid heat engine operated by combustion products, by steam and in a hybrid variant by a combined action of gas and steam, capable of working in a combined two-stroke and multistroke working cycle, to expand the useful cubic capacity of the cylinder of the conventional internal combustion engine (ICE) without changing its bore size or stroke, to perform a simultaneous constant volume precombustion combined with a variable volume combustion of up to five different fuels lasting during the entire working cycle and also capable of using solid fuels in its steam variant.

BACKGROUND OF THE INVENTION

Pollution of the environment and particularly of the atmosphere is a permanent preoccupation in the center of controversial disputes. An important part of the air pollution caused by industries can be coped with by a measure of additional investment for the preliminary treatment of the fuel or by the treatment of the noxious products of combustion by electrofilters, catalzers, gas washing and similar equipment built into existing fireplaces. The pollution caused by big, usually dual-fuel, slow speed industrial ICE lies in a more or less acceptable range. The evil increases with the increase of the speed of the engine which improves its efficiency but shortens the time of combustion, causing a low volumetric efficiency and an incomplete scavenging of burned gases resulting in an incomplete combustion and noxious exhaust.

These imperfections, largely responsible for the degradation of the environment, are a consequence of the more than 100-year-old constructional conception of the conventional ICE. Disregarding the tremendous improvement of its mechanical properties and technical performances realized during that period of time, it still represents a simple, technologically poor engine, with an extremely low thermal efficiency.

Its construction features as well as its method of operation are equally responsible for its low output and the nauseous exhaust. Whatever the proportion of the air fuel mixture taken into the cylinder or obtained by the fuel injection in the compressed air of an ICE, clean exhaust can never be achieved due to the lack of time needed for a complete combustion, limited by the duration of a single variable-volume power stroke.

The combustion time is further shortened by the high speed of the engine, necessary to improve its efficiency, which in turn requires the use of rapidly-burning high-quality fuels. Nevertheless, the largest part of the calorific value of these expensive fuels is dissipated due to the fact that the combustion occurs practically in an "open valve" condition, caused by the short time available for the scavenging of the burnt gases and the intake of fresh air.

It should also be mentioned that the conventional ICE lacks space for the installation of the valves in a number and size necessary for an improved air intake and exhaust off the burned gases. Also it is difficult to realize a gas-tight separation of the working cylinder from the crankcase in order to prevent a rapid degradation of the lubricating oil and avoid the ventilation of the crankcase through the carbureting system of the emgine. Another all-important disadvantage is the tremendous loss of heat caused by the cooling system of the ICE.

A turbocharger improves the mechanical efficiency of the ICE by allowing the injection of a larger quantity of fuel into a larger quantity of compressed air without improving the combustion or changing anything in the method of operation of the engine. On the other hand the catalyzer is an auxiliary palliative device which can reduce to a certain extent the toxicity of the exhaust gases on condition that their quantity, depending on the speed of the engine, is proportional to the filtering surface of the catalyzer. Nevertheless, it cannot solve the problem of pollution. Both devices seriously increase the price of the engine and require permanent servicing and maintenance.

Furthermore the different types of conventional ICE are of a different constructions substantially differing from each other with respect to the working cycle, kind of fuel and method of operation. The configuration of a two-stroke conventional diesel engine is entirely different from the basic structure of a four-stroke diesel engine. The difference is even greater in case of its hybrid and special purpose variant, which has very little in common with the basic four-stroke structure of the ICE (ACRO, LANOVA, BUECHI, PESCARA etc.—Prof. Fritz A. F. Schmidt "Verbrennungs-kraft-maschinen" Springer Verlag 1967, pages 181/183, 230/232, 296/297, 417). Moreover, none of these constructions solves the above enumerated problems.

OBJECT OF THE INVENTION

The principal object of this invention is to provide a reciprocating heat engine of a new type allowing its execution in several embodiments, always retaining its basic structural features and its capability to work as a multifuel, multihybrid engine without departing either from its working principle and characterized by its compactness, extremely high efficiency and the capability to synthesize, in the form of hybrid engine, all the useful features of a conventional internal combustion engine and an external combustion engine. Moreover, in all its embodiments the proposed multifuel, multihybrid engine (MME) should allow the application of the most appropriate method of operation, particularly with respect to the working cycle, number, quality and compression ratio of the mixtures, duration of their precombustion calculated on the basis of the maximal speed of the engine, etc. The construction should also take into consideration the purpose served by the engine, the space left for its erection, the choice of the most appropriate domestic fuels used for its operation and the adaptation of the construction to hybrid operation. By a proper combination of these elements, in addition to the increase of output and a clean exhaust, the MME provided by the invention should at the same time resolve the economic problems related to the production of domestic fuels, primarily those derived from agriculture and the coal-mining industry.

SUMMARY OF THE INVENTION

Due to its advantageous configuration which will be subsequently elaborated hereafter, the engine provided by the invention is a multifuel-multihybrid engine operated in all its variants on the same working principle consisting of a simultaneous development of driving power in two separate combustion systems, namely:

an External Combustion System (Ext.C.System) provided with at least one source of compressed air distributed in accordance with the applied two/multistroke working cycle into at least one hermetically closed precombustion chamber (PCCH) injected with at least one kind of fuel which selfignited, shall carry out a prolonged constant-volume precombustion lasting until the beginning of the last stroke of a multistroke working cycle when its combustion product penetrates into the:

an Internal Combustion System (Int.C.System) provided with at least one source of precompressed air peculiar to it, aspirated, during at least one stroke of the applied two/multistroke working cycle, into the cylinder perfectly scavenged from the burned gases from the previous working cycle or stroke, and compressed into at least one explosion chamber, injected on time with at least one kind of fuel which selfignited and exploding at the moment of the penetration of the burning gases from the Ext.C.System, continues to burn together in a variable-volume combustion encompassing the entire combustion space of both systems, exercizing a unified, uniform, synchronized common thrust against the piston, from the very moment of its arrival to the top dead point (TDP).

By the execution of the basic design it should be taken into consideration that the MME is a selfsufficient single-cylinder engine which, in its basic configuration, is already a double hybrid engine, due to the fact that its cylinder motor is always combined with at least one additional cylinder compressor of larger bore which enables its functioning as an internal-external combustion hybrid engine and at the same time as a combined Diesel-Otto hybrid engine.

Each particular cylinder of the MME can be operated independently or in tandem drive with one or more cylinders of the same or similar construction and/or in hybrid variants with one or more cylinders of the conventional ICE or of other suitable constructions, always using the same working principle and the method of operation adapted to the available fuels. In all these configurations the MME retains the above-stated operational capabilities and particularly its remarkable thermal efficiency resulting from a complete combustion of all kinds of fuels and a clean exhaust accompanied by a tremendous increase of output, with respect to the output of a conventional ICE of the same bore/stroke.

Executed in the form of a compound steam engine the MME represents another important hybrid variant which will be elaborated afterwords.

The most suitable configurations of the MME are:

a single or multicylinder MME operated on the combustion products of a single fuel at a combined two/-multistroke working cycle, a single or multicylinder, multifuel engine using up to five kinds of liquid and/or gaseous fuels simultaneously, operated as a combined Diesel-Otto hybrid engine in a two/multistroke working cycle or as a double-acting engine in which the lower compressor (CO2) is operated as an additional four-stroke conventional ICE, an independent self-propelled source of compressed air, the surplus of which is obtained preferably in a two/six stroke working cycle, an independent self-propelled source of propellant gas for a turbine consisting preferably of two oppositely lying working cylinders with their free multipurpose pistons connected among themselves by a single connecting rod, thus acting without any synchronizing device delivering the burning gases under pressure without impulses from a common receptacle directly to the turbine, a multifuel hybrid engine using the selfpropelled MME as a core, supplying its compressor air surplus to the adjacent cylinder or cylinders of a conventional ICE equiped with the cylinder head of the MME, thus functioning on the same working principle, a three-stage double acting, transport Compound Steam Engine, integrated into a compact steam boiler heated by a variety of fuels including solid fuels as for example a paste made of coal dust mixed with mazout, heavy oil and other derivatives obtained from the processing of coal or crude oil. In the hybrid variant with a MME operated on combustion products, its exhaust gases will be used as additional fuel.

a stationary double-acting Compound Steam Engine, having the working cylinder coupled with its own boiler or with a factory boiler reducing the high pressure steam to the factory's operative purposes, using the obtained energy for the direct drive of the large-size generators in the electricity-generating plants, industrial plants, as well as in small and medium-size sealed-capsulated nuclear units. In this hybrid variant, coupled with at least one cylinder of the MME operated on combustion products, it can serve as a multipurpose industrial, transport and marine engine as for example a starter, locomotive, tugger, dredger or as prime mover for stationary and mobile machinery etc., and a propelling MME consisting preferably of two opposed cylinders particularly appropriate as a propelling power source for two opposed propellers of a plane, characterized by an extraordinary efficiency and an extremely advantageous weight-per-horsepower relation.

Due to its specific configurations the initial design fundamentals of the MME must take into consideration the diameter of the internal cylinder motor (CM1) with respect to the diameter of the outer cylinder motor (CM3), the proportion in which the compressed air will be divided between the Int.C.System and the Ext.C-.System and the requirements of the method of operation with respect to the fuels to be used for its operation. Consequently, based on the desired output and available fuels, the calculation should encompass the decision concerning the number, cubic capacity and position of the cylinder motors and associated compressors as well as the number and position of the precombustion and explosion chambers, the compression ratio to prevail in each of them, duration of the precombustion, connection and harmonization of common operation with the associated hybrid engines, etc. Of capital importance in this calculation is the amount of compressed air to be generated by the engine in accordance with the maximum allowed speed, the main effective pressure (MEP) and the temperature prevailing in the entire combustion space of the engine during the power stroke. The rational use of the important surplus of compressed air generated by the MME results in a slow-speed, efficient, clean-exhaust, multifuel compact engine of an extremely advantageous weight per horsepower and of an output exceeding by more than thousand percent the output of the conventional ICE of the same bore/stroke operated at the same speed and at a four stroke working cycle. The MME can achieve the expected results in all power and speed ranges by adaptation of its configuration to the desired performances. This adaptation can be realized in all its variants with the same efficiency regardless of slight differences in their construction features illustrated in the enclosed schematic drawings of which the first three variants represent the MME operated on combustion products, each of them applying a particular method of operation. The fourth variant is operated on steam although it uses the same cylinder block and the cylinder block head as that illustrated in the first variant.

BRIEF DESCRIPTION OF THE DRAWING

The above and other objects, features and advantages of my invention will become more readily apparent from the following description, reference being made to the accompanying highly diagrammatic drawing in which.

BASIC FEATURES OF THE FIRST EMBODIMENT

Figure 1:
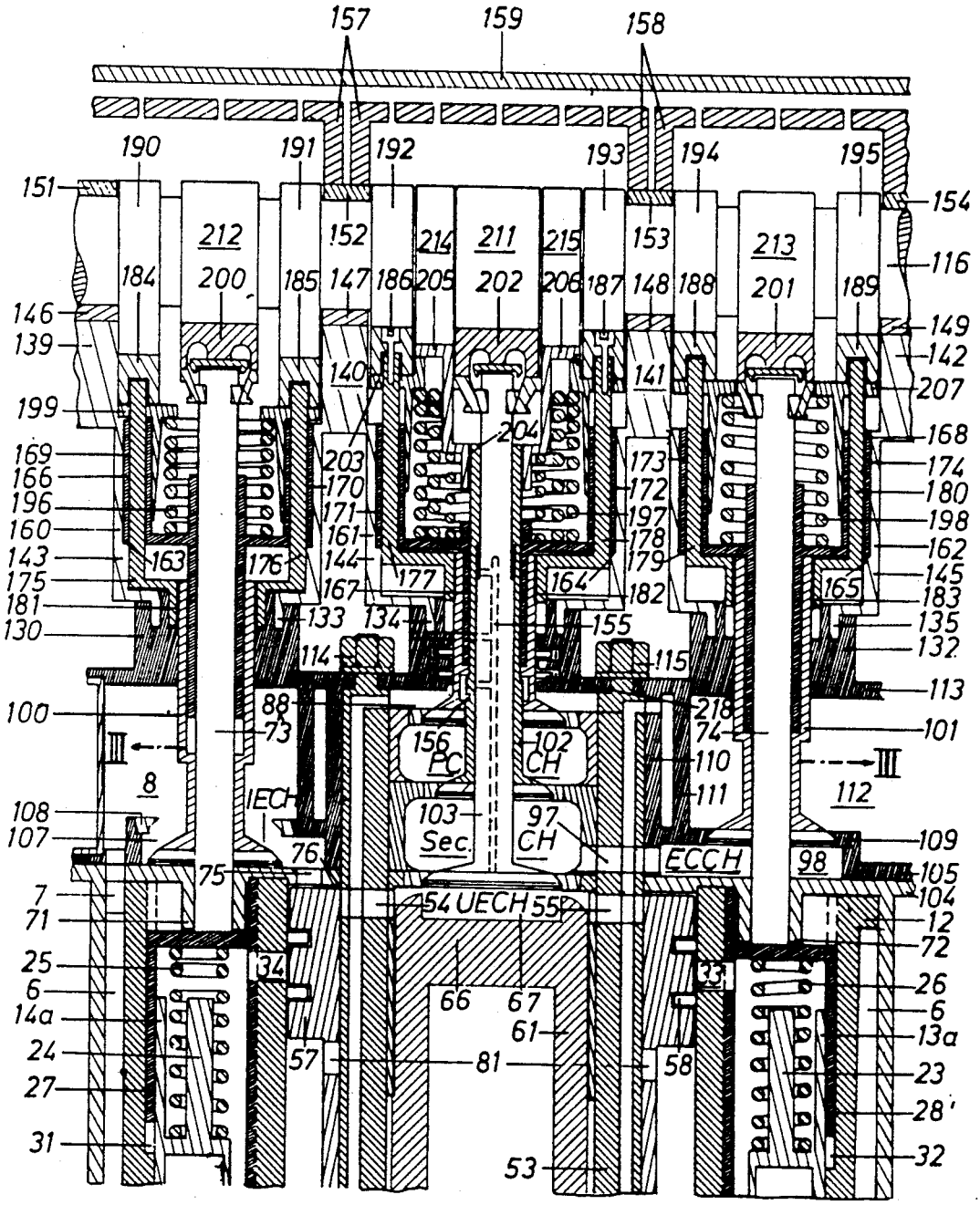
FIGS. 1 and 2 combined together represent in section along line I—I of FIG. 5 a first embodiment of the MME, with the piston in TDP at the beginning of the first stroke and with a horizontal section of the device containing three concentrically arranged valves.

The engine consists of a cylinder block, a cylinder block head and a crankcase. The cylinder block is enclosed in a housing covered by a plate manufactured in one piece with a vertical supporting wall which surrounds the entire cylinder block including the upper part of the crankcase, resting with its lower-end flange on a bottom supported by the clamping plate of the lower part of the crankcase, attached to each other by bolts and screws. From the said bottom rises a double-walled working cylinder in the internal part of which is coaxially suspended a shorter cylinder serving as the upper cylinder motor (CM1). The working cylinder is divided by a ring-shaped constriction into an upper part, enclosing with the outer wall of the said upper cylinder motor (CM1) a double acting cylinder of which the upper part, connected with CM1, serves as an outer cylinder motor (CM3) while its lower part serves as a compressor (CO1). All three are operated by a common multipurpose piston secured in the conventional way to a rod and crank assembly. The top of the working cylinder is fixed to the lower surface of the said cover plate by a groove and tongue circular joint. The outer wall of the double-walled cylinder is kept in position, being squeezed between the said cover plate and its vertical wall. The open space between these two cylinders accomodate two by two oppositely-lying oil receptaclecles provided with oil and air filters. The frames of the air filters are separated by their perforated walls from the space occupied by the oil receptacles containing the oil filters in their frames. In this way, from the total of lubricating oil circulating in both directions through the oil filters, a large part penetrates into the air filters, which receive hot air forced by the powerful impeller of the radiator through an air duct, provided with its own air filter, through the upper crankcase into the lower crankcase to be further precompressed by the reciprocating movement of the piston and forced through the air filters and their associated vertical air pockets toward the air intake ports of all cylinder motors (CM1, CM2, CM3) and associated compressors (CO1, CO2) controled by their respective sliding and/or inertia valves.

The totality of the cooling and lubricating oil coming from the left oil collector enters the oil filter situated in the left oil-receiving receptacle, occupying the upper part of the crankcase between the walls of the double-walled cylinder, streaming further together with the part of the oil coming from the air filters through their respective outlets formed in the bottom of the double walled cylinder, into the lower part of the crankcase to be drawn into a suction oil pump connected by a pipe with the right oil filter situated in the oil-returning receptacle, forced to mount the right oil collector and further through the oil-return tubes into the main oil reservoir situated at the top of the engine.

The ring-shaped constriction protruding from the internal wall of the lower part of the working cylinder toward the center of the engine has holes connected with the adjacent oil filters, supplying the oil necessary for the lubrication of both sides of the outer wall of the piston, of its ring shaped head and its piston rings. A part of this oil enters into the space occupied by the disc valve controlling the transfer of the compressed air into the Ext.C.System, lubricating its spring and through the adjacent inertia valve also the outer wall of the internal part of the piston.

The additional lubricating oil, if necessary, is brought to the working parts of the engine by the air stream discharged through the air filters flushed by the oil. All the air and the oil filter materials should be of the kind which can be flushed from time to time with gasoline and of an adequate transmissibility enabling undisturbed flow of fresh air toward the air intake ports.

The intake of filtered and precompressed air from the upper and lower crankcase into the cylinder motors (CM1, CM2, CM3) and both compressors (CO1, CO2), occurs through their intake ports controlled by the inlet sliding valves in their respective vertical grooves cut into the outer wall of the working cylinder along its two opposite segments facing the air filters. Both sliding valves, resting on their respective springs, are situated over the air filters and control simultaneously the intake of the hot air coming under pressure from the radiator through air filters into the crankcase and from the crankcase precompressed through intake ports into the enumerated cylinder motors and associated compressors. These intake ports being alternatively opened and closed during the reciprocating movement of the piston along its entire course, and in accordance with the "breathing" of the crankcase permanently supplied with the air under pressure coming from radiator, ensure at all speeds a continuous volumetric efficiency exceeding 100% and a perfect scavenging of the burned gases. Both compressors are of the positive displacement type and deliver the same pressure at all speed ranges, without being exposed to the backfire.

In the first embodiment the MME is provided with three cylinder motors (CM1, CM2, CM3), and two compressors (CO1, CO2) of which CO2 works for the lower cylinder motor CM2, delivering to it a full charge of compressed air twice during each working cycle. Disadvantaged by such distribution, the Ext.C.System should work with about 20% of the entire air intake only. This disproportion will be corrected by the choice of a method of operation which includes the recovery of the air after the completion of the scavenging of the burned gases during the second half of the fourth, or exhaust stroke which shall be explained afterwards.

As mentioned above a shorter cylinder of smaller bore which divides the upper part of the working cylinder into a ring-shaped outer compartment enclosing the outer cylinder motor (CM3) is coaxially fixed by suspension inside of the working cylinder and is used together with the upper compressor (CO1) as a common double acting cylinder. The upper thick part of this coaxial cylinder, situated in the cylinder block head, is kept in the vertical position, being fixed by bolts and screws on a load-bearing turret, which shall be described afterwards. Its thick wall contains a water jacket consisting of several water tubes open towards the main water reservoir situated in the cylinder block head and separated from each other by vertical ducts peierced in the same wall conveying compressed air from the receptacle of compressed air into the distributor of compressed air. Provided with cooling water tubes and compressed air ducts, the cylinder motor (CM1) is converted into a heat exchanger transferring by convection the heat developed in all cylinder motors (CM1, CM2, CM3) on the cooling water and compressed air permanently circulating through their respective tubes and ducts. The heat exchange occurs also with the fresh air permanently present and compressed in the compressor (CO1) and in the lower compressor-scavenger (CO2) alternately connected with and separated from the lower cylinder motor (CM2) by inertia valves. Because the wall of coaxial cylinder serving as cylinder motor (CM1) is adjacent to all the combustion chambers and explosion chambers of the engine, it can also contain the nozzles of an injection device in order to replace the cumbersome and expensive conventional injectors. The cylinder motor (CM1) being converted into a multipurpose heat exchanger, exchanges the heat developed in cylinder motors with the cooling water and with the compressed air which return the absorbed heat into the combustion process through the compressed air ducts leading into the combustion chambers of the Ext.C.System and through the water tubes of the water jacket and radiator into the compressors which in turn increase the temperature of the received hot air by cooling the inner wall of the working cylinder and all the internal walls of the piston. The space necessary to equip this heat exchanger with all the enumerated tubes and ducts will not cause any problem because the thicker the wall of the cylinder motor (CM1) the bigger the surplus of compressed air that will be generated. Consequently, higher temperatures and pressures can be implemented during the power stroke and the temperature of the injectors as well as the working temperature of the engine can be permanently kept on the most efficient level. Moreover, a remarkable quantity of the energy lost by cooling the conventional ICE is saved as it is returned into the combustion process by the compressed air heated simultaneously by the cooling of the hot water and by the convection of heat prevailing in the adjacent cylinder motor (CM1) from one side and in the double-acting cylinder motor (CM3) combined with the compressor (CO1) on the other side.

The lower end of the upper cylinder motor (CM1) is provided with a disc valve controlling the transfer of compressed air from the compressor (CO1) into the described vertical ducts. This disc valve, called the lower disc valve, is inserted, together with its supporting spring, into a ring-shaped receptacle in the form of a casing, before this casing is fixed by its screw joint onto the internal threaded wall of the cylinder motor (CM1).

The multipurpose double acting piston consists of an internal part and an external part fixed to each other close to the periphery of their common bottom from which the internal hollow part of the piston rises and is secured by a conventional rod and crank assembly to the common crankshaft, while the external part of the piston, in the form of a cylinder, is fixed to the bottom by welding or screw joints near its periphery, leaving a part of the bottom periphery out of the outer part of the piston to serve as the piston of an additional compressor-scavenger (CO2).

Because of its smaller diameter, the internal part of the piston reciprocates freely in both cylinder motors CM1 and CM2 without piston rings. Even when entering the lined part of the upper cylinder motor CM1 a sufficient clearance and the vertical slots cut in either the lining or in upper parts of its body ensure a permanent but throttled connection between all three cylinder motors CM1, CM2 and CM3.

By contrast, the outer cylindrical part of the piston provided on its top with a ring-shaped piston slides with its piston rings sealingly against the inner wall of the working cylinder enclosing in its upper part the already mentioned third cylinder motor CM3 connected by a horizontal opening with the upper cylinder motor CM1 and by a vertical opening with the cylinder block head. Being a double-acting device, the same piston forms between its lower surface and a bottom created by the said ring-shaped constriction of the inner wall of the double-walled cylinder the compressor CO1 which is enclosed by the cylindrical wall of the outer part of the piston which at the same time encloses, together with the horizontal bottom and the internal part of the piston, the lower cylinder motor CM2. This cylindrical wall of the outer part of the piston is provided below its ring-shaped top with the ports transfering the air compressed by the compressor CO1 in cooperation with the described lower disc valve into the vertical ducts pierced in the wall of the upper cylinder motor CM1. The outer circumference of the piston bottom, extended beyond the wall of the outer part of the piston, sliding tightly against the lower part of the internal wall of the double walled cylinder forms the piston of a second compresor-scavenger CO2, fed through the intake ports controlled by the described inlet slide valve and alternatively connected and separated from the lower cylinder motor CM2 by an automatic inertia valve.

Because of its height, the internal part of the piston, even on its BDP remains with its upper part in the upper cylinder motor CM1. During the movement toward the TDP, the entire space of all three cylinder motors, CM1, CM2, CM3 full of fresh air starts to shrink to be converted by the penetrating piston at the moment of its arrival at the TDP into the explosion chambers, namely the lower explosion chamber LECH formed between the bottom of the piston and the described ring-shaped casing of the lower disc valve, whenever the piston reaches its TDP. At the same time and in the same way, the explosion chambers, namely the upper explosion chamber UECH situated between the top of the internal part of the piston in its TDP and the cylinder block cover, and the intake explosion chamber IECH located in the cylinder block head below the intake valve are formed.

At the moment of entry of the top of the internal part of the piston into the upper lined part of the CM1 these two explosion chambers are separated from the LECH: thus the CM1 is separated from the CM2 during a part of the compression stroke and an adequate part of the power stroke. During that time the LECH situated in the timely separated CM2 shall act as the combustion chamber of an additional four-stroke ICE until the upper trunk of the piston leaves the upper lined part of the CM1.

The same separation of the CM1 from the CM2 occurs once more during the same working cycle, namely, during the exhaust stroke combined with the scavenging of the combustion space by the air originating from the CO2, which causes a certain loss of power through unnecessary compression of the air remaining in the CM2 after the described separation. In order to avoid or diminish this loss, it is advantageous to convert this separation into a throttling, either by cutting out in the body of the upper trunk of the internal part of the piston and/or in the lining of the upper cilinder motor (CM1) the vertical grooves or by a simple elimination of the lining of the CM1. During the exhaust stroke this measure saves a much larger quantity of the compressed air remaining in the CM1 and CM2 after the scavenging of the burnt gases, causing at the same time the ignition of the different air/fuel mixtures compressed in all the explosion chambers of the Int.C.System at the very beginning of the power stroke due to the propagation of the flame through the said vertical grooves connecting the explosion chambers into a single combustion space. All explosion chambers shall be injected with their respective fuels according to the determined method of operation, either by the conventional fuel-injecting system or by a new injector consisting of at least one vertical outer tube pierced or inserted in the wall of the upper cylinder motor CM1, provided with a bigger upper opening connected to the injection pump and a smaller lower opening of the size of an injection nozle perforated in its wall at the height of the respective combustion or explosion chamber. Within this "outer" tube sealingly slides an internal tube, secured against turning, whose upper solid part is activated by the camshaft, while its lower hollow part, without a bottom, rests on a spring inserted into the said outer tube.

This internal hollow tube is provided on the same level as the outer tube with two openings of the same size as those perforated in the wall of the outer tube. Raised by the spring, the upper opening of the inner tube matches with the corresponding opening of the outer tube, thus enabling the penetration of the fuel under pressure into the entire cavity. In this position the small opening-injection nozzle is situated above the injection nozzle of the outer tube for about half of the valve lift so that under the pressure of the cam the descending internal tube cuts the inlet of the fuel by closing the upper opening of the outer tube, matching at the same time its injection nozzle with the nozzle of the outer tube, thus injecting the fuel into the respective chamber under the pressure prevailing in it at the moment of injection.

The closing of the upper fuel inlet must prcisely correspond to the beginning of the opening of the injection nozzle. Nevertheless, any discrepancy can be offset by grooving a small vertical canal in the wall of the outer tube to return the oil surplus into the injection pump. Being situated in the wall of the upper cylinder motor together with the water jacket tubes and the compressed air ducts, this device keeps the temperature of the fuel at the desired temperature and adjoining all combustion and explosion chambers, eliminates conventional injectors otherwise needed for each particular chamber. In the described embodiment both parts of the piston joined at their lower end into one unit, are connected to a rotary shaft by a rod and crank assembly with the crosstail of the connecting rod secured in the conventional way in the hollow space of the internal part of the piston. However, as will be explained afterwards, the transmission by two connecting rods illustrated in the third embodiment of the NME represents an operational advantage over this configuration.

The total friction surface or the total number of piston rings as well as the weight of the entire piston should not exceed the number of the rings and the weight of the piston of a conventional ICE of same bore/stroke running at the same speed. Even with smaller number of piston rings, the leakages of burned gases and of the compressed air already reduced by the slow speed of the MME cannot be considered as a loss, because in the configuration of the engine described all leakages return automatically into the combustion process, thus eliminating the conventional ventilation of the crankcase through the carburetion system of the engine.

The piston is guided by its long outer cylindrical wall and the ring shaped piston fixed on its top, sliding against the internal wall of the double-walled working cylinder and against the the external wall of the upper cylinder motor CM1.

The sealed crankcase of the dry type extended up to the cylinder block head, feeds the precompressed air into both compressors CO1, CO2 and into the external cylinder motor CM3 through their respective intake ports conjugating alternatively during the operation with the openings provided in the sleeves of the sliding valves. The volumetric efficiency of all cylinder motors CM1, CM2, CM3, their scavenging from the burned gases as well as the recuperation of a part of the fresh air remaining in the cylinder motors CM1, CM2, CM3, after scavenging during the fourth stroke is stimulated by the coordinated action of the compressor-scavenger CO2, by the intake valve situated in the cylinder block head and by the multipurpose piston serving through its reciprocating movement in the sealingly closed crankcase, as an additional turbocharger.

The cylinder block head of the MME has a different task than the cylinder block head of a conventional ICE. It represents a complementary part of the engine capable of effecting a prolonged, simultaneous and complete combustion of two different fuels, unifying the developed power with the energy generated in the Int. C. System into a single force exercising a substantial common thrust against the piston during the power stroke.

The cylinder block head is fixed to the cylinder block by means of the already mentioned disc-cover plate of the cylinder block which is an important connecting element between the cylinder block and its head. The cover serves:

as a groove and tongue circular joint keeping the working cylinder in its upright fixed position;

as a ring keeping the upper end part of the double-walled cylinder in its position;

as the bottom of both oil collectors, connecting them with their respective left oil-receiving receptacle and the right oil-returning receptacle;

as the guide of the sliding valves controlling the air intake ports of the outer cylinder motor CM3 and of both compressors CO1 and CO2;

as the bottom of the round shaped intake explosion chamber IECH and the exhaust combustion chamber ECCH with their respective connecting valves;

as a tight passage of the upper part of the cylinder motor CM1 into the cylinder block head, through an opening cut to fit in its center; and as the supporting base of the cylinder block head which, with a disc of its load-bearing structure, rests on its peripheral surface fixed by bolts and screws to its upper end flange and the flange of the lower housing of the cylinder block head. In the upper part of the coaxially suspended cylinder motor (CM1) are two constant-volume combustion chambers, namely an upper precombustion chamber (PCCH) and a lower secondary combustion chamber (Sec. CH), both exchangeable, the latter unified by a passage with a third combustion chamber, called the exhaust combustion chamber (ECCH).

The PCCH and Sec. CH are mounted in place together with their associated valves before the upper part of the CM1 is bolted to the central load-bearing turret by bolts protruding from its upper surface. Both are operated by valves joined into a single device consisting of three concentrically arranged valves with their hollow stem sockets sliding inside one another, of which:

the external valve connects the PCCH with the distributor of compressed air, the intermediate valve connects the same precombustion chamber PCCH with the chambers Sec. CH and ECCH into a single combustion space, and the internal valve according to the method of operation and the working cycle in cooperation with the intermediate valve, connects either the entire precombustion space or consecutively first the Sec. CH and the ECCH and a short time later the PCCH with the cylinder motors (CM1, CM2, CM3). The described action of the valves, controlled by a common overhead camshaft, is programmed according to the preselected method of operation which determines their functioning:

in groups of two with the intermediate valve serving as a member of both groups, in groups of two with the simultaneous independent operation of the remaining third valve, and with each valve operated independently with the possibility of synchronizing the time and duration of its opening with the action of the other valves in accordance with the requirements of the applied method of operation.

The air intake and burned gases exhaust valves also provided with the hollow stems serving as sockets to the stems of the associated sliding valves function in a similar but more simple way function to control the intake of the precompressed air from the crankcase into the compressors CO1, CO2 and the cylinder motors (CM1, CM2, CM3), and the exhaust of the burned gases from the entire combustion space of the engine.

It should be noted that in the drawings all valves are situated along a common overhead camshaft. Although this solution reduces the cost price of the engine, it does not means that some of them cannot be operated by rocker arms. The two superimposed precombustion chambers PCCH and Sec.CH can be exchanged together with their associated valves whenever needed to increase or to reduce their cubic capacity and consequently to adapt the prevailing compression ratio to the requirements of the available fuels. Therefore the combustion space of the Ext. C. System is designed so that one of the chambers can be replaced by another appropriate chamber and/or both of them replaced by chambers of smaller or larger cubic capacity, fabricated in the required size of a suitable material as for example of fire-resistant materials like highly refractory ceramic compounds cast into the solid steel shells. The thickness of the wall of the cylinder motor (CM1), in the cylinder block head, allows the use of high pressures and temperatures in the associated combustion chambers. Nevertheless, being surrounded by cooling water their temperature can be kept exactly at the desired level. It is the same with the valves of the MME all of which are permanently immersed in cooling oil, their stems also being accessible to cooling water. The lower part of the load-bearing structure of the cylinder block head manufactured in one piece consists of a basic disc bearing two elevated stages. The peripheral part of the basic disc rests on the surface and particularly on the peripheral part of the cylinder block cover. Its first elevated stage is provided with the joint tongue and groove intervening barriers protruding from its lower surface, covering, enclosing or surrounding:

the intake explosion chamber (IECH), the exhaust combustion chamber (ECCH), the oil-receiving collector, and the oil-returning collector.

The same first elevated stage of the load bearing structure bears on its upper surface:

one cylindrical and two semicylindrical barrels, all three together forming on their top the second elevated stage of the lower load bearing structure in the form of a horizontal longitudinal stretch situated along the overhead camshaft of the engine. The semicircular barrels enclose the air-intake duct and exhaust duct and shelter and the stems of the valves associated with their respective explosion and combustion chamber, having their seats in the valve openings cut in the horizontal surface of the first elevated stage. The circular barrel rising from the center of the basic load-bearing disc in the form of a double-walled cylinder encloses:

the upper part of the cylinder motor (CM1) introduced into it through a hole cut in the center of the cylinder block cover and fixed by the setscrews protruding from the top of its wall to the upper horizontal surface of the said second elevated stage of the lower load-bearing structure;

three larger-diameter tubes welded to the holes cut in its surface above the oil-returning collector connecting it with the main oil reservoir situated in the upper part of the engine;

a large number of small-diameter tubes welded with their lower end parts to the holes in its surface above the oil-receiving collector and with their upper end parts welded or grooved into the corresponding holes formed in an upper shell or in the load-bearing slab which is the bottom of the main oil reservoir and an all-important part of the upper load-bearing structure; and a lateral solid segment of the lower load-bearing structure provided with a spark-plug barrel accessible through a hole cut in the vertical wall of the cylinder-block head housing.

From the second elevated stage of the lower load-bearing structure a turret rises above each barrel and is provided in its center with a valve guide which keeps the stems of the valves associated with the subjacent combustion and explosion chambers in the upright position. The part of the horizontal surface of the second elevated stage around the circular barrel is provided with several bow-shaped openings connecting the tubes of the vertical water jacket situated in the wall of the cylinder motor CM1 with the adjacent main cooling-water reservoir.

The turrets support an important part of the upper load-bearing structure via three overhanging cylinders suspended from the said horizontal slab. Each cylinder is provided with a solid cylindrical section protruding from the center of its bottom and tightly packed into the collar cut out in the upper horizontal surface of each particular turret, each section being provided in its center with a valve guide suitably associated with that formed in the subjacent turret.

The horizontal slab separates the main oil reservoir located in the upper part of the housing of the cylinder block head from the reservoir for cooling water located in the lower part of the same housing. The suspended cylinders, being an integral part of the slab, are practically a part of the main oil reservoir, sheltering the valves with all their components and keeping them permanently immersed in the cooling-lubricating oil.

The vertical supporting wall of the slab, tightly lined against the vertical wall of the housing, is fixed by its lower end peripheral flange to the cover of the cylinder block and to the basic disc of the lower load-bearing structure altogether keeping the elements of the cylinder block and of the cylinder block head tightly attached to each other, ensuring at the same time their hermetic sealing against the penetration of oil and/or gases from the receptacles under pressure located between the cover and the superposed load-bearing disc.

The main water reservoir enclosed in the lower housing of the cylinder block head keeps all parts of the engine in that space permanently immersed in cooling water, sustaining at the same time the forced water circulation in the vertical water tubes in the wall of the cylinder motor (CM1), in the water jacket surrounding the combustion chambers and in the drilled headers formed in the body of the central turret, thus cooling the valves and supplying with the water the automatic valve-water injection system. Being connected with the radiator by a water-inlet and a water-outlet hose fixed on two opposite openings, provided with a thermostat and operated by a water pump, the water in the main water reservoir is always kept at a suitable working temperature, conveying the heat surplus, deriving mostly from the cooling of combustion chambers, associated cylinder motor CM1 and exhaust duct in the radiator and further into the air intake duct.

At the top of the upper load-bearing structure are formed at least four camshaft supports locked in the conventional way with the bearing caps suspended from the upper part of the housing altogether bolted with the top cover of the engine, thus enclosing the main oil reservoir which operates while permanently immersed in the pressurized circulating cooling/lubricating oil together with all components of the camshaft and the subjacent valves.

Each of the three cylinders suspended from the horizontal slab of the upper load-bearing structure encloses a tightly-inserted valve cage open toward the overhead camshaft, keeping the inserted valves with their associate springs and other accessories in a stable upright position aligned under their respective cams, altogether permanently immersed in the lubricating oil. In addition to the enumerated structural components the MME can be equiped with conventional auxiliary equipment and devices such as a flywheel, a starter, fuel pumps, mixers, governors, electronic injection system, speed controlling devices etc.

CHOICE OF THE WORKING CYCLE

The capability of the MME to operate selectively with different methods of operation is a consequence of its ability to work on a combined two/multistroke working cycle. The difference in the method of operation and output of a conventional ICE operated in a two stroke working cycle with respect to an engine of the same cubic capacity operated at a four stroke working cycle is the consequence of their entirely different configurations. By contrast, the MME of the invention can work with either cycle without any change of its basic design. Its double-acting compressors functions always at a two stroke working cycle while its cylinder motors can function at the same time at a different working cycle. Consequently, an MME of the invention operated with a two stroke working cycle can be converted, without any alteration of its basic construction, into a combined two/four, two/six and theoretically two/n-stroke working cycle engine by a simple modification of its camshaft and by the adaptation of its flywheel to the purpose. A particularly important consequence of this advantage is the possibility of choosing the working cycle compatible with the method of operation chosen to carry out a complete combustion of the fuels to be used for its operation adjusted at the same time to the purpose served by the engine. For example a two/six stroke working cycle can be used in an engine serving to supply compressed air by means of a single non-return valve installed on the outer wall of its compressed air distributor connected to an adjacent receptacle for compressed air.

The engine can be equipped with a bigger or heavier flywheel. In this way, the MME can be converted into a self-operated compressor to be used in public works or serving as a compressed-air source in a factory. However, whether such an engine will be operated in a two/six stroke working cycle or, for example, with a two/four stroke working cycle, will depend not only on the quantity of compressed air needed for the purpose but also on the kind of fuels and time needed for their complete combustion, which combined with speed of the engine are of greatest importance for the proper choice of the working cycle. Consequently the operation of the MME at a simple two stroke working cycle is less advantageous because the time left for constant volume precombustion of the mixture is limited to the duration of one stroke only and is thus three times shorter than in case of a two/four stroke operation of the same engine provided with two precombustion chambers;

the time left for the precombustion, being inversly proportional to the speed of the engine, restricts to some extent the choice of slow-burning fuels that require more time for a complete combustion;

the achievement of a satisfactory compression ratio in the explosion chambers of the Int. C. System is rather limited because the separation of the lower cylinder motor (CM2) from the upper cylinder motor (CM1) should not take place before the burnt gases from the previous working cycle are scavenged from the lower cylinder motor (CM2);

the lack of time prohibits the application of sophisticated methods of operation helpful in achieving a simultaneous and complete combustion of at least two kinds of fuels including one difficult to ignite, slow-burning fuel; and the output of the MME operated at a two/stroke working cycle with respect to the output of the same engine operated on a two/four stroke working cycle is reduced by about 45%. Regardless of the enumerated shortcomings of the MME operated in a two stroke working cycle, it is necessary to underline that the choice between a two/stroke and a two/multistroke working cycle of the MME does not have the same meaning as in the case of a conventional ICE.

The structural and operational characteristics of a two-stroke conventional ICE are different from those of its four-stroke variant. Among other well-known shortcomings, the two stroke ICE is economically and technically less adaptable to the requirements of speed variations and to high-speed operation so that according to R. Brun ("Science et technique du moteur diesel industrial et de transport"—Société des Editions Technip et Institut Francais du Petrole, Paris 1966–1976, Tome I, pages 315 to 321) a supercharged four-stroke ICE, with respect to an adequate two stroke ICE, represents "an extremely serious competitor to it".

A two stroke working cycle applied in the MME of the first embodiment in comparison with the same engine operated at a two/four stroke working cycle results in a constant volume precombustion lasting during a single stroke and limited to the upper precombustion chamber PCCH only. The lower, secondary combustion chamber Sec.CH associated with the exhaust combustion chamber ECCH serving as the passage to the exhaust gases, automatically becomes the part of the Int. C. System provided with compressed air remaining in the cylinder motors CM1, CM2, CM3 and their explosion chambers IECH, UECH, LECH, after the completion of the exhaust of the burned gases occurring during the first half of the second or exhaust stroke. In order to expand the one stroke constant volume precombustion also to chamber Sec.CH and its associated chamber ECCH, an additional exhaust valve as illustrated in the second embodiment should be built into the cylinder block. In both cases the use of quickly oxidizing high-quality fuels is indispensable. Therefore, in order to explain the real abilities of the MME, the following Detailed Description describes the MME of the first embodiment operated on a two/four-stroke working cycle with the simultaneous use of four different fuels, burnt in a combined Diesel-Otto combustion process.

SPECIFIC DESCRIPTION OF THE MME EXECUTED IN THE FIRST VARIANT

As stated above, the MME operated on combustion products functions in all its configurations on the same working principle with the possibility of applying different methods of operation, different fuels, most suitable working cycle etc. In order to exemplify these capabilities I shall describe the structural features of the MME of the first embodiment, illustrated in FIGS. 1, 2, 3, 4, 5 to be operated in a sophisticated method of operation as a hybrid external-internal combustion, two/four-stroke working cycle, multifuel combined Diesel-Otto engine. We shall see later that the same engine can be also operated on steam as illustrated in the fourth embodiment.

The engine consists of a cylinder block, a cylinder block head, a crankcase, a rod and crank assembly and of the auxiliary equipment.

Figure 2:
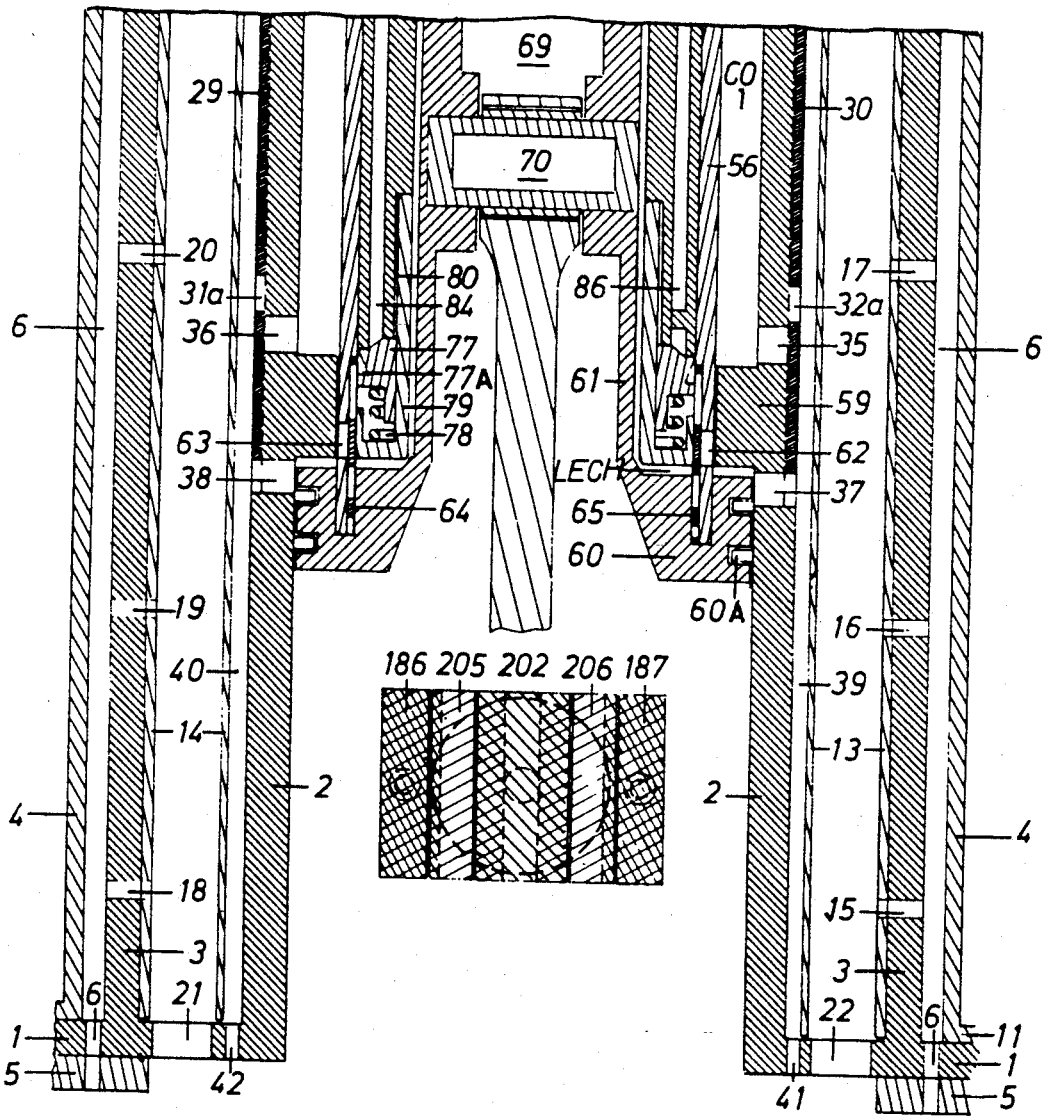

The cylinder block consists of a working cylinder 2 and an outer cylinder 3 rising in the form of a double-walled cylinder from a common bottom 1, the peripheral part of the bottom resting on a clamping plate 5 of the lower part of the crankcase (FIG. 2).

The upper end of the wall of the working cylinder 2 is fixed in a circular groove 9 (FIG. 3) cut in the lower surface of the cylinder block cover 10 which rests on the upper-end flange 12 of the outer cylinder 3 and bears on its peripheral surface 104 the basic disc 105 of the lower load-bearing structure, both fixed together by the bolts and screws, not represented. The outer cylinder 3 is kept in position by the casing 4 which is a vertical wall manufactured in one piece with the cylinder block cover 10 fixed by its lower-end flange 11 (FIG. 4) to the peripheral part of the bottom 1 and of the clamping plate 5, surrounding the entire cylinder block and enclosing the upper part of the crankcase 6.

The ring-shaped space between the working cylinder 2 and the outer cylinder 3 is divided in four twin opposite vertical compartments containing the bow-shaped frames of the air filters 13, 14 (FIG. 2) and oil filters 45, 46, (FIG. 3) all connected with the lower crankcase through the openings 21, 22, (FIG. 2), respectively 47, 48 (FIG. 4) formed in the bottom 1 of the double-walled cylinder.

The warm pressurized air blown by the impeller of the radiator through its air filter, not shown, located in the air-intake duct 8 (FIG. 1) enters through an arched opening 7 into the upper part of the crankcase 6 connected by the openings 15,16, 17,18,19,20 (FIG. 2) with the air filters 13,14 and further through the openings 21,22 pierced in the bottom 1 of the double-walled cylinder 2,3 into the lower crankcase not identified. Further compressed by the reciprocating movement of the piston, the hot precompressed air enters through the openings 41,42 into the air pockets 39,40 leading to the air intake ports 33,34 of the CM3, 35,36 of the CO1 and 37,38 of the CO2. The air intake is controlled by two opposite sliding valves 73,74 (FIG. 1) each operating two bow-shaped plates 27, 29, 28, 30 sliding in their respective slots 31,32, supported by the springs 25,26, kept in position by a bolt 23,24, protruding from the upper horizontal surface of the air-filter frames 13,14, each frame provided on the top by a bow-shaped prolongation guide 13*a*, 14*a*, the stem of each sliding valve 73,74 sliding in the pegged hole 71,72, part of the cylinder block cover 10 and in the hollow stem of the external valve 100,101, kept in the upright position by the valve guides 166,168; both sliding valves are with conventional valve tapets 200,201, operated by their respective cams 202,203. It should be emphasized that the size and position of the openings on the plates 29,30, controlling the air intake ports 33,34,35,36,37, 38, are adjusted to exercize their function when activated by a two-stage lift of their respective valves 73,74.

The two remaining vertical compartments opposed to one another serve as the oil-receiving receptacle 43 and the oil-returning receptacle 44 (FIG. 3) both provided with the oil-filter frames 45,46, of which the filter 45 is connected through the opening 47 with the lower crankcase and the filter 46 by an oil return pipe 48, to the outlet chamber of an oil pump, not shown, situated on the bottom of the crankcase. Both oil filter frames 45,46, are provided on their top horizontal surfaces with holes registering with holes 49,50 pierced in the cylinder block cover 10, connecting them with their respective oil collectors 51, 52. The working parts situated in the upper part of the cylinder block are lubricated by the oil forced through the oil feeders perforated in the internal vertical walls of the oil-filter frames 45,46, registering with the holes formed through the constriction 59 of the working cylinder 2. Moreover, the permanent draft of air forced through the air pockets 39,40, shall mix with the atomized oil sprayed from a predetermined number of small holes perforated in the internal vertical walls of the oil-filter frames 45,46.

Through a tightly-fitted passage 76 cut in the center of the cylinder block cover 10, a thick walled cylinder 53 (FIG. 1) is coaxially suspended in the upper part of the working cylinder 2, enclosing the upper cylinder motor CM1 and forming at the same time another annular cylinder motor CM3 (see also FIG. 1), connected among each other by the openings 54,55. In hte outer cylinder motor CM3 slides sealingly the outer cylindrical part 56 of a multipurpose piston the top of which is outwardly extended into a ringshaped piston 57, provided with piston rings 58, the upper surface of which closes the said cylinder motor CM3 while the lower surface, together with a constriction 59 protruding from the wall of the working cylinder 2 and with its internal wall 56 sliding against the said constriction 59, closes the upper compressor CO1, thus functioning as a double-acting working unit. The lower end of the cylindrical outer part 56 of the multipurpose piston is secured in a suitable way to the bottom 60 of the internal part of the piston 61, provided with piston rings **60*a*, enclosing together with the constriction 59 and the lower end horizontal surface of the suspended coaxial cylinder motor CM1-53, the lower cylinder motor CM2 and its compressor scavenger CO2, communicating with each other through the openings 62,63 controlled by the inertia valves 64,65 (FIG. 2). Moreover, the outer cylinder motor CM3 communicates through the opening 75 cut in the cylinder block cover 10, with the intake explosion chamber IECH situated in the cylinder block head. The top 66 of the inner hollow part of the piston, even in its BDP, remains in the upper cylinder motor CM1 without touching its lower unlined part, thus keeping the upper cylinder motor CM1 in connection with the lower cylinder motor CM2 until the top of the piston 66 enters into the upper lined part 68 of the cylinder motor CM1. Arriving at the TDP the inner part of the piston, namely its top 66 and its cavity 67 frame the upper explosión chamber UECH and, with its bottom 60**, the lower explosion chamber LECH.

Figure 5:
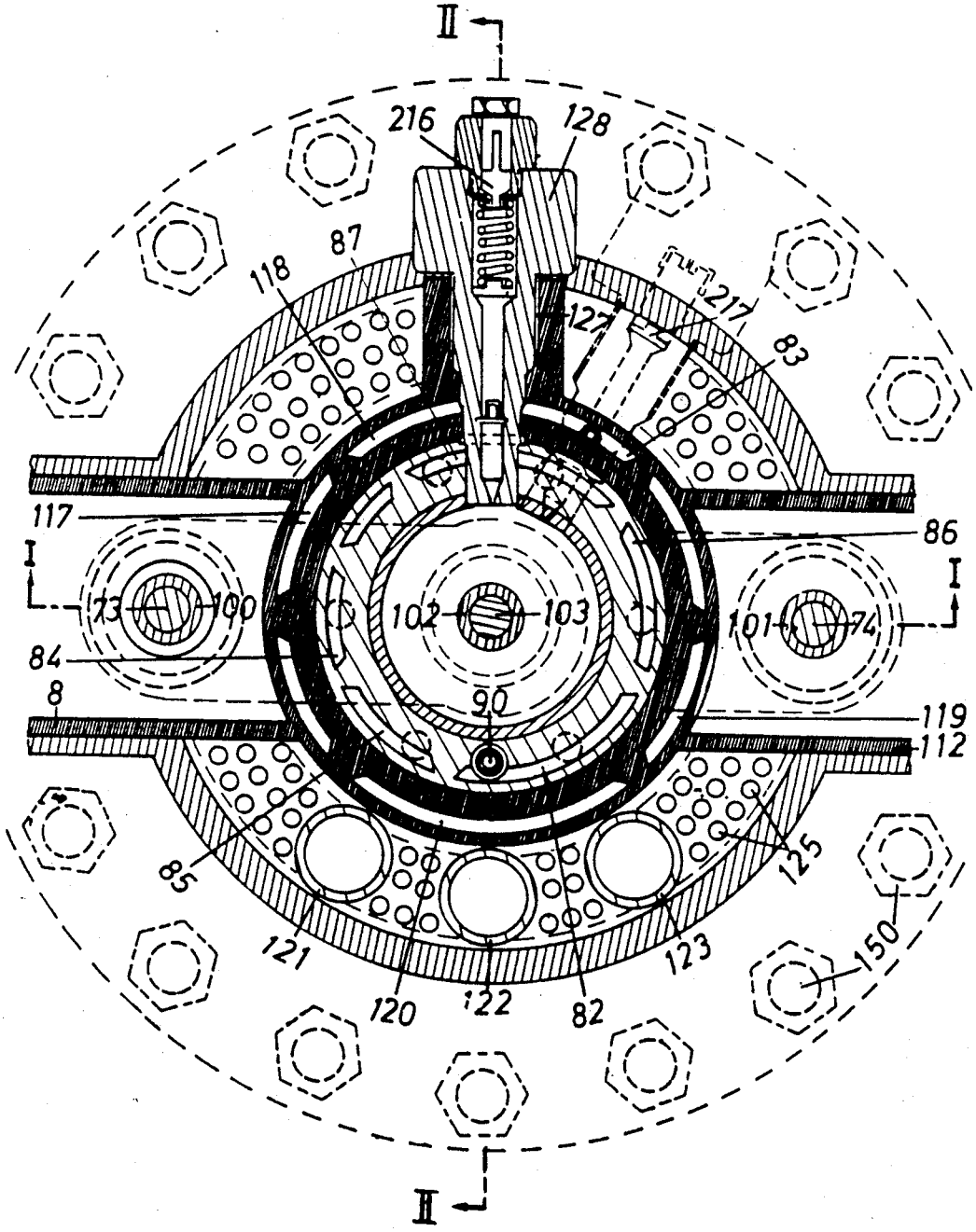
FIG. 5 is a section along line III—III of FIG. 1; IV—IV of FIG. 3; V—V of FIG. 7 and VI—VI of FIG. 9.

The hollow part 69 of the internal part of the piston 61 is secured in conventional way to a partially represented rod and crank assembly 70 lubricated by a splash of oil continuously flowing into the crankcase through the openings 21,22, 47, and by the conventionally drilled oil headers leading to the oil-spit holes provided at all spots requiring lubrication. The oil entering the crankcase is sucked by the said oil pump and forced back into the oil-returning system acting at the same time as a forced-feed lubrication and as a cooling medium. The thick wall 53 of the cylinder motor CMI bears on its lower end part, a triangular circular slot **77*a* oscillating on a spring 78, supported by a cylindrical bearer provided with a tread 80 screwed on the threaded edge cut all around into the lower end part of the internal wall of the cylinder motor 53, controlling the transfer of compressed air from the compressor CO1 through the opening 81 pierced in the wall 56 of the external part of the piston below its annular piston 57 into the vertical compressed air ducts 82,83,84 formed in the wall 53, 91 of the cylinder motor CM1, leading into the distributor of compressed air 88, separated from each other by the vertical water tubes 85,86,87 connected with the main water reservoir 89. In the same wall there is provided at least one camshaft operated fuel injector 90 (FIG. 5**).

Figure 3:
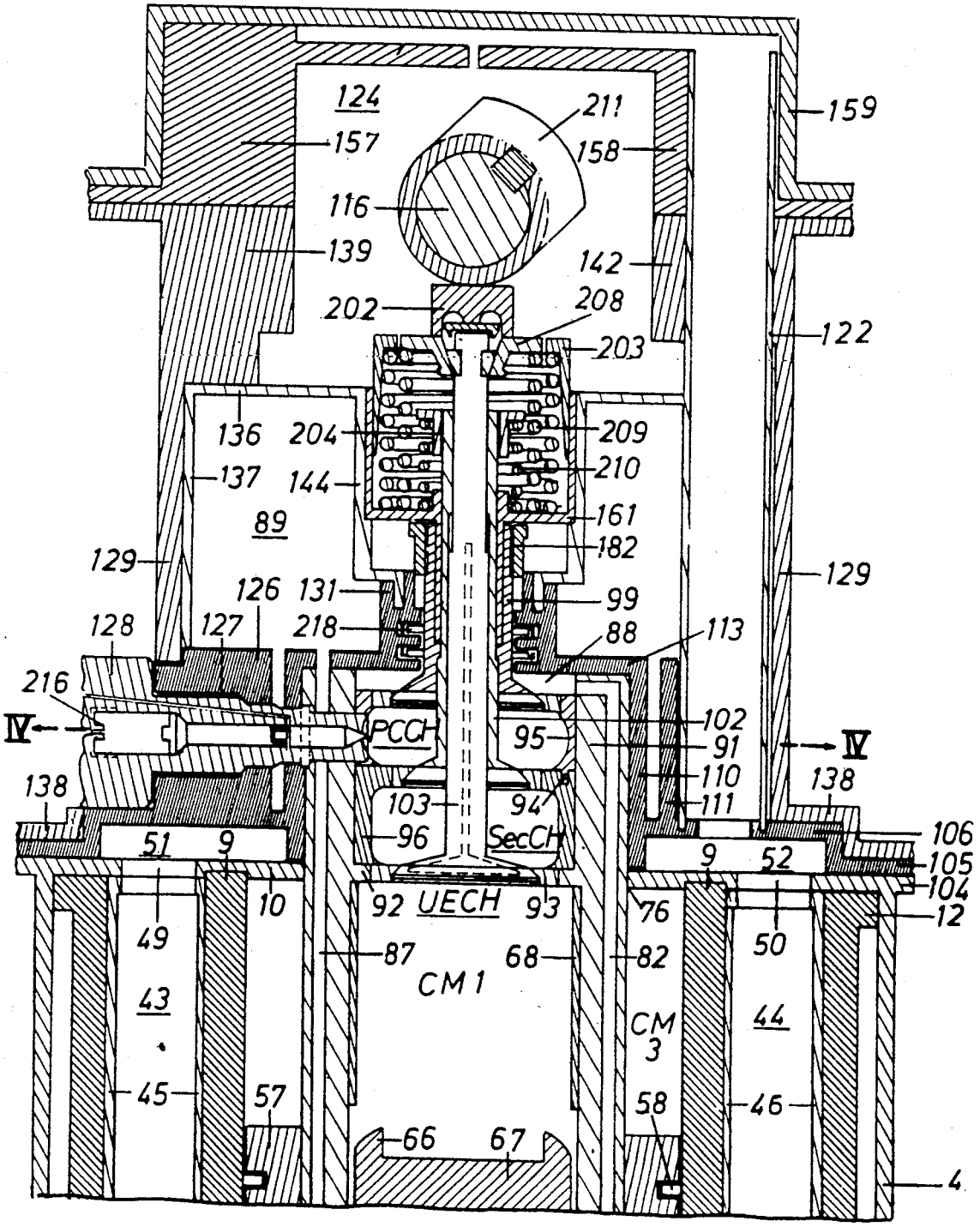
FIGS. 3 and 4 combined together represent in section along line II—II of FIG. 5 the first embodiment of the MME with the piston halfway from its TDP to BDP during the first intake stroke.

The cylinder block head contains:

The upper part of the cylinder motor CM1-91, situated in the cylinder block head, separated from its lower part 53 by a dividing plate 92 provided with a valve opening cut in its center, equipped with a valve seat ring 93, bearing on its peripheral surface two superposed exchangeable combustion chambers, namely an upper precombustion chamber 95 and a lower secondary combustion chamber 96 connected by a passage 97 into one working unit with a side exhaust combustion chamber 98 (FIG. 3). The two first mentioned combustion chambers namely, precombustions chamber PCCH-95 and secondary combustion chamber Sec.CH-96 are secured against turning by a peg 94 and provided with conventional fuel injectors 216,217. Both are operated by a single device consisting of three concentrically arranged valves of which the external valve 99, associated with the PCCH-95, controls the air intake from the distributor of compressed air 88, the tightness of which is ensured by the rings 213, the intermediary valve 102 associated with both PCCH-95 and Sec.CH-96 respectively its associated exhaust combustion chamber ECCH-98, controlling their successive connection and separation adapted to the method of operation, and the internal valve 103 controlling the connection of all three combustion chambers PCCH, Sec.CH, ECCH, through the upper explosion chamber UECH with all three cylinder motors CM1, CM2, CM3 and the two remaining explosion chambers, thus connecting the entire Ext. C. System with the Int. C. System of the engine.

The basic disc 105 is the foundation of a lower load bearing structure which consists of two elevated stages. The first elevated stage 106 is provided on its lower surface with the groove and tongue joined intervenings barriers, covering, enclosing and/or surrounding:

the oil receiving collector 51 and the oil returning collector 52 both extended over a ring-shaped surface between the IECH and the ECCH, the intake explosion chamber IECH 107 and the exhaust combustion chamber ECCH 98 both provided with valve openings equipped with the valve seat rings 108, 109 and operated by their associated valves 100,101, which are the external valves of their respective concentrically arranged double valve devices of which the internal stems 73,74 operate the described sliding valve plates 27,28,30,32. Both chambers are cooled with oil, continuously flowing through the adjacent oil collectors 51,52 and with water circulating through the tubes 85,86,87, of the water cooling jacket as well as with the oil circulating through the tubes 125 of the oil cooling heat exchanger and through the oil returning tubes 121,122,123; and the passage 97 is connecting the ECCH 98 with the Sec.CH 96.

The same first elevated stage 106 of the lower load bearing structure bears on its upper surface:

one circular barrel 110 whose outer cylinder 111 extends in opposite directions to form the air intake duct 108 and the burned gases exhaust duct 112, all manufactured in one piece, forming on their top the second elevated stage 113 of the lower load bearing structure, the said circular barrel in the form of a double walled cylinder 110,111, which shelters in its internal cylinder 110 the upper part 91 of the cylinder motor CM1 53 introduced in it through the hole 76 cut in the center of the cylinder block cover 10, tightly fixed by the set-screws 114,115, protruding from the top of its wall through the horizontal surface of the second elevated stage 113, keeping the entire cylinder motor CM1 91, 53, with already erected combustion chambers 95,96,97,98 and their associated valves 99,102,103, in a steady vertical position with their hollow stems sliding within one another, ascending toward the camshaft 116.

the space between the internal cylinder 110 and the external cylinder 111 is divided into four cooling water jackets 117, 118, 119, 120, open toward the adjacent main water reservoir 89.

the intake duct 8 and the exhaust duct 112 shelter the stems of the valves 73, 74, 100, 101. Both ducts are cooled by cooled water circulating in the adjacent main water reservoir 89.

three tubes of a larger diameter 121, 122, 123, welded in the holes cut in its 106 surface above the oil returning collector 52 are connecting it with the main oil reservoir 124 situated in the upper part of the engine.

a large number of small diameter heat exchanging tubes 125 (FIG. 5) welded on their lower end into their respective holes pierced in the first elevated stage 106 over its entire free bow-shaped horizontal surface extended over both oil collectors 51, 52.

a lateral solid segment 126 provided with a threaded opening 127 (FIG. 3) in which a conventional injector 216 is introduced and screwed into it through an opening in the external wall of the lower part of the cylinder block head housing 129.

The second elevated stage of the lower load bearing structure in the form of a horizontal longitudinal stretch 113, covering the barrels 110, 111 and both, intake and exhaust ducts 8, 112, bears on its surface three load bearing turrets 130, 131, 132, manufactured in one piece, with the lower load bearing structure (FIG. 1) each superposed upon its respective combustion or explosion chamber and each provided in its center with a collar 133, 134, 135 cut out in the peripheral surface of each particular turret 130, 131, 132.

The upper load bearing structure consists of a horizontal slab 136, manufactured in one piece with its supporting wall 137, which rests on the peripheral surface of the first elevated stage 106 of the lower load bearing structure, adhering to the vertical wall of the lower part of the cylinder block head housing 129 which fixed by its lower end flange 138 onto the basic disc 105, squeezes with its upper narrowed camshaft bearing supports 139, 140, 141, 142, the slab 136, thus keeping the entire upper structure of the engine in a steady position, joined with the cylinder block by the bolts and screws 150. The horizontal slab 136 (FIG. 3) being the principal element of the upper load bearing structure assumes the following functions:

separates the main cooling water reservoir 89 from the main oil reservoir 124, bears a large part of the load of the upper load bearing structure in truth of the entire upper part of the engine, by three vertical cylinders 143, 144, 145 suspended from the openings cut in its horizontal surface and open toward the main oil reservoir 124, provided with the holes cut in the center of their bottoms, pegged by the round shaped bearing shoulders 133, 134, 135, fit into the collars 133, 134, 135 of the turrets 130, 131, 132 (FIG. 1).

supports the camshaft 116 by the lower half of its journal bearings 146, 147, 148, 149, placed in the bearing supports 139, 140, 141, 142, protruding from its upper surface, enclosing together with the upper half of the camshaft bearing 151, 152, 153, 154 situated in the upper part of the cylinder block head housing 129, both halves of the camshaft casing fixed together by bolts and screws not shown in the drawing.

encloses together with its vertical wall 137 and the upper surface of the first elevated stage 106 of the lower load bearing structure the main water reservoir 89 provided with two opposite openings cut in the lower end part of the housing 129, not represented, linked by one inlet and one outlet hose to the conventional equipment of a water cooling system, consisting of a water pump with a thermostat and a radiator constructed in a particular way, being equipped with a powerful impeller blowing the warm air from the radiator into the air intake ducts 8, 7, and through the air filters into the cylinder motors CM1, CM2, CM3 and the compressors CO1, CO2.

The water cooling system keeps all the elements of the MME situated within the reach of the main water reservoir 89, permanently immerged in the water circulating through the tubes of the water jacket 85, 86, 87, cooling simultaneously the compressed air ducts 82, 83, 84, pierced in the wall of the cylinder motor CM1 53, 91, as well as those situated between the walls of the cylinders 110, 111 of the circular barrel 117, 118, 119, 120, the valve cooling system 155 and the valve-water injecting system 156, keeping the water at a suitable working temperature by transmitting the heat surplus, deriving from cooling of all cylinder motors CM1, CM2, CM3, their adjacent compressors CO1, CO2, combustion chambers 95, 96, 98, 107, and the exhaust duct 112, into the radiator and back into the air intake ducts 8, 7, closing together with the oil cooling tubes 125 the cycle of a multimedia heat exchanger, secures a sealed passage of the oil return tubes 121, 122, 123, into the main oil reservoir 124 and of the tube-injector tube 90 toward the camshaft 116, serves as the shell of the heat exchanger, the upper ends of the small diameter heat exchanging tubes 125 grooved sealingly or welded in nuts of their respective openings pierced in its bow-shaped surface, and serves as the bottom of the main oil reservoir situated in the uppermost part of the engine enclosed between the housing 129 of the cylinder block head, lower camshaft bearing supports 139, 142, upper camshaft bearing supports 157, 158 and the top cover 159 of the MME, all fastened together by their circumferential flanges fixed by bolts and screws, not shown.

Each cylinder 143, 144, 145 suspended from the slab 136 shelters a tightly inserted cylindrical valve cage 160, 161, 162 (FIG. 1), opened toward the overhead camshaft, its bottom resting on the contracted lower part 163, 164, 165 of the internal wall of the load bearing cylinder 143, 144, 145, each cylinder cage provided in the center of its bottom with an opening vertically extended into a rigid valve guide 166, 167, 168 descending deep into the turret 131, 132, 133 and with two opposite round shaped slide sockets vertically perforated in the thicker part of its wall 169, 170, 171, 172, 173, 174, situated along the camshaft serving as the guide for the from down inserted prong-stems 175, 176, 177, 178, 179, 180 of a double stemmed fork valve screwed by its eye bolt 181, 182, 183, on the upper part of the threaded hollow stem of the respective external valve. The fork valves exclusively operate the external valve 100, 101, 99, each of them by two identical valve tappets 184, 185, 186, 187, 188, 189 in the form of rectangular plates, activated in a synchronized manner two by two by their respective distant but equally positioned cams 190, 192, 193, 194, 195. Each of the two tappets are supported by their respective common valve springs 196, 197, 198 covered by the tappets 199, 202, 208, the cylindrical part of which slides against the internal wall of the cage 160, 161, 162.

The air intake and the exhaust of the burned gases are operated by two identical devices, each consisting of two concentrically arranged valves of which the stem of the internal valve slides in the hollow stem of the external valve. The internal valves 73, 74, covered by their respective tappets 200, 201, rest on their respective valve springs 25, 26, situated in the cylinder block, supported by the frames of the air filters 13, 14, kept in position by the vertical bolts 23, 24, and the bow shaped prolongation **13*a*, 14*a*, of the frames 13, 14, and by their own sliding plates of which the outer 27, 28, slide against the prolongation 13*a*, 14*a*, and the inner 29, 30 slides in their respective vertical slots cut in the outer wall of the working cylinder 2, controlling the air intake ports 33, 34, 35, 36, 37, 38. The forked external valve 100 (FIG. 5) controls the air intake into the intake explosion chamber IECH and through it, in all three cylinder motors CM1, CM2, CM3. The tappets 184, 185 of its stems 175, 176, are operated by the cams 190, 191 (FIG. 5) and supported by the spring 196 or its cover 199. The other forked external valve 101 associated with the exhaust combustion chamber ECCH controls the exhaust of the burned gases from the entire combustion space of the engine. The tappets 188, 189 of its stems 179, 180 are operated by the cams 194, 195, and supported by the valve spring 198 or by its cover 208**.

The combustion chambers of the Ext. C. System, PCCH and Sec. CH are operated by a device consisting of three concentrically arranged valves, an external valve 99, an intermediate valve 102 and an internal valve 103 (FIG. 1). All these valves are capable to work independently and in groups according to the requirements of the method of operation, chosen by way of example, described in the following chapter. The combined tappet of this three-valves device consists of five rectangular plates situated alongside each other. The central plate 202, which is the tappet of the internal valve 103, not being circular, is supported only by two opposite arc segments of its spring 209 situated below a single cam 211. In this way, both sides along the central plate 202 are free to accommodate the adjacent plates 206, 205, each born by one half of a support protruding upwards from two opposite sides of the eye bolt 204 screwed on the stem of the intermediate valve 102, operated by their respective cams 214, 215, supported by its own spring 210. However, beside this support, these two half-tappets rest each on its part of the lower circular part of the tappet 202 and are also supported by the spring 197, which simultaneously supports the outermost plates 186, 187, fixed on their respective forked valve stems, resting on two opposite segments of the said circular tappet 202, which keeps them in a stable horizontal position, supported from below by the said supports protruding from the eye bolt 182. The external valve 99 is operated by its outermost plates 186, 187, and their respective cams 192, 193 in the same way as by operation of the two-valves device described above.

METHOD OF OPERATION OF THE FIRST EMBODIMENT

The described concentrically arranged three-valve device illustrated in FIGS. 1 and 2 due to the independent activation of all its valves enables the application of a sophisticated method of operation which ensures the recovery of the compressed air during the exhaust stroke, a most effective combustion of different fuels burning at a constant volume precombustion in separated combustion chambers, the mixing of different burning mixtures at any appropriate moment, the separate scavenging of the precombustion chambers of the Ext. C. System etc. By way of example I shall describe the MME executed in the first variant occurring to the above mentioned method of operation at a combined two/four stroke working cycle as a hybrid Diesel-Otto engine, using simultaneously four different fuels, namely—fuel oil, gasoline, alcohol and natural gas, regularly injected with a preselected quantity of water, with the recovery of the compressed air during the second exhaust stroke and the scavenging and the injecting of the PCCH at the very beginning of the exhaust stroke. Nevertheless, similar or better results can be achieved with the same engine, for example with an additional explosion - exhaust chamber as illustrated in the second and third embodiment, which allows the prolongation of the constant volume precombustion, particularly advantageous in the case of utilization of certain slow burning fuels.

Figure 6:
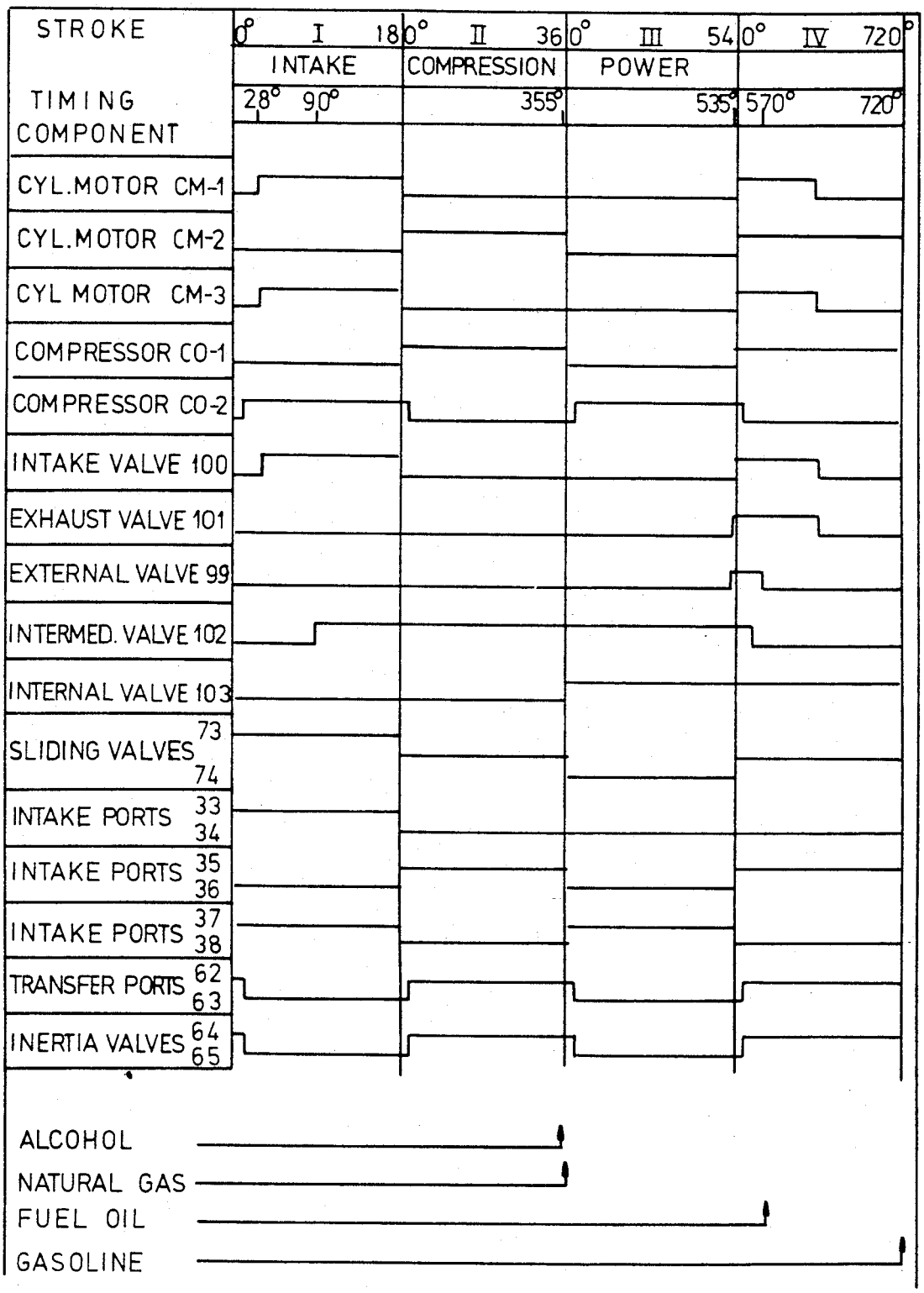
FIG. 6 is an explanatory diagram of the operation of the MME shown in FIGS. 1,2,3,4, and 5.

At the end of the previous working cycle illustrated in FIGS. 1, 2, with the piston in its TDP (top dead position) and the crankshaft in the position 0° (FIG. 6), the external valve 99 (FIG. 5), the intermediate valve 102, the internal valve 103 and the exhaust valve 101 are closed. In the PCCH 95, the constant volume precombustion of a rich mixture of fuel oil and compressed air burns during the entire stroke.

In the Sec. CH 96 and its associated ECCH 98, a separate constant volume commences of a poor selfignited mixture of gasoline injected by the injector 217 into the compressed air recovered during the last stroke of the previous working cycle. The air intake valve 100, the air intake ports 35, 36 controlled by the slide valves 73, 74, the inertia valves 64, 65, and their transfer ports 62, 63 are closed. The air intake ports 33, 34, 37, 38 controlled by the same above mentioned sliding valves 73, 74 are opened.

At the beginning of the first stroke which is the air intake stroke of a combined two/four stroke working cycle and which corresponds to the movement of the piston 56, 57, 60, 61, 70, from its TDP to its BDP (bottom dead position), with the crankshaft in 0° position and both sliding valves 73, 74 in their upper lift position, the air intake ports 33, 34, are opened but being obturated by the external piston 57 and with the air intake valve 100 closed, the cylinder motors CM1 and CM3 remain practically closed until the highly compressed air recovered in the Int. C. System during the last stroke of the previous working cycle expands sufficiently to avoid its draw back into the vertical air pockets 39, 40, and into the duct 8. At the same time, the inertia valves 64, 65, under the inertia force acquired during the previous stroke, stimulated by the change of the direction of the piston movement close their transfer ports 62, 63 allowing the compressor-scavenger CO2 to start the first air intake stroke of its two stroke working cycle. Meanwhile, with its intake ports 35, 36, closed, the compressor CO1 starts to compress the air aspirated during the previous working cycle, and during the first intake stroke of its two-stroke working cycle.

At 28° of the first crankshaft revolution simultaneously with the opening of the air intake valve 100, the annular part of the external part 57 of the external part of the piston starts to uncover the intake ports 33, 34 of the CM3. The already sufficiently reduced pressure of the air remaining in the Int. C. System from the previous working cycle allows the already once filtered, precompressed hot air forced by the impeller of the radiator, not shown, into the duct 8, to enter through the opened air intake valve 100 and adjacent openings 75, 54, 55 into the IECH, CM3, UECH, CM1 and further through the slots, not represented, cut into the body 61 of the internal part of the piston into the LECH and CM2. At the same time, the precompressed air from the same duct 8 enters through the bow shaped opening 7 into the upper part of the sealed crankcase 6 penetrating simultaneously through the openings 15, 16, 17, 18, 19, 20, into the air filters imbibed with oil and through the openings 6, 21, 22 into the lower crankcase from which already twice filtered and further precompressed hot air by the reciprocating movement of the piston is forced through the openings 41, 42 into the vertical air pockets 39, 40, leading through the open air intake ports 37, 38, 34, 33 into the compressor-scavenger CO2 and the cylinder motors CM3, CM1.

At 80° of the first revolution of the crankshaft the top 66 of the internal part of the piston 61 is out of the upper lined part 68 of the CM1, causing the unification of all three cylinder motors CM1, CM2, CM3 and their explosion chambers IECH, UECH, LECH into a single Int. C. System.

At 90° of the first crankshaft revolution, by the independent opening of the intermediate valve 102, the PCCH and the Sec. CH with its associated ECCH are unified into a single combustion unit and their respective burning mixtures into a single burning mixture, improved by a precisely determined quantity of water admixed to it automatically by each independent lowering of the intermediate valve 102, respectively of its water injector 156.

At the end of the first stroke at 180° of the revolution of the crankshaft with the piston at its BDP, the air intake valve 100 and the sliding valves 73, 74 controlling the intake of the precompressed air into the Int. C. System are closed. The compressor CO1 is completing the second stroke of its previously started two stroke working cycle, by delivering through the disc valve 77 and the vertical air ducts 82, 83, 84 a complete charge of the compressed air into the distributor of compressed air 88.

The compressor CO2 is full of the precompressed hot air.

The constant volume combustion of the combined fuel oil, gasolin, compressed air and steam mixture burning in the hermetically closed PCCH, Sec. CH and ECCH has already achieved the duration of two complete strokes, reckoning from the injection of the fuel oil into the PCCH.

The second stroke of the combined two/four stroke working cycle corresponds to the movement of the piston 56, 57, 60, 61, 70, from its BDP to its TDP. It begins at 180° of the first revolution of the crankshaft with the piston in its BDP, the closing of the air intake valve 100 and the lowering of the sliding valves 73, 74 from their second stage lift to their first stage lift, the closing of the intake ports 33, 34, 37, 38, the opening of the intake ports 35, 36 and soon after the beginning of the piston's movement toward its TDP the connecting of the compressor CO2 with the CM2 through the transfer ports 62, 63, uncovered by their respective inertia valves 64, 65, still subjected to the inertia force acquired during the previous stroke.

Moving toward its TDP the piston 56, 57, 60, 61, 70 compresses equally the entire body of air enclosed in all explosion chambers of the Int. C. System. At 280° its top 66 entering into the upper lined part 68 of the CM1, throttles the connection between the CM1 and the CM2, and between the IECH and UECH on one side, and the LECH with its vertical prolongation on the other side, limiting their communication to a throttled connection through the said vertical slots cut in the body 61 of the internal part of the piston, the number and the size of which determine the difference in the compression ratio of the said two groups of explosion chambers. Simultaneously the external part of the piston 56, 57, compresses the air enclosed in the CM3. At 350° i.e. 10 degrees before the arrival of the piston in its TDP, the air compressed in the IECH is injected with alcohol. The largest part of the resulting self ignited mixture remains in the IECH because its communication ports 75, 54, 55, are obturated by the rising piston 57, 66, separating it from the adjacent UECH which consequently remains filled with the preheated compressed secondary air. At that time the precombustion of the combined mixture in the Ext. C. System has achieved almost the duration of three entire strokes.

At 355° i.e. 5 degrees before the arrival of the piston 57, 66, in its TDP, the air compressed in the LECH and in its vertical extension is injected by the vertical injector 90 with, for example, natural gas, and at the same time, the internal valve 103 associated with the Sec. CH is opened. The entire combustion space of the Ext. C. System is connected with the entire combustion space of the Int. C. System. An extremely tumultuous interblending of different burning fuel-air-steam mixtures with preheated secondary air penetrate around the internal part of the piston 61 into the cylinder motor CM2 to mix and burn together with the self ignited mixture of the compressed air and the natural gas already burning in the LECH, accelerating a remarkably powerful accumulation of the energy in the entire combustion space of the MME, reaching its peak just at the moment of the arrival of the piston in its TDP, continuing to burn in a variable volume combustion, exercising an uniform thrust against the entire surface of the piston 61, 67, 57, 60 during the entire following power stroke.

During the same second stroke the compressor CO1 is filled with precompressed air aspirated through the vertical air pockets 39, 40, and its intake ports 35, 36.

At the beginning of the third stroke which is a power stroke of a combined two/four stroke working cycle, corresponding to the movement of the piston 57, 61 from its TDP to its BDP, with the crankshaft at 360° starting its second revolution, the entire combustion space of the MME hermetically closed is full of burning gases, exercizing a powerful thrust against the entire surface of the piston in all three cylinder motors CM1, CM2, CM3. However, to enable the CO1 to compress the air aspirated during the previous stroke and the CO2 to aspirate a new charge of the forced precompressed air, the sliding valves 73, 74 are lowered at the very beginning of the stroke to their second stage valve lift, leaving the intake ports 33, 34, closed, closing the intake ports 35, 36, and opening the inatake ports 37, 38.

At 535, i.e. 5 degrees before the arrival of the piston in its BDP, the external valve 99 is opened for a short time (FIG. 6) in order to allow the compressed air from the distributor 88 to scavange the PCCH from the burned gases and to fill it with compressed air which after a brisk successive closing of the intermediate valve 102 and the external valve 99, will be injected with the fuel oil by the injector 216 so that the obtained rich self-ignited mixture shall start the constant volume precombustion already at the moment of the arrival of the piston in its BDP. At the same time, the CO1 delivers its second charge of compressed air through its transfer opening 81 and its associated lower disc valve 81, 79 into the vertical compressed air ducts 82, 83, 84, leading into the compressed air distributor 88. The CO2, full of precompressed air, is still separated from the CM2. The constant volume precombustion in the PCCH already lasts for an entire stroke.

During the fourth stroke which is the exhaust and final stroke of the four stroke working cycle, at the very beginning of the movement of the piston 56, 57, 60, 61, 70, from its BDP to its TDP, thanks to the upward movement of the second stage valve lift of the sliding valves 73, 74, and of their bow shaped sliding plates 30, 32, the intake ports 35, 36, of the CO1 are opened, and the intake ports 37, 38 of the CO2 are closed along with the intake ports 33, 34 of the CM3 which consequently remain closed during the third consecutive stroke.

Simultaneously with the beginning of the upward movement of the piston, the exhaust valve 101 is opened and the inertia sliding valves 64, 65 controlling the connection between the CO2 and CM2, still under the moment of inertia acquired during the previous stroke, uncover the transfer ports 62, 63, connecting the CO2 full of precompressed air with the CM2 full of burned gases. Due to the fact that the air enclosed in the compressor CO2 is forced into the CM2 during the entire stroke and just below the lowest layer of the burned gases speeding toward the exhaust duct 112, the scavenging is completed with about 9/10 of the precompressed air remaining in the combustion space at the moment of the closing of the exhaust valve 101 (Prof Schmidt page 206) which in the case illustrated in the drawings FIGS. 1, 2, 3, 4, 5, shall occur at 580°, when the piston covers 22% of its 23 cm high stroke. By the rise of the piston 56, 57, 60, 61, 70, toward its TDP, this air is compressed in all explosion chambers and in the combustion chambers except in the already closed PCCH. The compression ratio will amount to 19.6:1 and the part of the compressed air recovered in the Sec. CH and ECCH according to their cubic capacity can be 42% of the total. This calculation, adapted to the circumstances, should be taken into consideration already at the designing of the MME first embodiment.

At 720° when the piston arrives in its TDP the internal valve 103 is closed, the compressed air in the Sec. CH and ECCH is injected through the injector 217 with gasoline in a poor structure so that the self-ignited mixture starts the constant volume combustion at the very beginning of the following working cycle. At that moment the fuel oil mixture in the adjacent PCCH has already been burning for an entire stroke, thus the situation being exactly the same as at the beginning of the described working cycle.

Summing up the described method of operation, the precombustion lasts in the PCCH over three strokes of which, one stroke initiates a separate combustion of a rich heavy oil mixture which continues to burn during the following two strokes, together with a poor mixture of a quickly oxidizing fuel injected into the compressed air recovered during the fourth-exhaust stroke in the Sec. CH and the ECCH. The realization of this process is possible due to the particular construction of the concentrically arranged three-valve device, allowing the independent opening of each particular valve, thus allowing the mixing of two different combustion products before their penetration into the Int. C. System. The same valve device is capable to keep the MEP of the combustion products on the same level during the entire power stroke by an adequate timing of the successive opening of the internal 103 and the intermediate valve 102. We shall see later that this advantage is of big importance in the fourth steam embodiment of the MME in order to improve the efficiency of the steam injector 271.

By the construction of an additional exhaust valve in the cylinder block as illustrated in the second and the third variant, the duration of the constant volume combustion in the Sec. CH and the ECCH can be prolonged in order to match with the duration of the constant volume precombustion occurring in the PCCH. This solution is preferred with slow burning fuels as well as where recovery of the air in the combustion chambers of the Ext. C. System is considered as superfluous. It can also be useful when the used fuel does not need for a complete combustion more than one stroke of the constant volume combustion plus one stroke of the variable volume combustion, thus allowing the MME to operate in a two-stroke working cycle.

Another important advantage of the first embodiment is the active surface of its piston which is equal to the active surface of the piston of an ICE of a bore equal to the bore of the largest compressor associated with the working cylinder of the MME, in spite of the thickness of the wall of the cylinder motor CM1 which limits stroke volume the working cylinder.

Furthermore, performing a simultaneous combustion of several kinds of different fuels at several levels one over another allows the use of the lower cylinder motor CM2 adapted to the purpose as an additional four stroke conventional ICE.

The second compressor CO2 serving as a turbocharger responsible for a perfect scavenging of the Int. C. System and the recovery of an important part of the air during the exhaust stroke can exercise these functions due to its inertia valves 64, 65, of the kind used in the second and the third embodiment as the principal regulators of the air intake.

Finally, the described method of operation can be adapted to the requirements of a complete combustion by the adjustment of the camshaft and the timing of the valve operation.

THE SECOND EMBODIMENT

As already stated the MME in all its embodiments always retains the same basic construction and uses the same working principle. Its second embodiment differs from the described first embodiment in the construction of the cylinder block and particularly in the internal part of the piston. Its cylinder block head is exactly of the same construction, allowing the same options concerning the choice of the suitable method of operation. Some other differences in the construction of the MME executed in other embodiment as for example a double connecting rod, different construction of the working cylinder, elimination of the outer compressors, position, number and size of the air intake ports, etc. are not the particular properties of any embodiment of the MME. They can be applied in all of them without producing changes in the working principle.

Nevertheless, in an abreviated description we shall emphasize the principal particularities of the MME executed in the second embodiment, but to avoid an increase in the number of drawings we shall use the numbers of the analogous parts described in the first embodiment whenever convenient to present the same element or elements exercising the same function in both variants. The MME executed in the second embodiment consists of a cylinder block comprising an outer cylinder 3 bolted on the clamping plate 5 of the lower crankcase, not represented, and an inner cylinder 2 which is the working cylinder of the engine suspended by at least two opposite tongue-shaped projections 219, protruding from its upper end part, slotted into the upper-end wall of the said outer cylinder 3. The lower-end part of the working cylinder 2 is supported by the same clamping plate 5 of the crankcase which supports at the same time the oil filter 220 and the air filter 221 inserted between the outer cylinder 3 and the working cylinder 2 below the inner right extension 222 of the outer cylinder 3 enclosing the lower exhaust duct 223 and its left extension 224 supporting by its vertical bolt 24 the spring 25 of the sliding valve 73 and enclosing the air intake bow-shaped passage 7, connected by the air duct 8 with the impeller of the radiator not represented. The upper-end flange 11 of the outer cylinder 3, the peripheral part 104 of the cylinder block cover 10, the basic disc 105 of the lower load-bearing structure 106 and the lower-end flange 138 of the second elevated stage 113 and housing 129 are fixed altogether by bolts and screws 50 into a single peripheric flange of the engine. From the second elevated stage 13 of the basic disc 105 of the lower load-bearing structure is suspended a shorter coaxially-mounted thick-walled cylinder 91, 53, screw bolted to the said second stage 113, penetrating into the cylinder block and dividing the working cylinder 2 into an outer ring-shaped compartment enclosing the outer cylinder motor CM2, and an inner enclosure used as the inner cylinder motor CM1. The thick wall of this suspended CM1 contains the vertical tubes of the water-cooling jacket 85, 86, 87, and the compressed air ducts 82, 83, 84, the same as in the first variant with the single difference that the ring-shaped receptacle 79 with its disc valve 77 controlling the transfer of compressed air into the said vertical ducts 82, 83, 84, built in the first variant into the lower-end part of the wall of CM1, consists in the second variant of a receptacle 79 serving as the bottom of the cylinder motor CM1, equipped with an upper 225 and a lower 226 disc valve, both connected with the compressed air ducts 82, 83, 84. This bottom is provided in its center with an opening big enough to slide through it a tube-shaped upper connecting rod 227 which is an integral part of the lower solid part of the piston 228 to which is fixed by a bolt 230 and screw 231 the upper part of the piston 229 which, provided with the piston rings 232 and pierced by the air-cooling headers 237, slides against the internal wall of the lower part 53 of the cylinder motor CM1. The internal wall of the CM1 serves also as the common cylinder to the upper inner compressor CO1, situated between the lower surface of the upper part of the piston 229 and the upper disc valve 225 which is the part of the bottom of CM1. The lower part of the piston 228 in the form of a sliding trunk is pierced in its center by a through hole 233 which opens the said tube-shaped upper connecting rod 227 toward the crankcase. The lower part of the piston 228 is laterally extended up to the internal wall of the working cylinder 2, provided with the piston rings 234, pierced close to its periphery with several through holes traversed by stud bolts 235 protruding from the lower end of the outer cylindrical part 56 of the piston which, fixed by the screws 236 to the lower part of the piston 228, slides against the outer wall of the cylinder motor CM1, enclosing with the said tube connecting rod the second inner compressor CO2 situated between the bottom 239 of the CM1 and the upper surface of the lower part of the piston 228, delivering compressed air through its lower disc valve 226 into the receptacle 239 which is the bottom of the CM1. The lower part of the piston 228 is vertically extended forming two opposite piston-boss bushings 238 lodging the piston pin 240 of a forked connecting rod 241 and connecting the entire piston 228, 238, 227, 229, 56, 57 with the crankshaft, not represented.

The upper end of the outer cylindrical part of the piston 56 bears on its top annular piston 57 provided with the piston rings 58 sliding against the inner wall of the working cylinder 2, enclosing with its upper surface the outer cylinder motor CM2 permanently connected through the opening 75 with the IECH and through the opening 242 with the EECH which, associated with the internal valve 74, controls the exhaust of the burned gases from the entire Int. C. System guiding them into the lower exhaust duct 223, connected with the main exhaust duct 112 which, associated with the external valve 101, controls the exhaust of the burned gases from the Ext. C. System. The IECH and the EECH are permanently connected with the UECH, respectively with the CM1, through the openings 243, 244. The lower surface of the annular piston 57 encloses with a constriction 59 protruding from the inner wall of the working cylinder 2 an outer compressor CO3 which delivers compressed air into the distributor of compressed air 88 by the ducts 82, 83, 84, through the openings 247, 248, controlled by a disc valve 249, supported by the spring 250 resting on the said constriction 59. The upper surface of the extended circumference 251 of the piston 228 forms with the lower surface of the constriction 59 the second outer compressor CO4 which is permanently connected with the CO3 through the opening 245.

The air intake into the cylinder motors CM1, CM2, occurs simultaneously through the IECH controlled by the external valve 100 of a device consisting of two concentrically arranged valves of which the internal stem 73 operates the sliding valve controlling the air-intake ports 252 of the CM2 and the air-intake ports 246 and 253 of the compressors CO3, CO4 activated by a two-stage valve lift as described in the first variant. Both described exhaust valves 74, 101 are also operated by a single device consisting of two concentrically arranged valves.

The air intake into the inner compressors CO1, CO2 occurs through the intake ports 254, 255, provided on the wall of the tubed connecting rod 227 of the piston 229, controlled by the inertia valves 256, 257, sliding in their respective slots cut in the wall of the tube. The connecting tube 227, being an integral part of the body of the piston 228, fixed to its upper annular part 57 and to its outer cylindrical part 56, follows the reciprocating movement of the piston and transmits its motion to the sliding inertia valves 256, 257, which, by retaining with each stroke the movement imposed during the previous stroke, reciprocally cover and uncover the intake ports 254, 255, connecting alternatively both inner compressors CO1, CO2, with the crankcase full of precompressed hot air.

In order to eliminate the noise caused by the uninterrupted to and fro movement of the sliding inertia valves 256, 257, the slots of their arresting device 258, 259, are cut so tightly that the shock of their weight shall be absorbed by the air compressed by their entry into their respective slots the bottom of which is lined with hard rubber.

An important advantage of the MME executed in the second embodiment represent its above described lower exhaust duct 223 which enables earlier closing of the internal valve 103 and consequently the prolongation of the constant volume combustion for the duration of an entire stroke. However, this solution is less convenient for the recovery of compressed air, because the cubic capacity of this additional exhaust explosion chamber EECH increases the negative space in which the part of the recovered air has to be unnecessarily compressed. In addition the recovery requires perfect escavenging with sufficient air surplus remaining in the cylinder motor CM1 after the exhaust of the burned gases, which in the second embodiment can be attained only by the conversion of the internal compressor CO1 into a compressor-scavenger by cutting the transfer canals into the lower-end part of the internal wall of the inner cylinder motor CM1 sufficiently high to transfer its cotent into CM1. Of course the upper disc valve 225 should be eliminated. Consequently, the MME executed in the second embodiment is more appropriate to function without air recovery, because it has a big air surplus and, having no need to open the internal valve 103 except during the power stroke its postponed opening shall cause the prolongation of the constant volume combustion for an entire stroke.

CONSTRUCTION FEATURES OF THE MME THIRD EMBODIMENT

We shall see later that in comparison with a conventional ICE of the same bore/stroke the MME of the first and second embodiments will be too powerful to be used as substitute in the place of conventional small ICE mostly used as transport engine. For this purpose the MME should be miniaturized to such an extent that the solution to the problem of big power transmission to be developed in a small cylinder shall require a great deal of additional efforts which we prefer to postpone to a later time. For the time being, we shall rather remain as close as possible to the dimensions practiced in the construction of the conventional ICE, which should also be useful for the manufacturing of the MME in the existing factories without new investment. However, if built out of elements dimensioned after those of a comparable conventional ICE, even with a reduced number of cylinders, the force of the MME shall exceed by far the output needed for the purpose, particularly by the automotive engines. This excessive power can be reduced:

by the reduction of the bore/stroke of the cylinder motor CM1, by the elimination of the outer compressors, by increasing the diameter of the piston's air intake connecting tube, by decreasing the thickness of the wall of the cylinder motor CM1, by reducing the governed speed of the engine.

Figure 9:
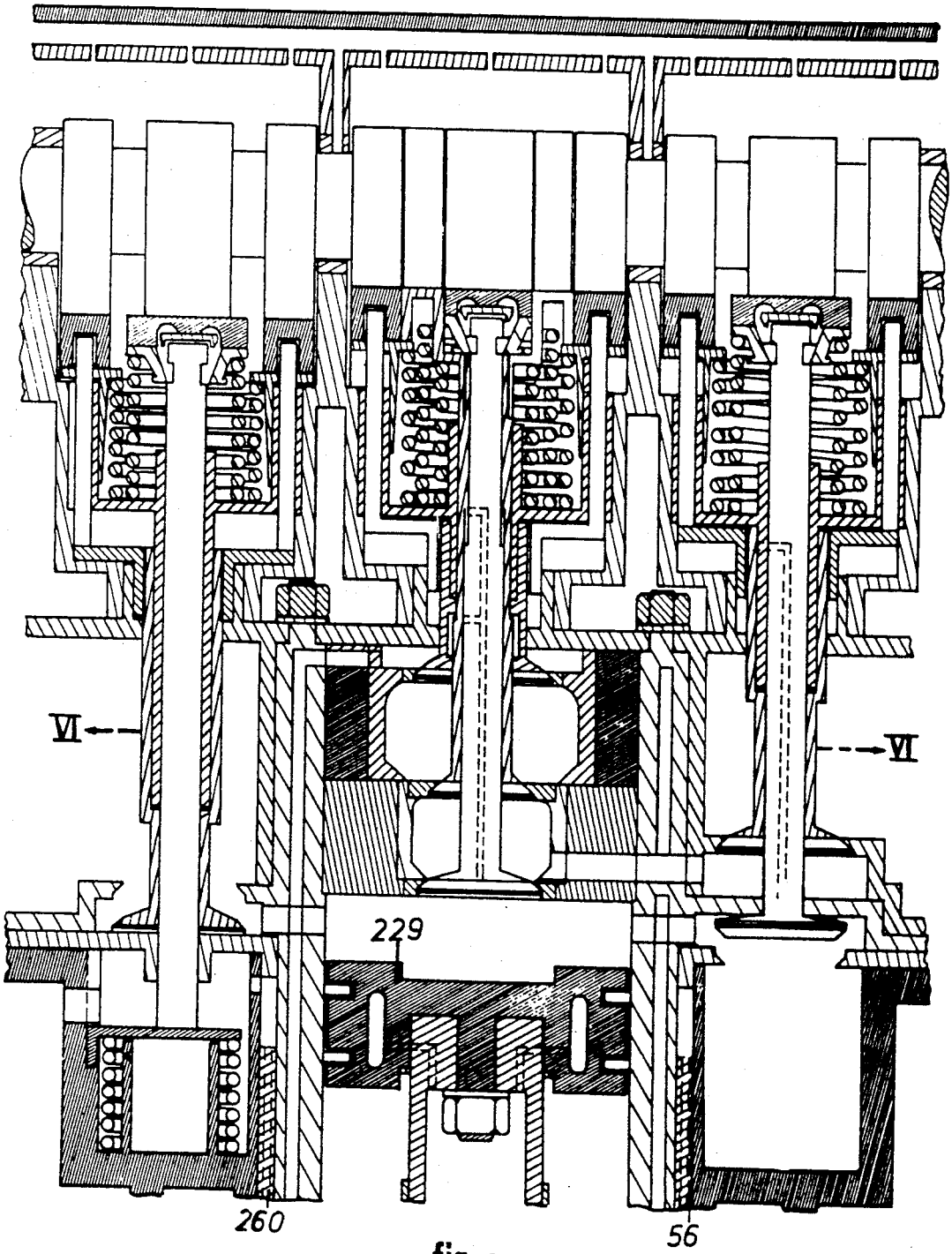
FIGS. 9 and 10 combined together represent in section along line I—I of FIG. 5 a third embodiment of the MME with the piston close to TDP at the end of the exhaust stroke.
Figure 10:
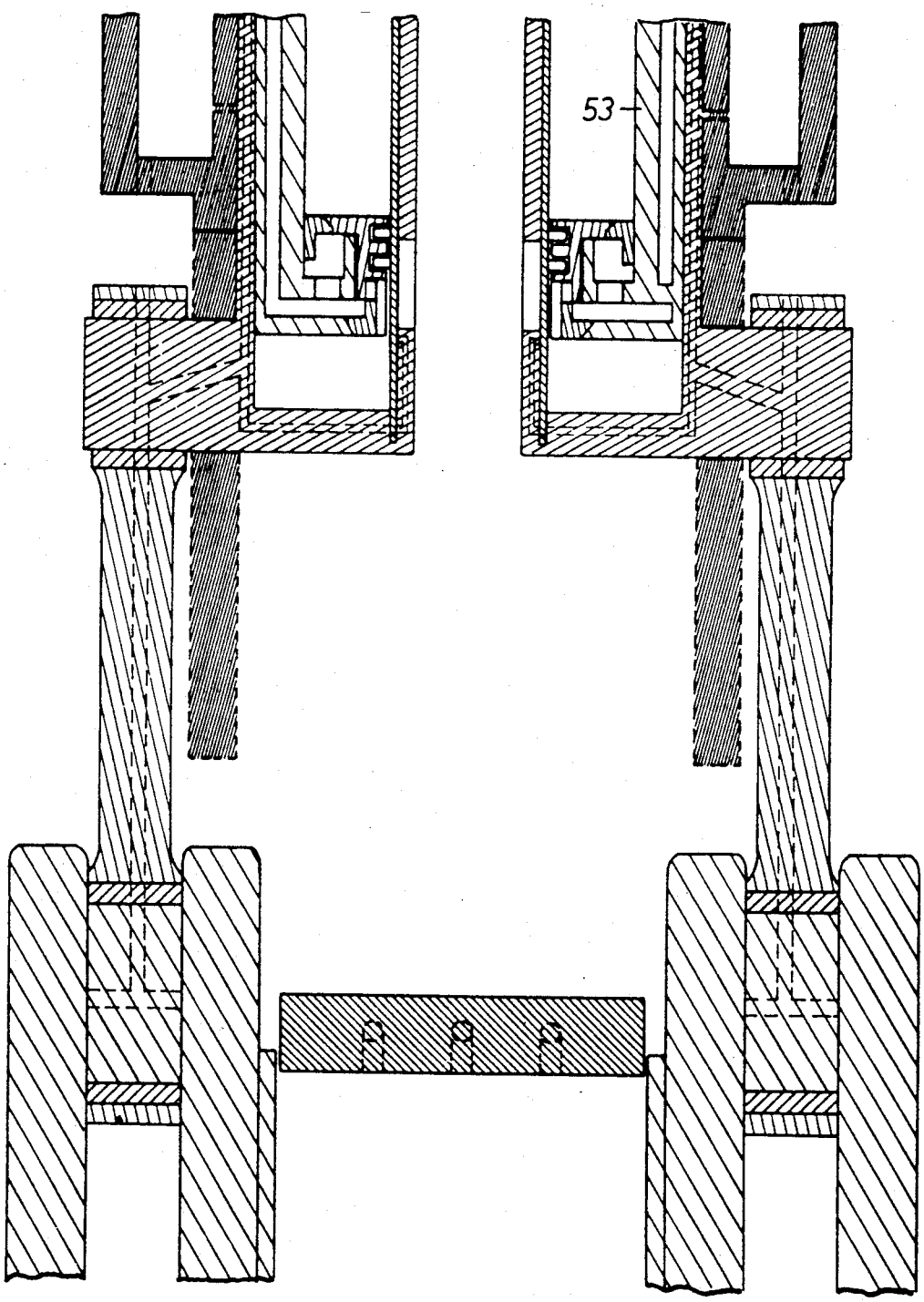
Figure 11:
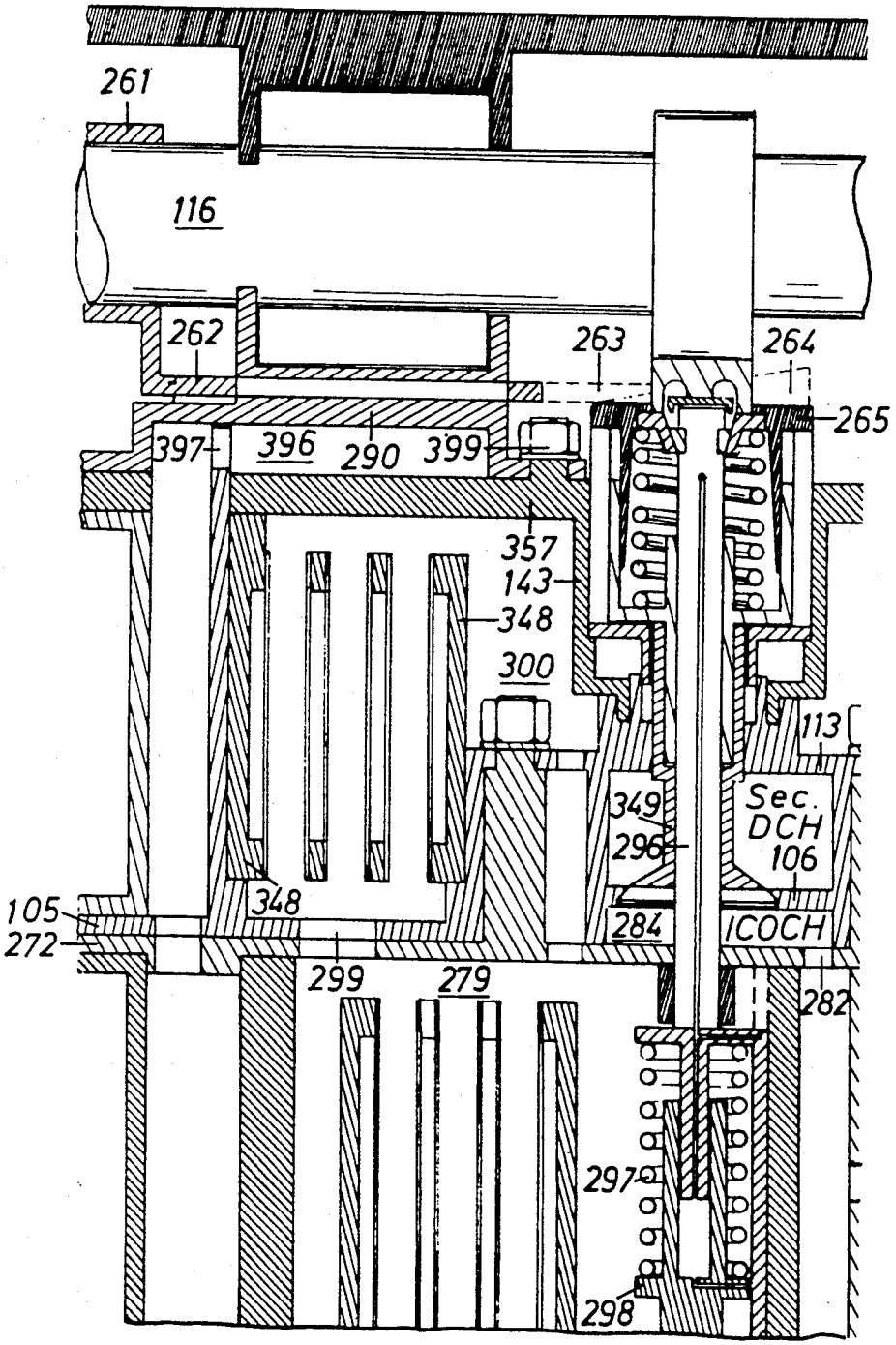
Figure 12:
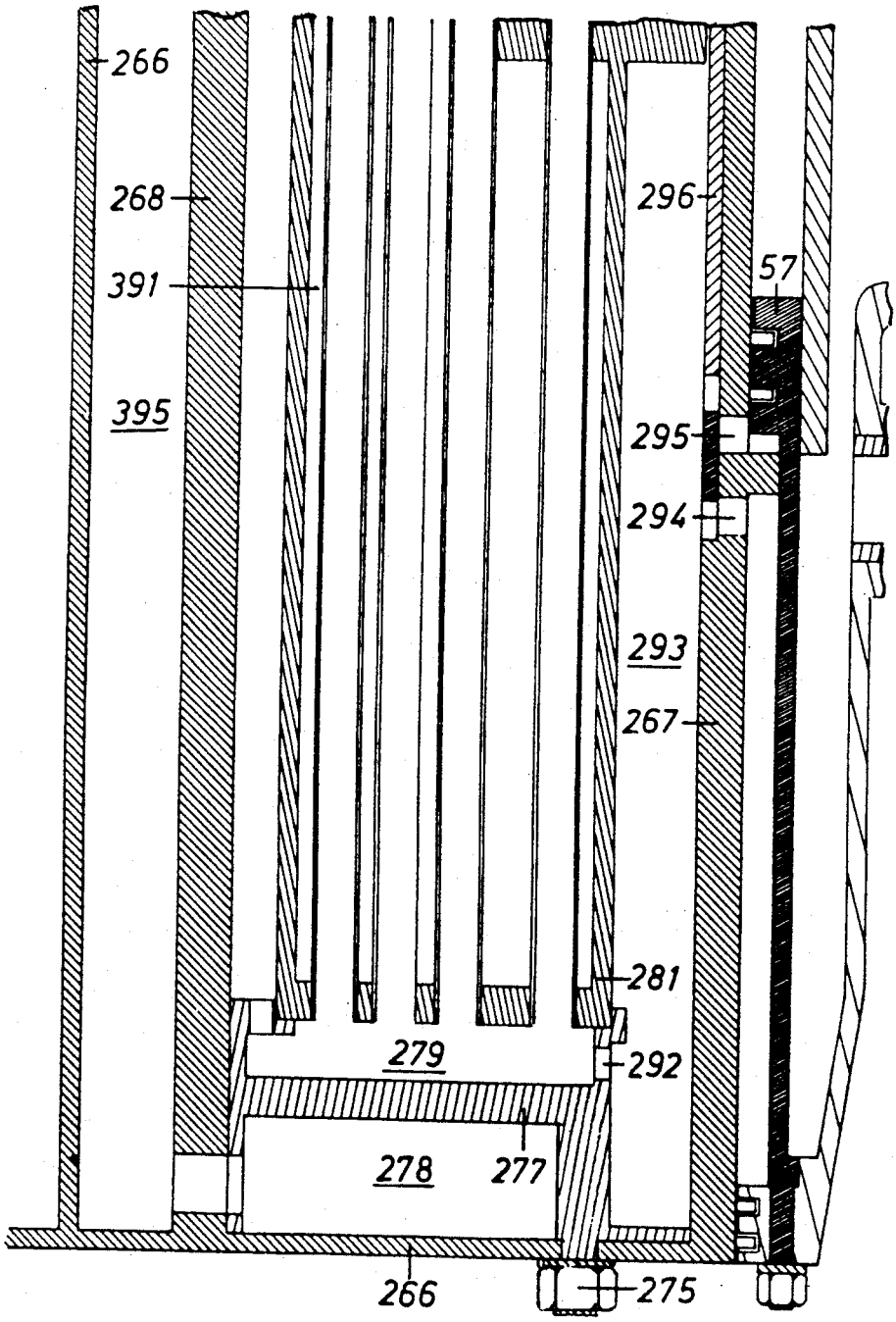
Figure 13:
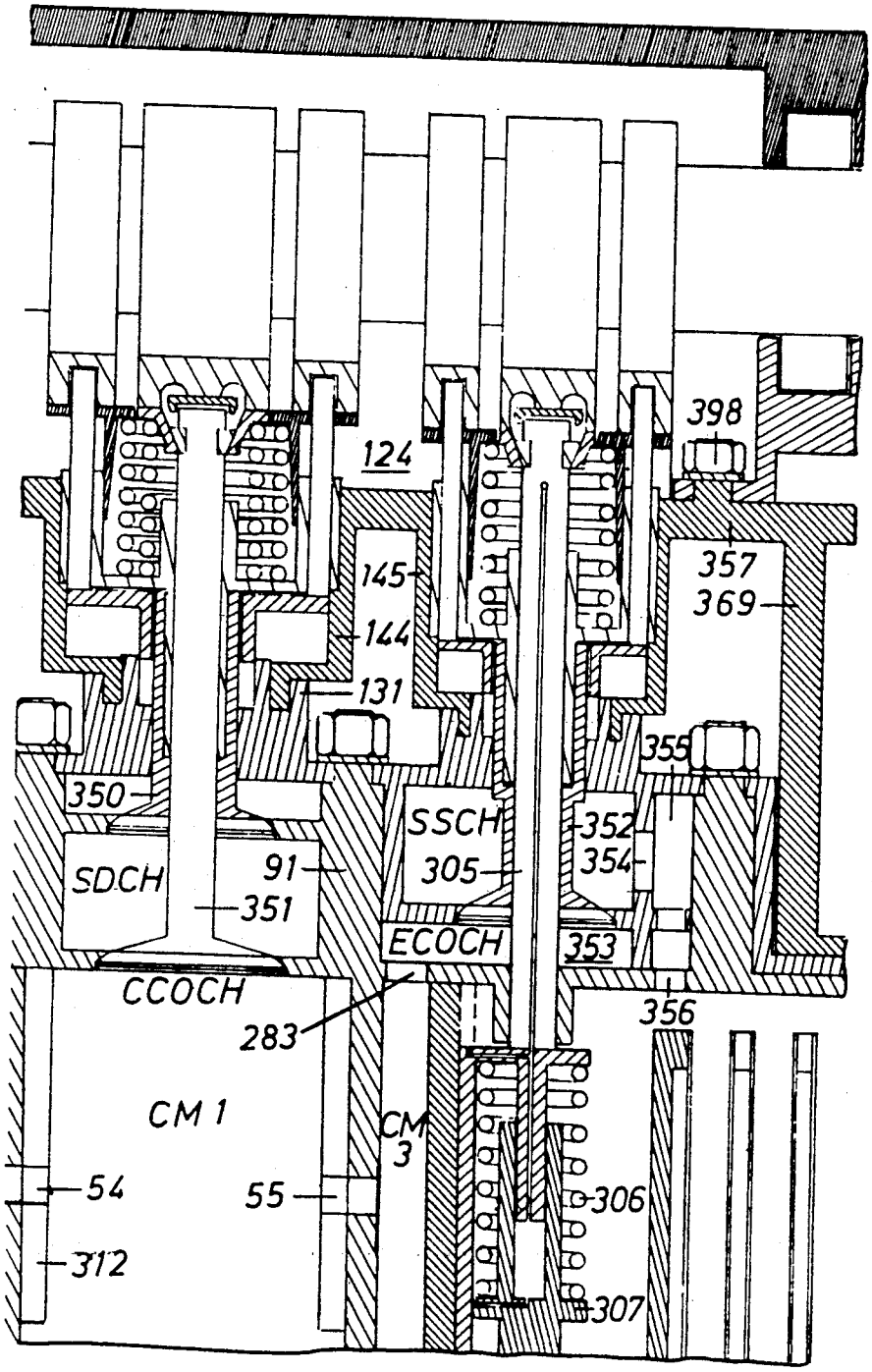
Figure 14:
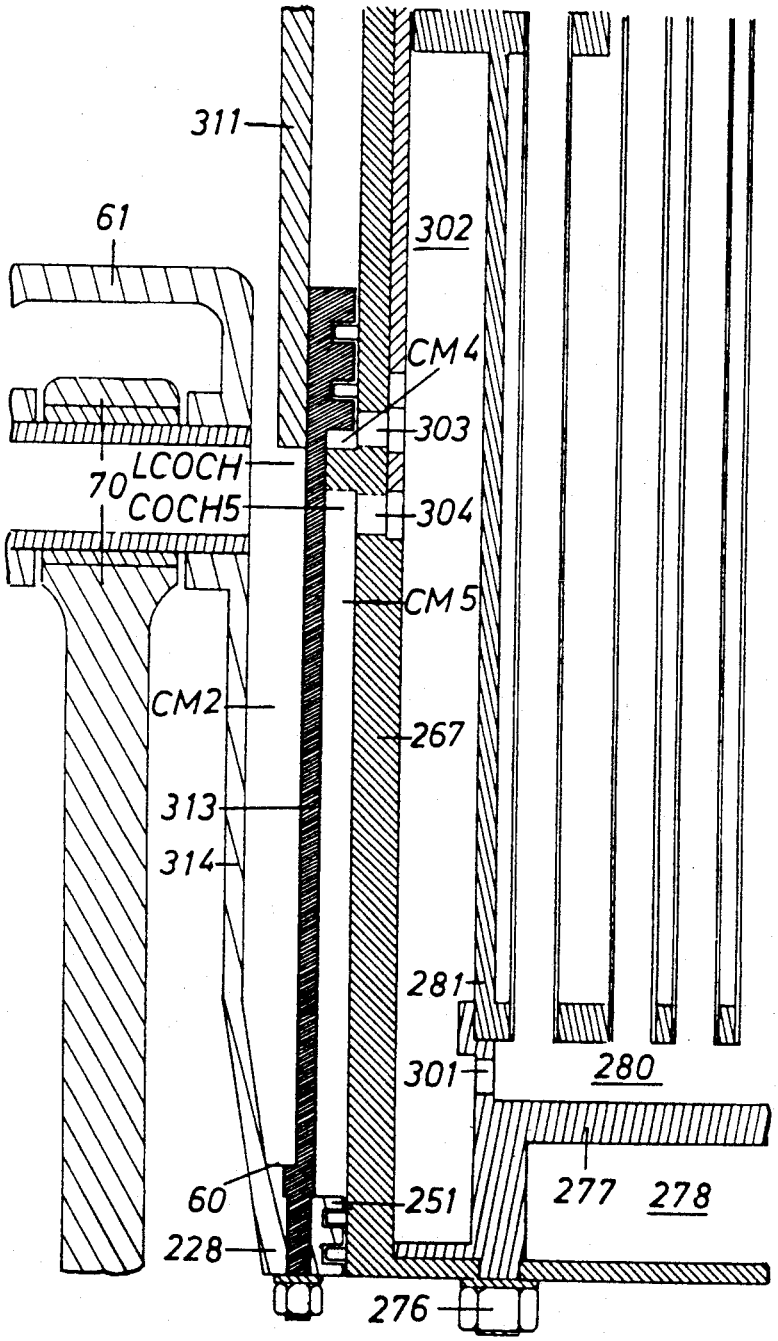

By way of example the cubic capacity of the MME executed in the third embodiment, illustrated in FIGS. 9, 10, is reduced through the elimination of the outer compressors and of the cylinder motor CM2. The parts being identical to those of the second variant and the method of operation being the same, it should not be described anew. However, it should be underlined that the external cylindrical part of the piston 56 which serves as a guide of the internal part of the piston 229, serves in this embodiment also as a pump accelerating the circulation of the lubricating oil by forcing it through the vertical slots 260 into the horizontal grooves, not represented, lubricating through the adjacent small holes the upper part of the internal wall of the cylinder motor 53, stimulating at the same time the surplus of the oil to flow into the lower crankcase.

CONSTRUCTIONAL CONCEPTION AND OPERATIONAL CAPABILITIES OF THE MME WITH RESPECT TO THOSE OF A CONVENTIONAL ICE

Figure 4:
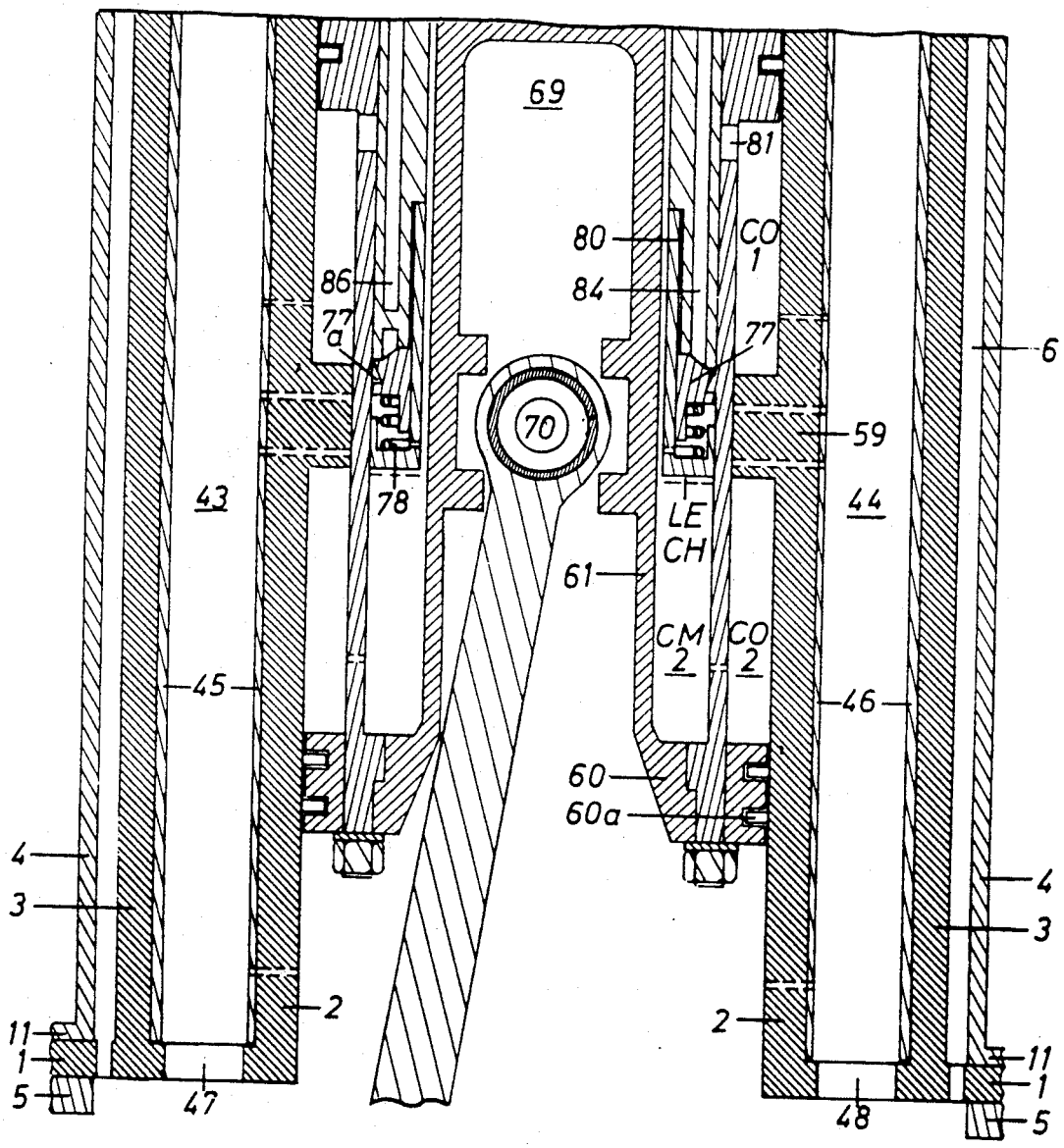

Looking at the enclosed drawings of the MME in all four variants it becomes obvious that its basic construction consists of at least two engines of different bore put together one within another and of two different combustion systems lying upon another, operated altogether as a single engine by means of a common piston and a common cylinder block head, capable to function simultaneously as an Otto and a Diesel engine. Although the most important characteristic features of this double hybrid combination have already been discussed, it is necessary to clarify more precisely the performances of the MME resulting from its constructional conception as well as some of its particular operational capabilities with respect to those proper to the conventional ICE. For this purpose we shall use as the basis of the comparison the results of the scientific research of Prof. Fritz A. F. Schmidt described in his work "Verbrennungskraftaschinen", Springer Verlag 1967. In order to avoid the citation of his conclusion we shall give in parenthesis of our explanations as cross reference the page of his book related to the discussed problem, which can be summarized as follows:

the sandwich construction and the crowding of the valves under a single overhead camshaft was chosen to facilitate the understanding of the construction and of the functioning of the MME. The eventual advantageous solutions should be introduced by the constructor without neglecting the solutions used in the construction of the conventional ICE as for example cylinder block manufactured in one piece, rocker arm operated valves etc.

the robust construction of even the smallest size units resulting from the important thickness of the wall of the upper cylinder motor CM1 predestined to resist the excessive pressure developed during the power stroke and to serve at the same time as a heat exchanger provoking automatically a useful increase of the temperature of the compressed air guided toward the distributor of the compressed air (p.228) as well as the increase of the air intake due to an unavoidable proportional increase of the diameter of the associated inner lower compressor.

the dimensioning of the moving parts of the MME and particularly of its connecting rod, after the dimensions of the working parts of a conventional ICE is facilitated by the already mentioned fact that the output of the MME substantially increases with the increase of its bore with respect to its stroke. A larger bore of the cylinder motor allows to secure into the cavity of the piston a robust connecting rod eye of a rod and crank assembly, capable to resist together with the thick wall of the cylinder motor CM1 the high MEP developed in the combustion space of the MME due to its big surplus of compressed air and its advantageous method of operation.

a new solution is represented by the described connecting rod, consisting of an air intake tube provided with inertia sliding valves, combined either with a lower, rather conventional connecting rod as illustrated in the drawing FIGS. 2, 4, or with two connecting rods—with their eyes articulated on the round proprolongation of two opposite rectangular fastening lugs forged integrally with the outer wall of the piston, sliding in their respective slits cut in the prolongation of two segments of the working cylinder as illustrated in the drawing FIG. 10. In this solution the side friction of the piston against the lining of the piston is completely eliminated, thus avoiding the deformation of the cylinder, diminishing the friction and enabling a better lubrication of the entire structure.

the air and oil filters, oil and water reservoir are enclosed within the cylinder block and the cylinder block head in order to reduce the size of the engine and to facilitate the functioning of its advantageous combined air-water-oil cooling and lubricating system, ensuring a perfect adjustable cooling of all hot spots of the engine and particularly of the combustion chambers with their associated valves and their components, permanently immerged, together with the camshaft into cooling and lubricating oil. In addition, the combined air-water cooling of the cylinder motor, the combined oil-air cooling of the piston and of its rod and crank assembly, the lubrication of the sliding valves with their sliding sleeves, the cooling and the lubrication of the MME is solved in an efficient and adjustable manner. Under the pressure of an oil suction pump situated on the bottom of the crankcase and a water pump associated with a thermostat, the entire oil and water contained in the engine circulate permanently through their respective filters, heat exchangers and the drilled headers towards all parts of the engine which require cooling and/or lubrication.

instead of the conventional ventilator, a powerful impeller forces the hot air emerging from the radiator through the connecting ducts, some of it directly into the cylinder motors and larger part into the crankcase where it will be further compressed by the reciprocating movement of the piston. This forced inlet of the hot precompressed air shall return into the engine a large part of the energy lost in conventional ICE by its water cooling system, increasing at the same time the precompression ratio of the aspirated air for at least an additional 5 psi $= +0.35$ kg/cm$^2$ resulting in the increase of the output of the engine (p.106) and in the reduced consumption of fuel (p.115). The volumetric efficiency is further increased due to the fact that the intake ports controlled by the sliding valves are wideopen during the entire intake stroke, the duration of this opening being further prolonged by the small speed of the engine.

although the Int. C. System of the MME operates in a similar way as in a conventional gasoline engine, the compression ratio in its explosion chambers can be increased to any desired reasonable compression ratio without the knocking danger which seriously hampers the performances of the conventional Otto engine. The causes of the knocking are eliminated in the MME by the efficient cooling of the walls of its combustion and explosion chambers, by the use of the antiknocking fuels such as alcohol, natural gas and/or industrial gases as well as by an extremely efficient turbulence emerging during the mixing of the water injected into the hot burning gases at the moment of their penetration from the Ext. C. System into the Int. C. System, simultaneously with the explosion of the quick oxidizing fuels injected on time in its explosion chambers. The high compression ratio resulting from the big surplus of the compressed air increases the efficiency of the MME (p.115), keeping the combustion process at a suitable temperature by water injection (p.227). In addition, the low speed of the MME diminishes the mechanical losses caused by the compression of the air during a high speed operation (p.213). In principle, the compression ratio in the Ext. C. System of the MME is much higher than in its Int. C. System. Nevertheless, it can be adapted in both combustion systems to the requirements of the fuel in the following manner:

- in the Int. C. System, by increasing the diameter of the internal part of the piston by a sleeve joint, provoking the reduction of the cubic capacity of the vertical part of the LECH and at the same time its more strangled, eventually interrupted communication with the UECH;
- in the Ext. C. System, by replacing the combustion chambers by the smaller ones, operated by the same or with smaller valves, the proper functioning of which can be secured also when associated with miniaturized combustion chambers;
- in the second embodiment with or without air recovery, by introducing the transfer canals, converting the CO1 into a turbocharger;

the cubic capacity of a conventional ICE operated at a four stroke working cycle without turbocharger consists of a single charge of air aspirated during the intake stroke. On the contrary the all important advantage of the MME is its capability to generate—with a small increase in its size—a much larger quantity of compressed air, whose compression shall absorb the total force generated by the given cylinder motor of the MME, thus converting it in a source of compressed air to be also used outside the MME for many useful purposes, such as for example serving as the source of compressed air in the factories, workshops, public works, hybrid engines etc. For example, with a built-in receptacle of compressed air, provided with a non return valve connected or being an integral part of the distributor of compressed air, the MME preferably operated at a two/six stroke working cycle, will be converted into a self-operated compressor to be used in public works, blowing and ventilating equipment, compressed air operated hammers, conveyors, starters, in compressed air plants in factories for instrumentation, control of industrial technological processes, cleaning, drying, polishing etc.

of particular importance is the use of the air surplus generated by the MME in numerous hybrid variants; Due to the fact that the cylinder block head of the MME is an efficient generator of the propellant gas, particularly if operated on a two/six or a two/eight stroke working cycle, by connecting its compressed air distributor with a compressed air distributor of an identical cylinder block head mounted on the adjacent cylinder of a conventional ICE, there shall result a substantially increased output and a clean exhaust also from the cylinder of the associated conventional ICE hybrid engine.

Similar results can be obtained:

in a hybrid combination of the MME operated on combustion products with its exhaust duct connected to the fire place of the boiler of a steam operated MME;

by using the exhaust gases of the MME combined with a part of its compressed air surplus to drive a gas turbine;

by converting one of its lower compressors into an additional four stroke ICE, giving to the entire MME the character of a double acting engine.

Besides the enumerated benefits there are many other important advantages resulting from the constructional conception of the MME and from its operational capabilities which can be summarized as follows:

the already described long lasting constant volume combustion occurring in the Ext. C. System and the mixing of its hot burning gases injected with water with the combustion products of the quick oxidizing fuels, exploding at the same time in the explosion chambers of the Int. C. System provoke a number of useful reactions under conditions not realizable in a conventional ICE, as for example:

increased efficiency of the MMEE high MEP and constant torque during the entire power stroke at all speeds, elimination of the knocking - detonation, reduction of the thermal constraint in the cylinder motors, precise regulation of the combustion temperature in both combustion systems, resulting in the lowering of the oxides of the nitrogen in the exhaust gases, simplified timing of introduction and ignition of each particular fuel into the Int. C. System, coinciding with the penetration of the burning gases from the Ext. C. System precisely synchronized with the arrival of the piston in its TDP, the combustion time lasting during the entire working cycle is further prolonged by the slow speed of the MME, the injection of the precisely determined quantity of water into the burning mixture, occurring at each opening of the intermediary valve, causes a substantial increase of the MEP and consequently of the output with a simultaneous decrease in temperature, keeping the piston, valves and spark plugs always clean and of long life.

the slow speed of the MME also reduces the mechanical losses which increase with the increase of the speed of the engine a perfect scavenging of the entire combustion space of the MME increases and stabilizes the volumetric efficiency at all speeds, participates in the cooling of the working parts, diminishes the temperature of the walls of the entire combustion space and of the exhaust gases, increases the MEP and consequently the output of the engine up to further 19%. This advantageous scavenging is a consequence of the positive displacement double acting compressors always operated at a two stroke working cycle, providing an abounding air intake, exceeding by far the need of a balanced external-internal combustion, thus increasing the MEP within thick walls of the combustion chambers and of the cylinder motor, proportionally to the surplus of the compressed air;

the precise timing of the fuel injection, its duration and ignition connected by the ICE with a sophisticated synchronization of the overlapping of the valves does not cause any problem to the MME in which the overlapping of the both, intake and exhaust valves does not exist at all, except if used in small measure in order to better exploit the compressed air surplus as for example in the case of its recovery, described in the method of operation of the first embodiment;

another important advantage of the MME used as an automotive engine consists in its capability to keep at all speed ranges and in both its combustion systems, the amount of the compressed air at a constant level, regulating the necessary output by the quantity of the injected fuel, thus applying the advantageous qualitative regulation proper to the conventional diesel engine.

The improvement of combustion and the diminution of the knocking by increase of the turbulence and by a small precombustion chamber built-in in the top of the cylinder of the conventinal ICE is much more pronounced by the MME due to the tumultuous mixing of the burning gases resulting from different air-fuel mixtures, mixed with steams, burned under controlled temperatures in the combustion chambers of two separated combustion systems.

The dimensioning of the working elements of the MME after those used in the conventional ICE should help to establish the equilibrium and the stabilization of the forces acting upon the crankshaft of the designed engine, regardless to its size, and should make easier the mastering of the torsional vibration of the shaft and the regularization of the engine's torque even in the compact units. This delicate task should be facilitated by the smooth precombustion and principal explosion occurring in the hermetically closed combustion chambers, exercizing relatively uniform impulses during the power stroke on the flywheel, even in the single cylinder units.

A proper combination of the enumerated elements should frame at a certain point the gradation of the MME. On one side the powerful industrial, transport and power generating, mostly stationary engines, requiring much less space, using cheap domestic fuels, manufactured in the existing factories etc. On the other side the compact small engines of an extremely convenient power to weight ratio, built with a reduced number of cylinders and of reduced cubic capacity, mostly used as transport engines to be further developed toward a miniaturized engine operated on the same working principle, capable to run at a high speed.

COMPARISON

The following comparison is based on the amount of the naturally aspirated air during a comparable working cycle, increasing the main effective pressure MEP of the MME proportionally to its air intake expressed in percentage, corrected by minus 8% and combined with a speed corresponding to the maximum allowed speed for the bore/stroke of its largest compressor. The obtained results represent a mathematically exact output of the MME in horse powers. The calculation is based on the horse power formula cited by I. Chvetz, Kondac and co-authors in the "Thermique Generale", Edition Mir, Moscow 1969 page 315, reading as follows:

$$Ne = \frac{II \cdot D^2 \cdot S \cdot pi \cdot n \cdot i \cdot ))^m}{4.60 \cdot z} \cdot 100;\ KW$$

II=3.14
D=bore in cm
S=course in m
p1=MEP in bars
n=revolutions per minute RPM
i=number of working cylinders
ηm=mechanical efficiency
z=number of revolutions of the crankshaft during the working cycle
KW=735498.75 (W·1000)

The same formula is used to calculate by interpolation the main effective pressure MEP of the respective conventional ICE. In spite of the large surplus of compressed air, the expected extraordinary performance of the MME could not be realized without a robust construction capable to resist the unavoidable thermal constrains. As it can be seen from the enclosed drawings the problem is settled by the constructional conception of the MME which enables the realization of a very compact engine of an extremely robust construction with all parts exposed to the excessive efforts permanently supported by an efficient cooling and lubricating system. These advantageous construction features shall enable the increase of the MEP to a level proportional to the surplus of the compressed air generated by the MME and a temperature high enough to burn the total of the N-oxides. In order to keep the comparison as close as possible to the reality, the dimensions of the compared MME's are taken after the dimensions of the existing ICE's, which in the first embodiment consist of the cylinder motor CM1 taken from a four stroke, 6 cylinder naturally aspirated 29.6 l diesel engine of a bore/stroke 17.5/20,5 cm, 370 HP at 1500 RPM or 4.933 l/cyl. or 61.65 HP/cyl. at 1500 RPM, combined with a compressor 23/23 cm, dimensioned after another ICE of 9.551 l/cyl., 68.56 HP/cyl. at 1500 RPM, both together, converter into a MME hybrid variant of a bore/-stroke 18/23 cm for cylinder motors CM1, CM2, CM3 and bore/stroke 23/23 cm for compressors CO1, CO2;

thickness off the wall of the cylinder motor CM1=2×2.5 cm=5.0 cm, containing water tubes of 0.9 cm and compressed air ducts of 0.5 cm—internal diameter. The air intake per cylinder amounts to 21.676.31 cm³ which compared to the 4.933 cm³ of the described ICE shows an increase of 339.41%, increasing the MEP from 15.34 to 66.18 and the output from 61.67 HP/cyl. to 515.6 HP/cyl. or 736%, so that the output of one cylinder of the MME shall theoretically be equal to the output of 8.36 cylinders of the first mentioned ICE or 6.65 cylinders if compared with the output of the second ICE whose bore/stroke of 23/23 cm was borowed for the compressor of the described MME.

The total of the air intake in this variant is divided between the Int. C. System and the Ext. C. System in proportion 61.2:38.8 in favor of the Int. C. System. Nevertheless, it should be mentioned that this calculation includes 1274 cm³ of the compressed air recovered during the fourth, exhaust stroke in favor of the Ext. C. System due to the fact that the compressor-scavenger CO2 is connected through the lower cylinder motor CM2 with the upper cylinder motor CM1 which communicate with the Ext. C. System through the associated internal valve 103. A more efficient allocation of compressed air to the Ext. C. System can be achieved by an adequate prolongation of the wall of the cylinder motor CM1 respectively of its compressed air ducts 82, 83, 84 and replacement of the inertia valves 64, 65 by two disc valves 249 (FIG. 8) one of them situated on the upper and the other on the lower surface of the constriction 59. In this case the same compressor CO2 shall supply during each four stroke working cycle 2×3.033 cm³=6.066 CM3 of compressed air directly into the Ext. C. System, thus 4.792 cm³ more than in the first comparison. The total surplus of compressed air shall amount to 375.09% and the output of the MME shall increase from 515.60 HP/cyl. to 558 HP/cyl.=+805%, equal to the output of 9.04 cylinders of the first and 7.20 cylinders of the second above compared ICE. The total of the air intake shall be divided between the Ext. C. System and the Int. C. System in proportion 56.4:43.6 in favor of the Ext. C. System.

In addition to the increase of the output the bigger supply of compressed air by compressors connected with the Ext. C. System allows the larger use of the slow burning cheap fuels, the constant volume combustion of which, occurring in the hermetically closed combustion chambers, shall also substantially decrease the vibration of the engine. Moreover, the already mentioned prolongation of the time of combustion, elimination of the unnecessary compression of a part of air during the recovery and the scavenging of the burned gases by a simultaneous opening of the external intake valve 100 and the intake ports 33, 34 of the cylinder motor CM3 at the very beginning of the exhaust stroke make the method of operation without air recovery more advantageous.

Figure 7:
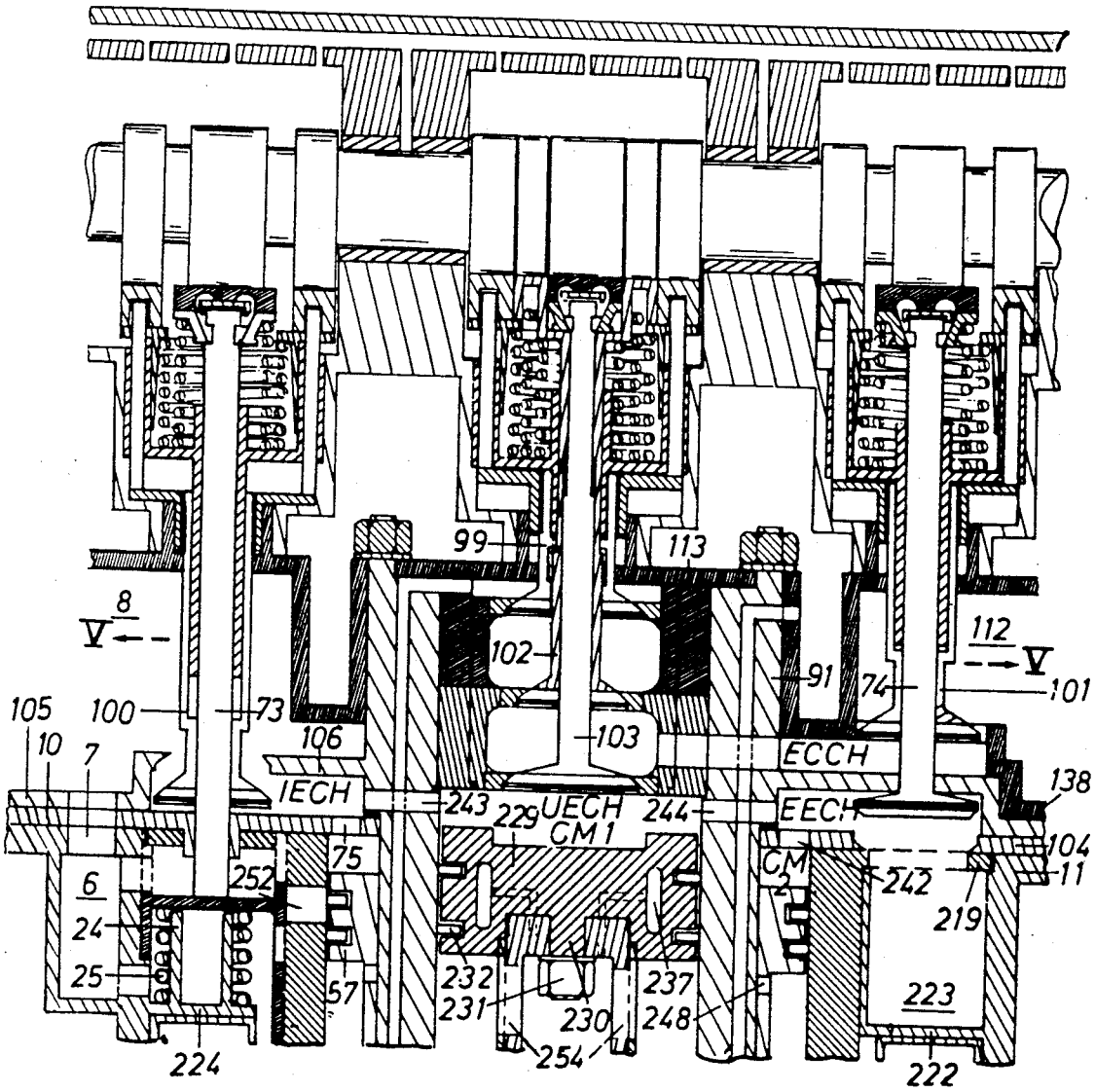
FIGS. 7 and 8 combined together represent in section along line I—I of FIG. 5 a second embodiment of the MME with the piston close to TDP at the end of the fourth exhaust stroke.
Figure 8:
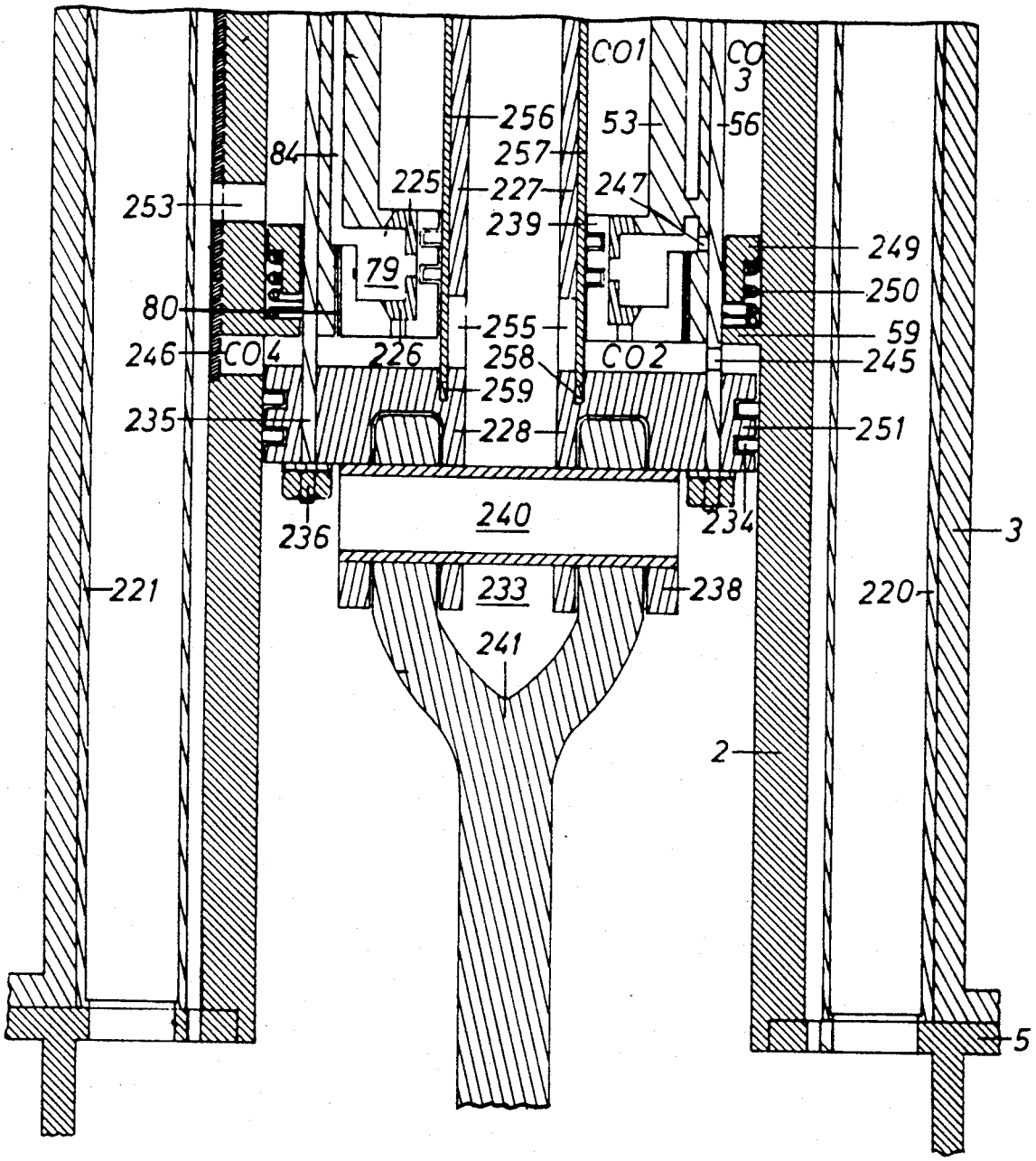

The MME of the same bore/stroke consisting of two working cylinders and four compressors arranged as illustrated in the second variant FIGS. 7 and 8, increases the air intake to 607.74% and the output from 61.67/HP cyl. to 591.30 HP/cyl., so that the output of one cylinder of the MME executed in the second variant corresponds to the output of 9.60 cylinders of the first above compared ICE or 7.60 cylinders if compared with the bore/stroke of its compressor which is the same as in the first embodiment.

Going up to the large size stationary industrial and marine ICE, the result infavour of the MME can be more than doubled. By dimensioning the MME after two four cycle diesel - dual fuel, spark ignition 6 cylinder gas ICE of a bore/stroke 13½"×16½"=345.29/41.91 cm, 383.33 HP/cyl. at 514 RPM, turbocharged combined with an other 21½"×31"=54.61/78.44 cm also turbocharged ICE diesel engine running at a maximum speed of 257 RPM converted into a MME executed in the second variant with an inner and one outer cylinder motor, operated without air recovery, with a total air intake of 427.561.70 $cm^3$/cyl. which in comparison with the air intake of the first mentioned ICE amounting to 38.682.93 $cm^3$/cyl. represents an increase in air intake of 1005.20%, distributed between the Int. C. System and the Ext. C. System of the MME in a proportion of 20:80%.

The thickness of the wall of the cylinder motor CM1 fixed at 2×3 cm=6.0 cm, of the pistons outer wall at 2×1=2.0 cm and the diameter of the pistons upper tube-connecting rod at 8 cm, resulting in an output increase from 383.33 HP/cyl. to 4.174.0 HP/cyl. or plus 990%, meaning that the output of one cylinder of the MME equals the output of 10.89 cylinders of the first mentioned conventional ICE. Bearing in mind that both cited ICE's are turbocharged, the improvement realized by the MME should be multiplied by two, supposing that the compared ICE is turbocharged in proportion 1:1. The improvement can be further improved by the described air recovery and/or with an increased diameter of the compressors up to the most convenient allowed speed.

On the other hand, going down to the small sized engines used in passenger cars and trucks, with the proper choice of the diameter of the cylinder motor CM1 and thickness of its wall as in the construction executed in the third variant illustrated n FIGS. 8, 9, in which the outer compressors are eliminated, the result remains close to those stated above. By way of example one of the smallest engines used in passenger cars, a 4 cylindre ICE, bore/stroke 64.5/76.2 mm, 9 HP/cyl. at 4500 RPM, executed in the third variant without air recovery, with the diameter of cylinder motor increased to 83/76.2 mm and its wall thickness of 2×19 mm=38 mm, shows an air intake surplus of 931.20%, which should increase the MEP from 14.78 to 152.42, operated at a speed reduced to 3300 RPM giving an output of 112.70 HP/cyl. or 1152.22% more than the cited conventional ICE running at 4500 RPM. In this case the proportion is 1:12.52 cylinders in favour of the MME.

Although mathematically exact, the above comparison may not be considered neither as guaranteed performances nor as the maximum output which can be obtained from the compared MME. The cited horse power formula concerns the conventional ICE which always realizes an air intake directly proportional to the bore/stroke, respectively to the cubic capacity of its cylinder, corrected by the volumetric efficiency, compressed and entirely consumed during the same working cycle. The increase of the air intake caused for example, by a turbocharger results in the increase of the MEP which together with a speed designed as high as possible is responsible for the increased output of the engine.

On the contrary, the MME designed whenever possible as a multipurpose engine is not compelled to follow a schematic way of operation. Provided with sophisticated construction features encompassing a large number of working units in the form of separated combustion and explosion chambers, supplied with the necessary quantity of compressed air, it is capable to determine in the preliminary tests the most suitable method of operation and to change it from time to time according to the requirements of the fuel available.

Instead of cooling the air before its intake into the cylinder of the conventional ICE, the air intake by the MME is based on an entirely opposed conception, aiming at the saving of an important part of energy lost in the ICE in the form of hot air forced by the radiator into the atmosphere. Due to the fact that the MME can increase its air intake to any desired amount by an insignificant increase of the diameter of its compressors and due to its high volumetric efficiency achieved without turbocharger it is preferable to feed it with hot air forced by the impeller of the radiator into the working cylinder, respectively into the crankcase of the engine. In this way the largest part of the energy lost in the conventional ICE by cooling and by the leakage of hot gases into the crankcase is automatically recovered in the MME by the forced circulation of the hot air and by the recovery of the hot gases escaping from the cylinder motor into the adjacent compressors. Another important part of the energy is saved by two heat exchangers situated in the very core of the engine.

These and many other advantages of the MME are not taken into consideration by the above cited comparison, however they will substantially influence the output of the engine and especially the saving of fuel, the wasting of which, by the actual stand of the technic, is estimated to 75%.

THE MME OF THE FOURTH EMBODIMENT

As already mentioned, the MME of the fourth embodiment is operated on steam. Although all reciprocating engines are of similar constructional conception, those operated on steam have to be adapted to a lot of technical requirements deriving from the specific characteristics of the steam. Due to these inconveniences, the use of the steam was limited to the drive of steam turbines particularly in power generating plants and in factories. The reciprocating steam engine was almost entirely replaced in industry by electromotors and in all kinds of transport by the relatively compact internal combustion engine, using cheaper and easy-to-handle liquid fuels. Many problems emerged from this technical development. Crude oil, respectively its derivatives become progressively the main source of energy, causing a disastrous situation in the coal-mining industry and serious problems in the protection of the environment. The high demand on one side and the monopoly of the oil producing countries on the other side led to a sudden increase of the crude oil prices to an extent seriously endangering the economy of the entire world and particularly that of the industrialized countries. An accelerated development of substitute fuels became the imperative need. Big investment was made in the opening of new sources of crude oil, in the construction of nuclear plants, in large size industrial plants for the treatment of the coal including the plants for the desulphurization of the coal and for the absorption of the noxious exhaust gases emanating from the coal heated power plants. Similar efforts are in course with respect to the air polution, for which the internal combustion engine is considered as a most dangerous factor.

Unfortunately a proper solution to the problem as a whole is not in view. The conversion of coal into crude oil derivatives, although more expensive, may to a certain degree diminish the demande for crude oil, but cannot eliminate its plaguing effects on the environment. Even worse may be expected from the atom used as a source of energy. A big number of other fuels in gaseous and liquid form, already used i heavy stationary engines are not suitable for an efficient combustion in the compact internal combustion engines. In other words the enumerated measures can serve as an "emergency exit" in case of a new "petroleum shock" but cannot settle the problem because the real problem does not consists in the improvement of the fuels but rather in the construction of an engine capable to burn all kinds of fuels in a efficient and pollution free combustion.

There is no doubt that the proposed MME executed in the three described embodiments operated on combustion products is capable to accomplish this task as far as the gaseous and liquid fuels are concerned. In this fourth, steam embodiment, the choice of the fuels includes also solid fuels as for example coal dust as well as burning gases exhausted from the associated hybrid components. Of greatest importance will be the use of the coal dust in mixture with heavy oil and other residual fractions of the coal hydration, improved by addition of the oxidizers, subsequently injected into the fire place in the form of a paste. Most encouraging is the recent development in the U.S.A. of the "Carbon Fuels' Process" a cheap coal liquefaction process said to be "analogous to oil refining" which should form a char-oil slurry to be transported in existing oil pipe lines (see Chemical Week July 30, 1986).

As well as the previously described variants of the MME operated on combustion products, the steam variant can be executed in several different embodiments adjusted to the purpose to be served by the engine. After a short outline of the present state of the technique we shall describe, by way of example, one of its sophisticated variants to be used in the compact steam transport engines.

PRESENT STATE OF TECHNICS CONCERNING THE STEAM-OPERATED RECIPROCATING ENGINE

The constructional forms of the conventional reciprocating steam engine differ from each other in the manner the working cylinder is fed with steam. From the point of view of steam consumption, an expansion steam engine operated at a limited dosage of superheated steam combined with a condenser reducing the counterpressure almost to atmospheric pressure is considered as a preferable solution.

The efficiency of the reciprocating steam engine depends on the capacity of its boiler, the quality of the generated steam and the cubic capacity of its working cylinder which should be big enough to enable a complete expansion of the introduced steam. The axhaust of the saturated insufficiently expanded steam either into the condenser or into the atmosphere causes an important loss of output. Furthermore, the loss is increased by the condensation of the expanding steam on the wall of the working cylinder during the first part of its expansion against the cool wall of the working cylinder.

A good solution to these condensation problems is achieved by the compound/multi-expansion steam engine, consisting of at least two working cylinders of the same stroke but of different bore. The first cylinder of the smallest bore is connected through a steam receiving receptacle with the following cylinder of a larger diameter allowing the transferred steam to continue its expansion and delivering the additional work to the common crankshaft. The following cylinders are operated in the same manner (see "Course de Force Notrice" by N. Mestre, Tome II.7eme Edition—1960 pages 116–120).

Almost the same thermal efficiency can be achieved at a convenient price by a reciprocating steam engine equipped with a double-acting cylinder connected to a factory boiler. Namely, the price of the high pressure steam generated by the large-size boilers is much cheaper than the price of the medium-pressure steam generated by the small size boilers. To reduce this high pressure to the pressure needed for factory operation, either a turbine or a reciprocating steam engine should be used in order to transform the surplus boiler pressure into electricity. Particularly convenient for this purpose is a reciprocating steam engine with a double-acting cylinder equipped with a piston 4/10ths the length of its stroke with the steam-inlet ports situated on both ends equipped with valves of special construction and the exhaust ports situated in the middle of its length, covered and uncovered by the reciprocating movement of the piston (see N. Mestre pages 120–124). The problems related to this kind of exhaust are similar to the scavenging of a conventional two stroke classical diesel engine (scientifically elaborated by R. Brun—Tome I pages 326–350).

SPECIFIC REQUIREMENTS OF THE RECIPROCATING STEAM ENGINE

As it can be seen by comparing the enclosed schematic drawings, the working cylinder of the MME executed in the fourth embodiment operated on steam does not differ at all from the working cylinder of the MME executed in the first embodiment operated on combustion products. The execution in the second embodiment can also be adapted to the purpose. Consequently, if connected with a factory boiler it can be used, without any particular adaption, as a stationary power-generating engine, replacing the expensive and cumbersome turbine or sophisticated multistage compound steam engine, coverting the high pressure steam coming from the factory boiler into the low pressure steam needed for factory operation. In this combination the choice of fuel is resolved by the choice of fuel for the factory boiler.

Being particularly interested in the application of the MME's steam variant for transport purposes, we shall describe it in a specific sophisticated embodiment, built into a miniaturized self-sufficient boiler capable of burning all already mentioned fuels, resolving at the same time all the specific requirements of the conventional reciprocating steam engine in a compact solution, eliminating its bulkiness which causes its failure when in competition with the conventional ICE. These specific requirements are settled in the following way:

the compactness is ensured by the unique constructional conception of the MME which allows a multistage expansion of the steam in a single working cylinder of any desired cubic capacity, the elimination of the condenser and the regeneration of the saturated steam within the closed circuit simultaneously by heating and by compression;

the lack of space for the installation of a water reservoir of sufficient volume with a condenser and an appropriate large-surface radiator or other cooling system, the resulting decrease of efficiency by bearing such bulky equipment and the disproportional quantity of water are settled by a controlled multistage expansion of the superheated steam, which after its conversion into saturated steam of a predetermined temperature and pressure, is divided in two parts, the first partially regenerated by compression and the second fully regenerated by pasage through the medium-pressure tubes, steam injector and high pressure tubes of the boiler. This regeneration of saturated steam eliminates the losses arising in the conventional reciprocating steam engine by its condensation into lukewarm water of about 40° or by its release into the atmosphere.

The exact percentage division of the expanded steam into two parts is regulated by the position and size of the opening connecting the internal cylinder motor CM1 with its external coequal cylinder motor CM3.

The return of the regenerated steam into the heating tubes of the high-pressure compartments of the boiler is accomplished by a small-size steam injector operated by an additional cylinder block head of the MME, controlled by a device acting under the predetermined pressure of the compressed air.

The dosage of steam being regulated by the camshaft, the same engine can be operated at will as a full-pressure engine or as an expansion engine with a precisely regulated dosage. In the illustrated solution the MME operated on a 1/10th expansion dosage shall be converted automatically into the full pressure operation whenever the increase of load requires more power.

The adaptation of the dosage of steam to the variations of load occurs during the power stroke in all five cylinder motors simultaneously by the action of a specific device operated by a conventionally manufactured regulator as for example Watt's centrifugal regulator.

The joint sleeve of the regulator is fit on the camshaft and provided with a forked cam regulating simultaneously the lift of the valve controlling the inlet of additional steam into all three cylinder motors CM1, CM2, CM3, operated on expanding steam, through their common auxiliary steam inlet regulating valve and into both cylinder motors CM4, CM5, operated on full pressure steam, through their respective steam-inlet ports and steam outlet ports controlled by the inlet and outlet sliding valves. The harm caused by the additional superheated steam acting in the cylinder motor against the piston during its working movement is automatically eliminated because according to the regular program during the exhaust strokes the respective outlet ports of the CM1, CM2 and CM3 are opened while the cylinder motors CM4 and CM5 are protected by their sliding valves expelling the undesired additional steam directly into the saturated steam envelope of the working cylinder. Otherwise, the coordinated action of the associated valves ensure a permanent and automatic inlet of additional steam in both directions and in the proportion corresponding to the variations of the load, thus keeping the speed of the engine constant. A prolonged increase of the load shall automatically convert the expansion-operated MME into a full-pressure engine and return it to normal feeding as soon as the charge becomes normal.

The losses caused by the condensation of the expanding stem on the wall of the cylinder motor and on the other part of the engine which becomes cooler than the expanding steam during the power stroke, are eliminated by the fact that the entire working cylinder as well as its crankcase with all their accessories are situated inside the boiler and permanently enveloped by steam of much higher temperature.

Water-hammering is excluded because in whatever position the engine will be stopped, the space reserved in the upper and lower cylinder motor for the compression of the expanded steam is bigger than the space needed to store the water obtained by the condensation of the steam remaining in both cylinder motors exposed to this danger. Moreover, the engine cannot be put into operation before the prescribed steam pressure is achieved.

The regulation according to which the entire surface of the engine in direct contact with the fire place must be immerged into the water, is satisfied in that the entire engine including the boiler is inserted into a water jacket which also envelops the crankcase. In addition to the protection of the surrounding of the excessive heat, the water jacket also serves to prepare the hot water used to start the engine, to cover the leakage and to receive the surplus steam whenever the safety valve opens to reduce superpressure developed in the boiler. Through a water-level regulation device the water jacket is connected to the water supplying system of the engine.

Whenever used as a "small" transport engine the MME executed in the steam variant should be combined with at least one cylinder of a variant operated on combustion products. The impeller of the radiator of this additional engine should be powerful enough to generate a surplus of hot air exceeding its own need. This hot-air surplus is led into a vertical antechamber of the boiler to be mixed with the exhaust gases which enter into the same antechamber through a kind of Venturi tube. The high temperature developed in the antechamber in which several burners are vertically arranged, shall facilitate the inlet of solid fuel, for example coal dust mixed with heavy oil, stimulating and regulating its inflow into the boiler's fire place according to the speed of the engine.

The role of the said additional cylinderoperated on combustion products is also to enable immediate start of the vehicle, without waiting for the level of steam pressure necessary for steam operation. When this pressure is achieved the engine switches automatically either to steam operation or to a combined gas-steam operation.

The shocks occurring at TDP at the moment of the change of direction of movement of the pistom are eliminated by the compression of the saturated steam in the compression chambers situated in place of the explosion chambers of the variant operated on combustion products.

THE CONSTRUCTION FEATURES OF THE MME OF THE FOURTH EMBODIMENT

The performances of a steam reciprocating engine are measured in steam consumption per HP/hour. The obtained indicated output corrected by the losses of the friction, the power needed for the drive of the auxiliary machines etc. represent the effective output or mechanical efficiency, which can go up to 96% of the indicated output. It is quite different concerning the heat efficiency, which is the proportion between the theoretical and the real output or the difference between the calories contained in the fuel introduced in the engine and the value of that part of energy converted by the engine into useful work. The heat efficiency is very low (20 to 25%) due to the important losses caused by the already mentioned loss of heat in the condenser and on the wall of the working cylinder, by the use of a full instead of a cutoff fractional admission into the working cylinder at the beginning of the power stroke, by exagerated or incomplete expansion, clearance lossee, imposibility to keep the engine close to a stable working temperature etc. Although the proposed reciprocating steam engine solves all these problems, it is difficult to evaluate its efficiency with a pure theoretical calculation. This should be done with long lasting tests made with great care by experts. It is usually calculated on the basis of an approximate diagram by converting the height of the working cylinder in mm into the pressure in kg/cm$^2$.

We shall nevertheless keep on describing the construction features of the proposed steam MME and of its putting into operation in order to prove its feasibility, leaving to the experts to make the calculation of its performances. Consequently, the enclosed drawings drawn to 1:1 scale should suggest the dimensions of the principal elements of the engine and other important parameters to be taken into consideration already during the preliminary calculations, which can be summarized as follows:

- cubic capacity of the working cylinder,
- specification of the associated boiler and its heating surface,
- kind and calorific value of the fuel,
- quantity of steam to be generated per hour,
- temperature and pressure of saturated and superheated steam,
- speed of the steam circulation within the closed circuit,
- calories and time necessary to regenerate the saturated steam,
- specification of the eventually associated gas engine and the thermal value of its exhaust gases.

Most of these requirements are elaborated in the "Machines à vapeur à piston, turbines à vapeur" by N. Mestre, Tome II 7eme Edition—1960 A. De Boeck, Bruxelles and several kinds of small and medium size boilers are described by G. Lamasson, A. L. Tourancheau, L. Vivier in the "Eléments de Construction—production et utilisation de la vapeur", Tome IX, Dunod, Paris 1971, pages 67/77 and 85/86. According to the size and the purpose, the small boilers evaporate from 100 to 4500 kg/m$^2$/h, which goes up in the medium size boilers to 38 t/h of the steam with a pressure of 25 to 145 bars and a temperature of superheated steam between 450° C. and 520° C.

Nevertheless, the boiler which we need must be of a specific construction, taking into consideration that the place available for the erection of the proposed steam operated MME in a vehicle should not exceed a length of 90 cm, a width of 60 cm and with a conventional rod and crank assembly a height of 82 cm. No doubt that within these limits it is possible to construct a smaller steam engine of a satisfactory size and performance. By way of example the enclosed drawings FIGS. 10, 11, 12, 13, 14, 15, 16, 17 and 18, though illustrated in a reduced width due to the lack of space, combined together, represent a MME operated on steam, having a working cylinder of 150/140 mm and a boiler equipped with 234 tubes of 22.5 mm outer diameter, which, together with the outer surface of the working cylinder and that of the steam injector, amount to a heating surface of about 9.75 m$^2$. To draw a comparison, another MME not illustrated, built within the same parameters, having a working cylinder of a bore/stroke 230/140 mm and a boiler equopped with 92 tubes of 32.5 mm outer diameter, makes together with the outer surface of the working cylinder and of the steam injector a heating surface of about 5.75 m$^2$.

Taking into consideration that according to G. Lamasson and coauthors (p. 69,73,77,85) the production of small boilers of 35/kg/m$^2$/h can be increased by a forced circulation to 65 kg/m$^2$ and with a fire place under pressure up to 600 kg/m$^2$/h, there is no doubt that within the cited parameters a boiler of a capacity sufficient to operate the proposed steam MME can be installed. The more, the proposed construction includes a forced circulation of steam automatically adjustable to the speed of the engine and a fire place under pressure also dependent on the crankshaft's revolutions.

SPECIFIC DESCRIPTION OF THE MME OF THE FOURTH EMBODIMENT

The MME of the Fourth Embodiment consists of a cylinder block and a cylinder block head almost identical to those of the MME of the Fourth Embodiment. The difference consists in the elimination of the ring shaped disc valve with its accessories 77,78,79,80, of the vertical air ducts and water tubes pierced in the wall of the cylinder motor 53,81,82,83, 84,85,86,87,88, as well as of the inlet duct 8 and exhaust duct 112, all illustrated in FIG. 1. With this correction, the MME executed in the fourth variant can simply be connected with a factory steam boiler in order to use the boilers high pressure reduction to generate electricity as already explained above. Nevertheless, whenever necessary to overcome the lack of erecton space, to reduce the weight, the consumption of fuel and water as it is the case with small transport engines, the proposed steam MME should be then equipped with its own boiler, and function together with it in a balanced arrangement as a single working unit. Even in this case the engine does not differ from the above described simple variant, except for the elements of its boiler being the integral part of the engine as it will be described afterwards.

The engine consists of a lower and an upper part. The lower part consists of four vertical cylinders rising from the bottom of a water jacket 266 which envelops the entire engine including its boiler. The working cylinder 267 is surrounded by a convergent cylinder 268 which forms by the extension of its outer wall an adjacent twin cylinder 269 inside which a fourth cylinder 270 is built-in, enclosing a steam injector 271. All four cylinders 267,268,269,270, are covered by a common cover 272 serving as the principal means of communication between the lower and the upper part of the engine, and also as the support of the entire cylinder-block head and its fastening into a single working unit with the lower part of the engine. In the cover 272 are perforated holes traversed by projecting studs 273,274, protruding from the top of the walls of the cylinders 268,269,270. Between the working cylinder 267 and the converging cylinder 268, all-around the working cylinder, is fixed to the bottom of the water jacket 266 by screw bolts 275,276 a ledge 277, separating the water compartment 278 from the steam compartment 279,280 and serving as the support to a removable nest 281 of the welded evaporating tubes opened on both ends of which about three quarters are situated in the superheated steam compartment 279 and the rest in an adjacent saturated steam compartment 280 situated between the working cylinder 267 and the steam injector 271. The superheated steam compartment 279 is connected through the passage 292 with the superheated steam envelope of the working cylinder 293, which communicates with the working cylinder 267 through the steam inlet ports 294,295 controlled by the inlet sliding valve 296, which rests on the spring 297 supported by a small platform 298 protruding from the upper part of the evaporating tubes nest 281 of which the tubes belonging to the superheated steam compartment 279,293, are connected through an opening 299, pierced in the cover 272 and in the adjacent basic disc 105 with the central superheated steam distributing compartment 300 situated in the upper part of the engine. The evaporating tubes of the said saturated steam compartment 280, welded in the nest 281, are connected on one side through the passage 301 with the vertical part 302 which communicates with the working cylinder 267 through the outlet ports 303,304, which are controlled by the outlet sliding valve 305 resting on the spring 306, supported by a small platform 307 protruding from the upper part of the nest 281. The same saturated steam compartment 280 is connected on its opposite side through a passage 308 with the saturated steam compartment 309 connected by the valve 310 with the lower enceinte of the injector 271. In the same way as in the first variant, the cylinder motor CM1 91,311, is suspended from the second elevated stage 113 of the basic disc 105 of the lower load bearing structure, however this time as mentioned above, without the disc valve 77 and inertia valves 64,65 (see FIG. 1), but with a thicker lining 312 of the CM1,311 and with openings 54,55, connecting the CM1 with the CM3 situated at a lower position which is of capital importance in the steam variant as it will be explained afterwards. The entire piston 313,314 and 57 remains unchanged except for the way in which its external cylindrical part 313 is fixed to the internal part 314, which is optional for all variants. In the lower part of the cylinder 270 which encloses the steam injector 271 a ledge 315 is inserted and fixed by a screw-bolt 316 to the bottom of the water jacket 266, consisting of a vertical cylinder guide 317, rising up to the top of the steam injector 217, serving as guide to a free piston 318 which, provided with internal and external piston rings 319,320, slides against the external wall of the cylinder guide 317 and the internal wall of the cylinder 270. From the lower part of the cylinder guide 317 protrudes a circular platform tightly inserted by its vertical supporting wall 321 into the lower part of the cylinder 270, bearing on its horizontal surface 322 an internal cylinder 323 fixed on it by the screw-bolts 324,325, provided with a horizontal cover 326 accomodating an external valve 310 which connects the saturated steam compartment 309 with the steam injector 271 and an internal valve 327 connecting the steam injector 271 with the superheated steam compartment 328, further connected through the opening 329 with its lower part 330 connected in turn on one side through the openings 331,332, with the superheated steam compartment 333 situated in the cylinder guide 317 and on the other side through the opening 334 with another superheated steam compartment 335 containing at least one security device 336, connected through the opening 337 with the superheated steam compartment 338 containing another evaporating tubes nest 339 situated between the outer wall 270 of the steam injector 271 and the internal wall of the twin cylinder 269, supported by the ledge 340 fixed to the bottom of the water jacket 266 by the bolt and screw 341, 342 with tubes opened at both ends and with the upper part of the compartment connected through the opening 343 pierced in the cover 272 and in the adjacent basic disc 105 to an upper superheated steam compartment 344 containing evaporating tubes nest 345 with tubes opened on both ends, situated between the outer wall of the upper part of the cylinder 270, enclosing the cylinder head 346 of the steam injector 271 and the inner wall of the upper part of the twin cylinder 269, the nest being supported by the basic disc 105 fixed by the screws 347 onto the cover 272. The nest 345 of the upper superheated steam compartment 344 reaching on both ends the wall of the converging cylinder 268 delivers the accumulated permanently pressurized circulating superheated steam through the openings, not represented, into the central superheated steam distributing compartment 300 equipped itself with another evaporating tubes nest 348 supported by the basic disc 105 fixed on the cover 272, situated within the upper part of the converging cylinder 268 so that all space around the lower and upper load bearing structure 113,131 as well as the space within both compartments 300 and 279 connected by the passage 299 is permanently filled with the high pressure and high temperature superheated steam. In this way the forced closed circuit of the superheated steam and within it of the saturated steam are closed, and their repetition can take place only through the power stroke occurring in the working cylinder 267 and in the steam injector 271, both controlled by their respective valves. The concentrically arranged valves are exactly of the same construction and are operated in the same way by the overhead camshaft, permanently immerged into the lubricating oil circulating under the pressure of an oil pump, not represented, situated at the bottom of the crankcase.

The auxiliary steam inlet regulating valve 349 associated with the secondary dosing chamber Sec.DCH and with the inlet compression chamber ICOCH is provided with a specific regulating device of capital importance for proper functioning of the steam MME. It automatically converts all three on steam expansion operated cylinder motors CM1, CM2, CM3, whenever necessary, as long as necessary, according to the changes of the load from the expansion steam engine into a full pressure operated steam engine. The device consists of a conventional centrifugal regulator, not represented, being part of a joint sleeve 261 fitted on the camshaft 116, provided with a fork 262 with two prongs 263 sliding on two opposite sides of a sloping up surface 264 of the valve spring cover 265, exercising simultaneously a thrust against the auxiliary steam inlet regulating valve 349 associated with the secondary dosing chamber Sec.DCH and with the inlet compression chamber ICOCH 284 and against the sliding valve 296 which controls the inlet ports 294,295, of the working cylinder 267, allowing the increase or decrease of the steam inlet according to the changes of the load, without disturbing the regular operation of the said valves by the camshaft and without opposing the increase of the driving force during the exhaust stroke of all five cylinder motors CM1, CM2, CM3, CM4, CM5.

The main steam dosing chamber SDCH is associated with a main steam inlet valve 350 connecting it with the superheated steam compartment 300 and on its lower part with a main steam dosing valve 351 associated to its central compression chamber CCOCH. The saturated steam exhaust control valve 352 is associated with the saturated steam exhaust compression chamber ECOCH, 353, and with the saturated steam chamber SSCH which is connected by an opening 354 with a transit chamber 355 directing the surplus of the saturated steam through the passage 356, into the saturated steam compartment 280 and the saturated steam envelope 302 of the working cylinder 267 and further through the said opening 308 into the saturated steam compartment 309. A permanent increase of the pressure and temperature of the saturated steam during its passage through the heat exchanging tubes 281 and the steady arrival of the additional steam forces the valve 310 to open, connecting the saturated steam compartment 308 with the steam injector 271, forcing its piston 318 to start its upward movement toward a cylinder block head 346, identical to those of the previously described variants, operated in the same way on the combustion products by means of the same devices consisting of two concentrically arranged valves, comprising the following elements:

a frame 346 tightly inserted into the upper part of the cylinder 270 supported by the cover 272, suspended from the same load bearing disc 357 supporting the steam operating valves, spread over the entire upper surface of the engine, bearing three suspended valve cages 285,286,287, supported by the cover 272, equiped with the same valve accessories as those described in previous variants, permanently immerged into the lubricating oil circulating between the crankcase and the main oil reservoir 124 enclosed between the said disc 357 and the cover of the engine 358;

the PCCH and the Sec.CH being of the same construction as those described in the previous variants are associated with the same valves, namely an external valve 359, provided with a flange stopper 360, an internal valve 361, each provided with its own injector 288,289. The upper explosion chamber UECH is situated in a small compartment 364 at the top of the cylinder guide 317 which is inserted into a circular groove cut in the lower surface of the cover 272. The UECH is associated with the Sec.CH by the internal valve 361 provided with a fuel injector 366, separated from the superheated steam compartment 333 situated in the cylinder guide 317, by a dividing plate 365, connected with the upper part of the steam injector 271 through the openings 367,368;

the steam injector's cylinder block head 346 is fed by fresh air under pressure coming from a compressor-turbine, not represented, operated on the exhaust gases from the boiler guided through a duct 369, and the inlet ports 370 into the antechamber 371 associated through the intake valve 372 with the upper part of the steam injector 271 operated on combustion products.

The exhaust valve 373 is connected through the opening 374 with the fire plac of the boiler, however through the intermediary of a non return valve 375 which closes automatically whenever the pressure in the boiler's forced circulation overcomes the pressure prevailing in the upper enceinte of the steam injector during the exhaust of the burned gases.

All four valves 359,361,373, controlling the operation of the steam injector 271 are actuated by a specific device consisting of an outer camshaft 376 fit on the main camshaft 116 sliding on it, first under the pressure of the air compressed in the upper enceinte of the steam injector and after the first explosion, under the pressure of burning gases expanding throuh the duct 377 into the transit chamber 378 and further through a restraint passage 379 and a non-return valve 380 into the high pressure chamber 381, exercising pressure against a mobile cylinder 382 which is an integral part of the said outer camshaft 376, provided with a spring 383 resting on the bottom of another fixed cylinder 384, pushing on its way ahead three shoes 385,386,387, against the sloping up surface of the valve spring cover 388,389,390 opening successively in precisely determined small intervals of time the valves 361, 359, controlling the secondary chamber 363 and the precombustion chamber 362, opening the way to their burning air-fuel mixtures to expand within the enceinte 271 of the steam injector 270 full of compressed air. The prolonged combustion is sustained by an additional fuel injection 366 into the upper explosion chamber UECH-364 until the free piston 318 reaches its BDP, forcing the saturated steam accumulated below its lower surface through the internal valve 327 into the superheated steam compartment 328. At that moment the shoes 385, 386,387, under the pressure of the explosion have attained their most advanced position, keeping all valves opened for a short time starting slowly to return them in their initial position by the release of the spring 383 occurring at a speed proportional to the size of the said restraint passage 379, decreasing progressively the pressure in the high pressure chamber 381. However, before these valves are closed, the fresh air blown by the turbine under higher pressure than the pressure prevailing in the boiler penetrates into the enceinte 271 of the steam injector 270, forcing out the burned gases through the valve opening 373 and the adjacent outlet 374 into the fire place of the boiler, filling at the same time the entire space, including the precombustion chambers with fresh air.

The burner 392 feeding the boiler with fuel should be adjusted to the kind of fuel or fuels used which have to be introduced through their respective fuel induction tubes 393 together with air of a predetermined pressure, arriving through the duct 394 from the said turbine operated on the exhaust gases from the same boiler and/or from the impeller of the radiator of the associated gas cylinder. The number and position of the burners 392 shall be determined according to the number of fuels as well as to the division of the fire place 391 into compatments separated from each other by adjustable passages for flames and smoke, not represented.

As already stated, the MME executed in the steam variant is entirely immersed into a water jacket 266 in the shape of a casing lagging also the entire boiler in order to protect the environment and some parts of the engine from the excessive heat and to use its radiation to warm the water. This protection is of particular importance for the parts of engine working immersed in lubricating oil as for example all valves and their accessories, camshaft, oil pump situeted in the crankcase etc. which are all protected by the water circulating in the lower and vertical part 278,395, of the water jacket as well as in the upper horizontal part 396 enclosed between the disc 357 of the upper load bearing structure and its cover 290 fixed by the bolts and screws 273,274,398,399. The water supply device, not represented, should regulate the water level in the water jacket 278,395,396, evacuate air and gases mixed with steam, cover the leakages and drain the eventual water and or steam surplus through the drain outlets 291 and others situated on the top of the engine, not represented. In the bottom of the boiler some space free of water is left for an ash-box.

METHOD OF OPERATION OF THE MME OF THE FOURTH EMBODIMENT

The MME of the Fourth Embodiment is always operated on a two stroke working cycle. Although substantially differing by its nature from other gases, steam can be used for operating an MME of the same constructional conception as those operated on combustion products. Of course, the steam variant should be adapted to some specific requirements of the steam, although the most important ones are already settled by the very constructional conception of the MME. It was already mentioned (page 6) that the MME operated on combustion products can be converted in a double acting engine by using its lower compressor CO2 as an additional four stroke conventional ICE. In case of a two stroke steam operated MME the employment of its double acting cylinder motor CM4 as the working cylinder of an additional two stroke steam engine acting in the opposite direction is included in the initial design without any particular adaptation.

Intended to be used as a transport engine, the proposed MME executed in the fourth variant should preferably be built as a hybrid engine in combination with at least one cylinder operating on combustion products, which should eliminate the waiting until the necessary steam pressure will be achieved, and accelerate the steam operation by blowing its exhaust gases into the fire place of the boiler. Otherwise the engine shold be equipped with an auxiliary blower to perform this task. If built as a hybrid engine, the vehicle shall start on its gas cylinder with the impeller of its radiator already blowing its surplus of compressed air mixed with fuel and with its exhaust gases into the fire place of the boiler. At the moment of the achievement of the necessary steam pressure, the engine can continue either as a steam operated or as a gas-steam operated engine.

At the beginning of the steam operation:

all the compartments 279,293,300,328,330,333,335,338,344 of the superheated steam and their evapoating tubes welded in their respective nests 281,339,345,348, are full of superheated steam estimated to be of a temperature of at least 520° C. and of a pressure of at least 125 bars;

all the compartments 280,302,309,355 and their part of the evaporating tubes in the common nest 281, are full of saturated steam estimated to be of a temperature of about 140° C. and of a pressure of about 5 bars;

depending on the position of the sliding valves controlling the inlet and outlet ports of the working cylinder 267, the cylinder motor CM5 is full of saturated steam while the saturated steam from the CM4 is already evacuated into the saturated steam envelope 302 of the working cylinder 267.

The cylinder motors CM1,CM2,CM3 with their respective compression chambers CCOCH, ICOCH, ECOCH are full of saturated steam.

The main steam dosing valve 351, the central steam inlet valve 350, the saturated steam exhaust control valve 352 are closed, the auxiliary steam inlet regulating valve 349 is in the position corresponding to the actual speed of the engine.

The inlet ports 294 of the CM5 and the outlet ports 303 of the CM4 are closed, the inlet ports 295 of the CM4 and the outlet ports 304 of the CM5 are opened.

the pressure of the saturated steam enclosed in the envelope 302, in the saturated steam compartments 280,309 and in the evaporating tubes of their nest 281, is steadily kept on the high level by new steam forced out of all five cylinder motors CM1 to CM5 by their respective pistons 60,61,57,251, and further increased by the passage through the evaporating tubes 281, keeping the valve 310 permanently open, thus penetrating systematically into the steam injector 271 below its free piston 318 forcing it to move slowly upwards.

The upper part of the steam injector 271 over the piston 318 and both combustion chambers 362,363, are full of fresh air with all three shoes 385,386,387, drawn back by the expanded spring 383, reducing the volume of the high pressure chamber 381 and closing all four valves 372,359,361,373.

The forced circulation of the air fuel mixture in the fire place of the boiler 391 permanently increases by convection the temperature and the pressure of both superheated and saturated steam circulating in the evaporating tubes and in all steam compartments.

During the heating time, which should not exceed two minutes, the steam engine is separated by an auxiliary clutch engagement, not represented, from the already running gas cylinder; its crankshaft and all its crankshaft driven working parts, still lying until a device subjected to the pressure of the steam, not represented, shall disengage the spring of the said clutch and put the steam engine automatically into operation, either as a steam or as a combined steam gas engine;

at this moment, the steam MME with the piston 60,57,251,313,314, in the BDP, start the process as follows:

At the beginning of the first stroke which is at the same time tha main exhaust stroke and an auxiliary power stroke of a two stroke working cycle, which corresponds to the movement of the piston 57,60,251,313,314, from its BDP to its TDP with the crankshaft in 0° position, the main steam dosing valve 351 ia closed, the central steam inlet valve 350 is open, the pressure and the temperature of the steam in the SDCH is equalized with those prevailing in the superheated steam compartments of the entire engine;

the inlet ports 295 are opened and the outlet ports 303 are closed during the entire stroke so that the cylinder motor CM4 operating at full pressure in the opposite direction stimulates the compression and the forced circulation of the saturated steam, the upward moving piston starts to compress the saturated steam in three successive stages:

in the first stage simultaneously in all three idle cylinder motors CM1,CM2,CM3, in the second stage when the top of the piston 61 reaches the lined part 312 of the CM1, the compression continues in two separate enclosures, namely in the LCOCH of the CM2 and in the CM1 and CM3, connected through the openings 54,55, into a single compression space, in the third stage when the top of the piston 61 closes the openings 54,55 the separated compression of the saturated steam continues in the central compression chamber CCOCH of the CM1 and in the LCOCH of the CM2, while, due to the timed opening of the saturated steam exhaust control valve 352, the predetermined percentage of saturated steam from the CM3 is forced through the opening 283 into the saturated steam compression exhaust antechamber ECOCH 353 and further through the transit chamber 355 into the saturated steam envelope 302 to pursue its way through the evaportaing tubes nest 281, saturated steam compartments 280, 309 and external valve 310 into the lower enceinte of the steam injector 271, pushing its free piston 318 slowly upwards to compress the air enclosed in the upper enceinte of the steam injector 271. During its way toward the steam injector, the saturated steam under pressure already starts its regeneration by circulating freely through its separated part of the evaporating tubes welded in the common nest 281, opened on both ends within its separated saturated steam compartment 280. However, by closing the outlet ports 304 of the CM5 and the saturated steam exhaust control valve 352 of the CM3 before the arrival of the piston in its TDP, the connection with the saturated steam envelope 302 will be interrupted and a predetermined part of the saturated steam will also be compressed in these two cylinders. Bearing in mind that at the same time the main steam dosing valve 351 is closed and that in the ICOCH the compressed steam will be present whatever will be the position of the auxiliary steam inlet regulating valve 349 shall remain in all four cylinder motors CM1,CM2,CM3,CM5, a predetermined quantity of compressed saturated steam helping the arriving piston to change smoothly the direction of its movement and to increase the thrust against the piston in cooperation with the superheated steam penetrating from the SDCH and from the superheated steam envelope 293.

At the moment of the arrival of the piston in its TDP, the main steam dosing valve 351 is opened and the superheated steam enclosed in the SDCH—amounting to 1/10 of the cubic capacity of the working cylinder 271—mixes with the compressed saturated steam remaining over the top of the piston in all cylinder motors except the CM4.

The superheated steam inlet opening 295 in the CM4 is closed and its outlet opening 303 is opened. Simultaneously the inlet opening 294 of the CM5 is opened and its outlet opening 304 is closed.

At the beginning of the second stroke which is at the same time the main power stroke and an auxiliary exhaust stroke of the two stroke working cycle, which corresponds to the movement of the piston 61, 60, 57, 251, 313, 314, from its TDP to its BDP, the mixture of the superheated steam from the SDCH with the saturated steam compressed in the CCOCH, converted by compression into high temperature superheated steam exercise a power thrust against the top of the internal part of the piston 61, corresponding to the thrust developed in the high pressure cylinder of a compound steam reciprocating engine. At the same time a moderate thrust is exercised by the expansion of compressed steam in all compression chambers ICOCH, ECOCH, LCOCH, while the pressure of the part of saturated steam compressed in the COCH5 of the CM5 is amplified by the opening of the inlet ports 294 by the sliding valve 296, connecting it with the superheated steam envelope 293 operating it at full pressure during the entire power stroke.

When the downward-moving piston 314 uncovers the openings 54,55, the re-established connection between the CM1 and CM3 cause the mixing of both steam and their further common expansion in the increased expansion space, corresponding to the volume of the medium pressure cylinder of a compound steam engine. When the tops 61 and 57 of the piston 313,314 descend below the lining 312 of the CM1,311, the entire expansion space of the CM1,CM2 and CM3 is converted into a single expansion space corresponding to the volume of a low pressure cylinder of a conventional compound steam engine;

the pressure developed in the CM1, CM2 and CM3, joint by the full pressure operation of the CM5 shall exercise a common thrust against the total surface of the piston by the steam expanding in three successive stages in order to reach at the end of the stroke an estimated 5 bars pressure;

at the end of the stroke, the lower face of the double acting piston 57 has exhausted the total of saturated steam from the CM4 through the outlet opening 303 into the saturated steam envelope 302,280. The lowering of the outlet sliding valve 305 closes its outlet ports 303 while the sliding inlet valve 296 simultaneously opens its inlet ports 295 to allow the penetration of superheated steam from the envelope 293 ensuring the operation of the CM4 at full pressure during the entire following stroke;

at the same time and by the same lift, the sliding valves 296 and 305 close the inlet ports 294 of the CM5 and open its outlet ports 304 in order to allow the exhaust of the saturated steam into the saturated steam envelope 302.

the main steam dosing valve 351 is closed and the central steam inlet valve 350 is opened so that the SDCH is filled with superheated steam of the pressure and temperature prevailing in the superheated steam compartments and the evaporating tubes of the entire engine.

Consequently, before the beginning of the following working cycle the situation in the engine corresponds exactly to the situation described at the beginning of the previous working cycle.

Nevertheless, the described method of operation cannot ensure perfect results without being sustained by specfic devices allowing to realize its specific requirements and to accomplish each working cycle with an engine capable of continuing its work. These already described particularities should be explained more in details:

the problem of the adjustment of the efforts of the engine to the changing load is solved by the described regulator, controlling the auxiliary steam inlet regulating valve 349 although this valve is operated at the same time by the camshaft according to the programmed valve timing. Consequently, by the increase of the load, the regulator shal open the said valve at the moment when, according to the programed working cycle it should be closed. In other words, the additional superheated steam will be injected against the piston running in the opposite direction during the exhaust stroke. As far as such an injection occurs at the moment the top of the piston 61 enters the lined part 312 of the CM1, interrupting its connection with the CM3 by obturating the passages 54,55, the programmed compression of the saturated steam in the central compression chamber CCOCH shall not be affected. If it occurs earlier, it will be diluted in the saturated steam and compressed together with it until the saturated steam-exhaust controlling valve 352 opens the way toward the saturated steam compartments 280,302. If the injection occurs against the opposite movement of the piston in the CM4 or CM5, it will simply accelerate the exhaust of the saturated steam through—at that time opened—outlet ports 303,304, according to the programmed timing of the valve operation.

Another all-important problem is the regeneration of the saturated steam. It consists in the conversion of the expanded steam at successive very short time intervals, becoming shorter with the increase of the speed of the engine. To master this delicate matter in the restricted limits of a compact transport engine, the MME in its steam variant is capable to carry out a technological process resolving the problem in the following way:

the engine works on closed water and steam circuits thus without loss of heat by condensation and without repeated heating of the condensed water, the temperature and the pressure of the expanded steam after the power stroke is kept on a high level so that its conversion into superheated steam shall not require neither too much heat nor to long time, the compression of a part of the saturated steam in the cylinder motors enables the smooth functioning of the engine, diminishing at the same time the quantity of saturated steam to be regenerated by its passage through the evaporating tubes, thus facilitating the task of the boiler. The losses caused by the compression of a partz of the saturated steam in the cylinder motors CM1, CM2, CM3, are recovered in large part by an increase of its temperature by compression and by its own expansion at the beginning of the power stroke, the full pressure operation of the two cylinder motors CM4 and CM5, the often repeated intervention of the auxiliary steam inlet regulating valve 349 and the forced circulation of the steam under the uninterrupted pressure of the piston during the exhaust stroke in both direction, combined with the pressure of the injected steam resulting from the explosion occuring in the upper part of the steam injector, accelerate the flow and regeneration of both saturated and superheated steam in their respective evaporating tubes.

the regeneration and the keeping of the steam at the prescribed temperature and pressure is facilitated by the forced circulation of the air-fuel mixture through the boiler's fire place.

The realization of the described technological process also depends on a precise calculation of the position of the openings 54,55 on which depends the most effective evolution of the described three stages steam expansion process. Of the same importance is the determination of the height of the lining 312 of the CM1, on which depends, during the exhaust stroke, the division of the saturated steam into two parts of which one is to be compressed in the cylinder motors CM1,CM2,CM3, and the other to be regenerated by the passage through the evaporating tubes of the boiler.

Figure 15:
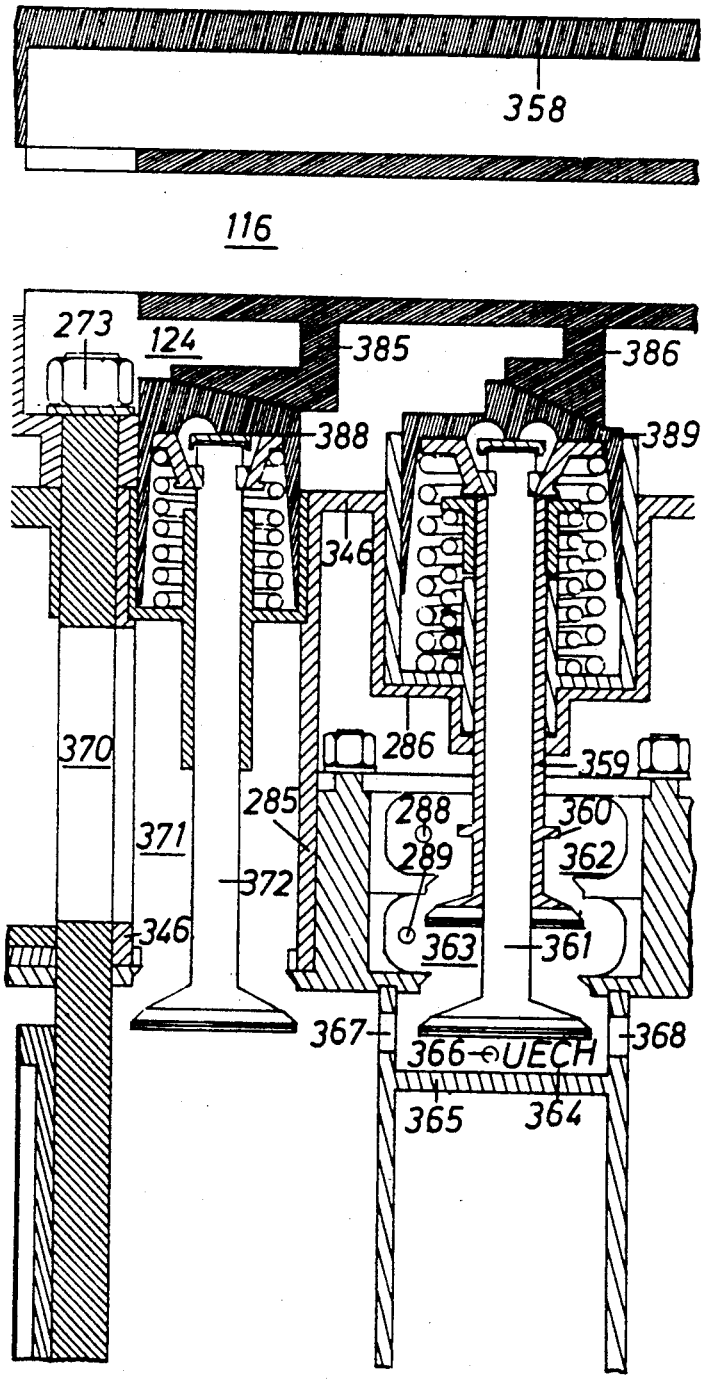
Figure 16:
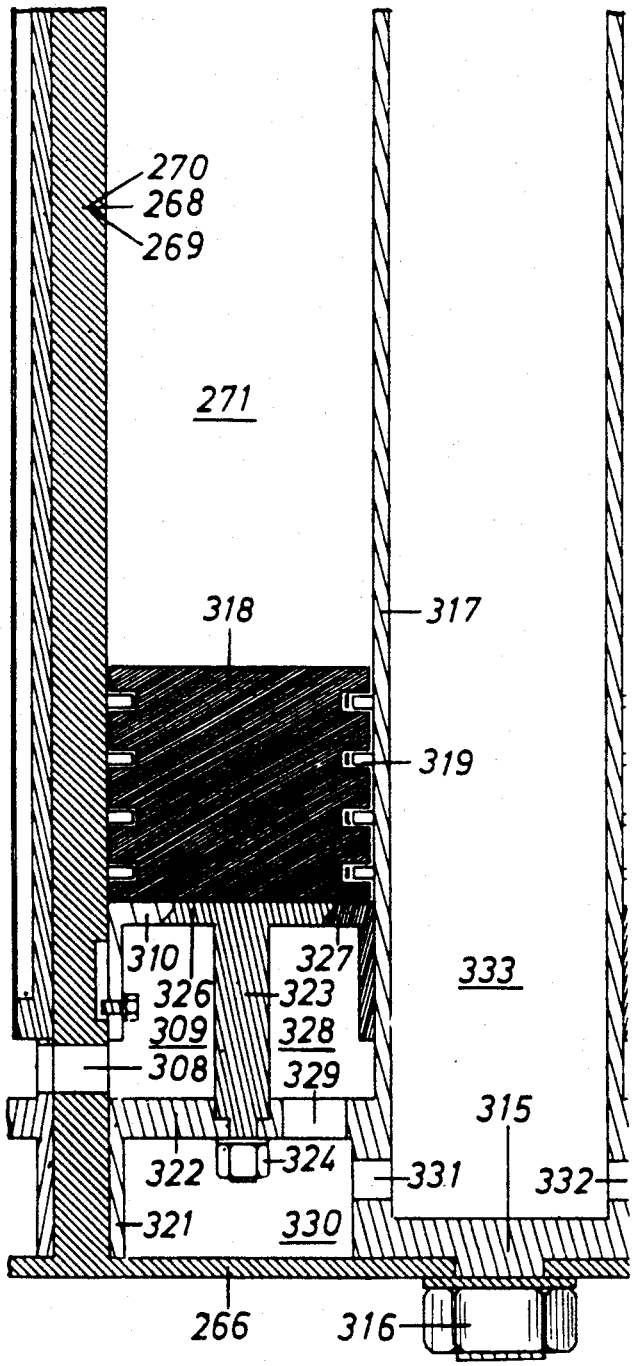
Figure 17:
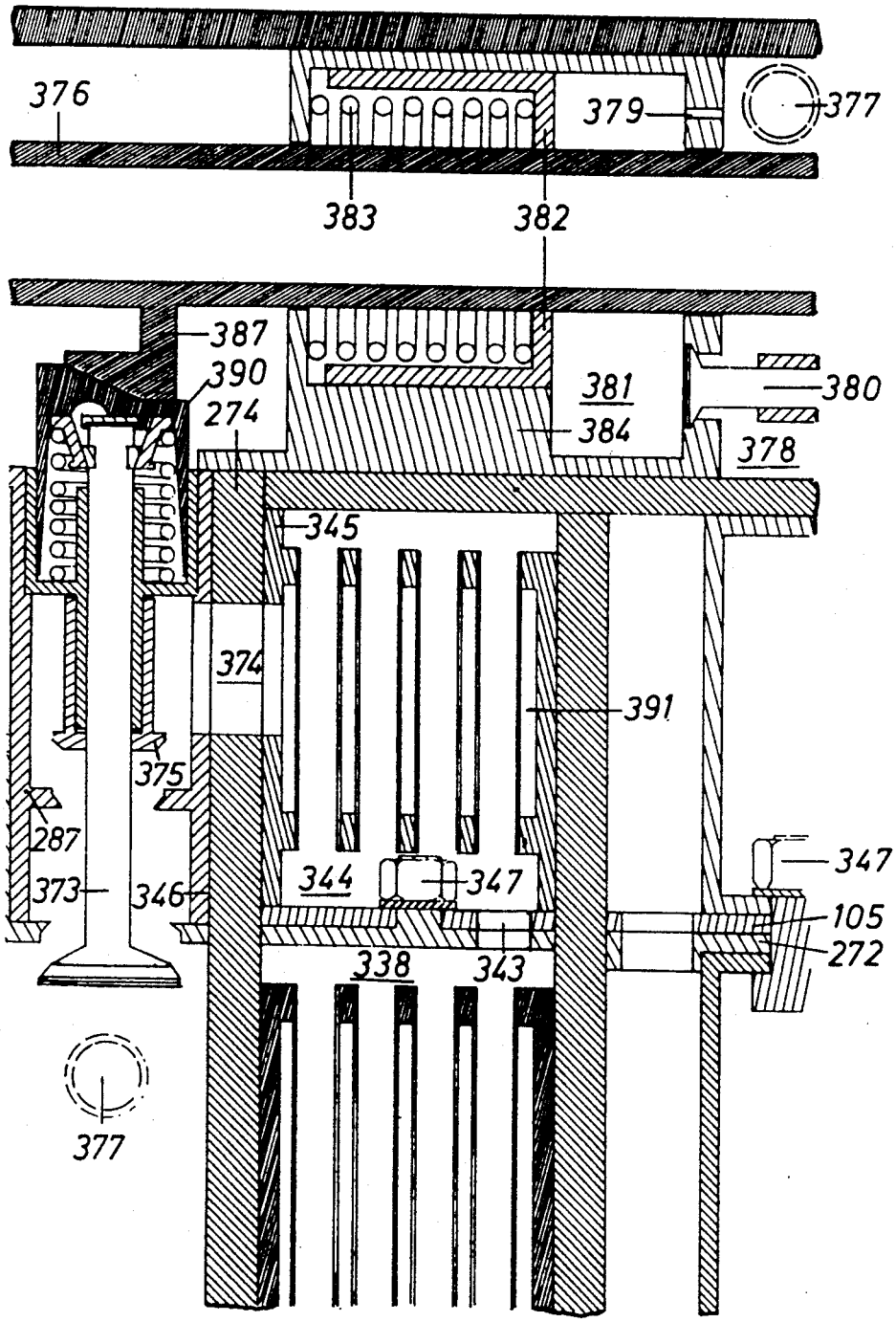
Figure 18:
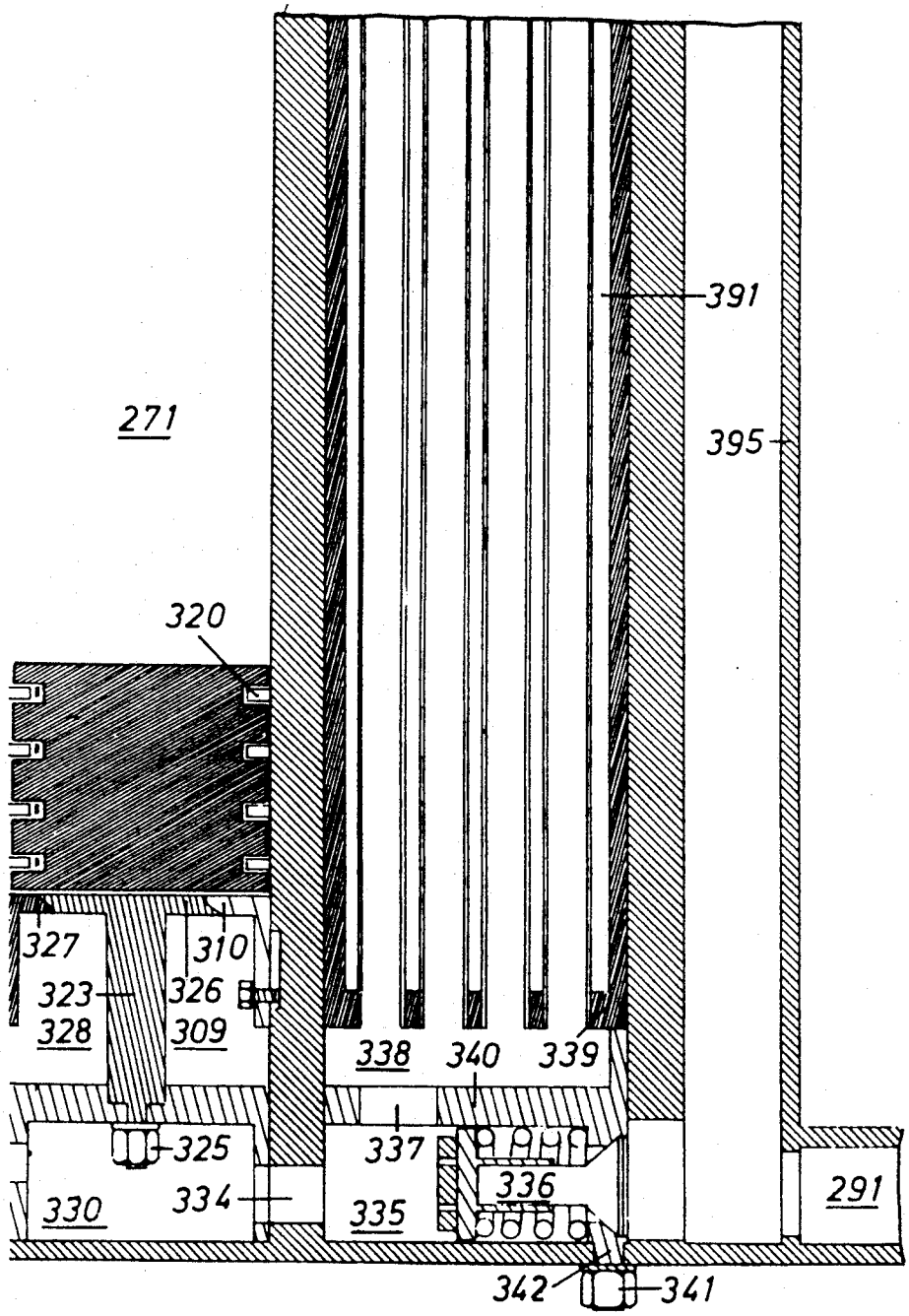
Figure 19A:
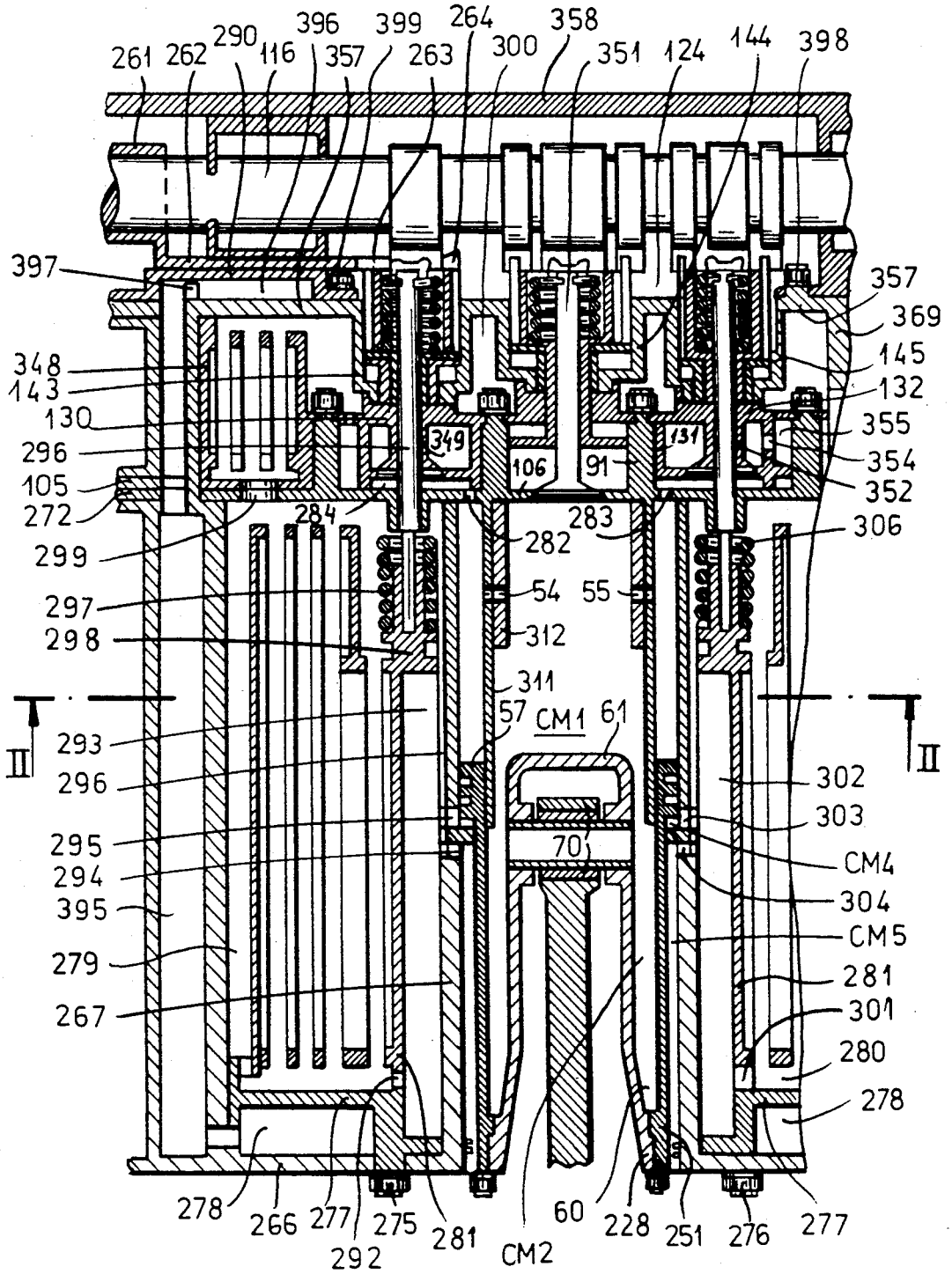
FIG. 19, consisting of the combined FIGS. 11,12,13,14,15,16,17 and 18 in section along line I—I of FIG. 20 represents a vertical section of a steam operated MME illustrated with its own boiler.
Figure 19B:
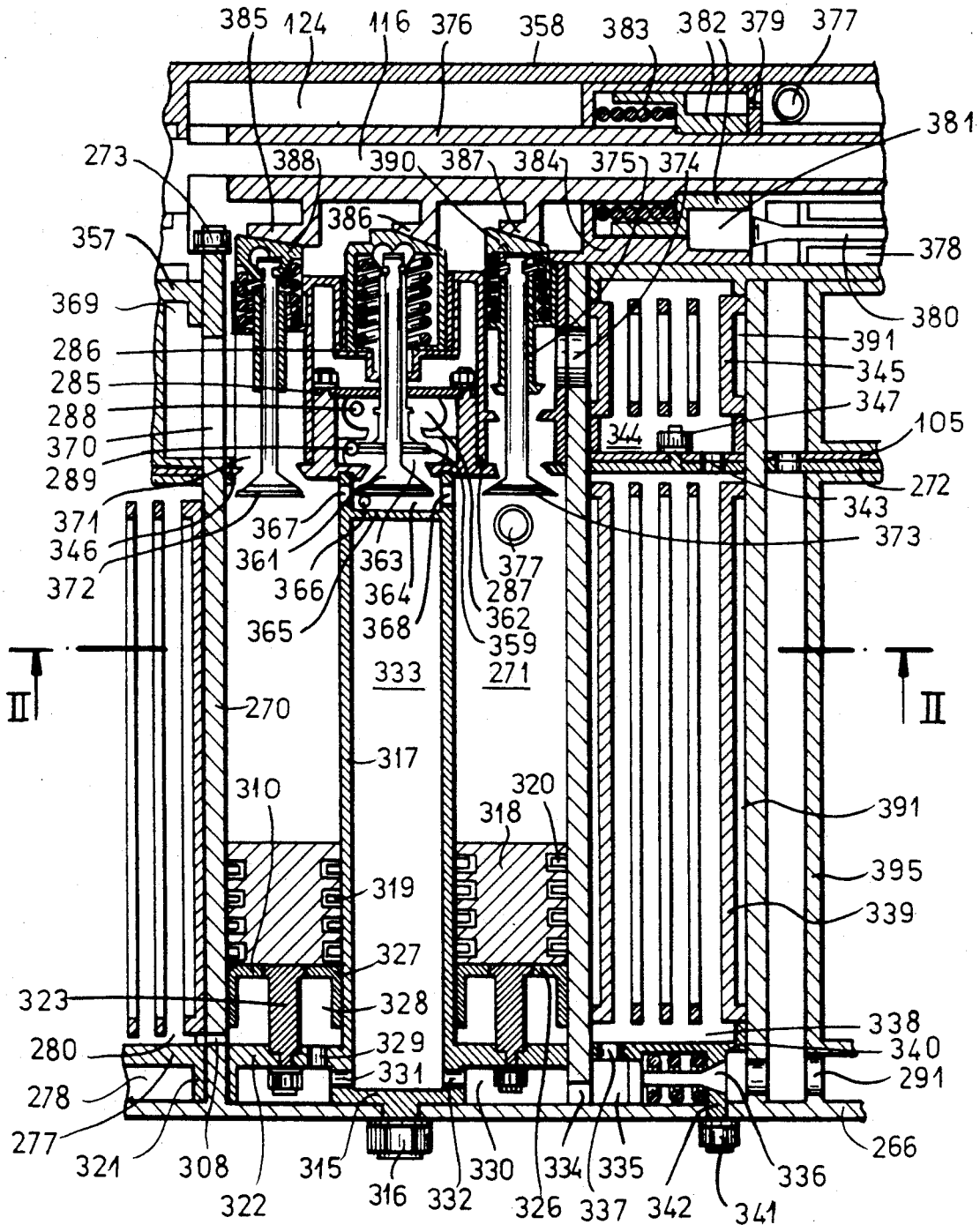
Figure 20:
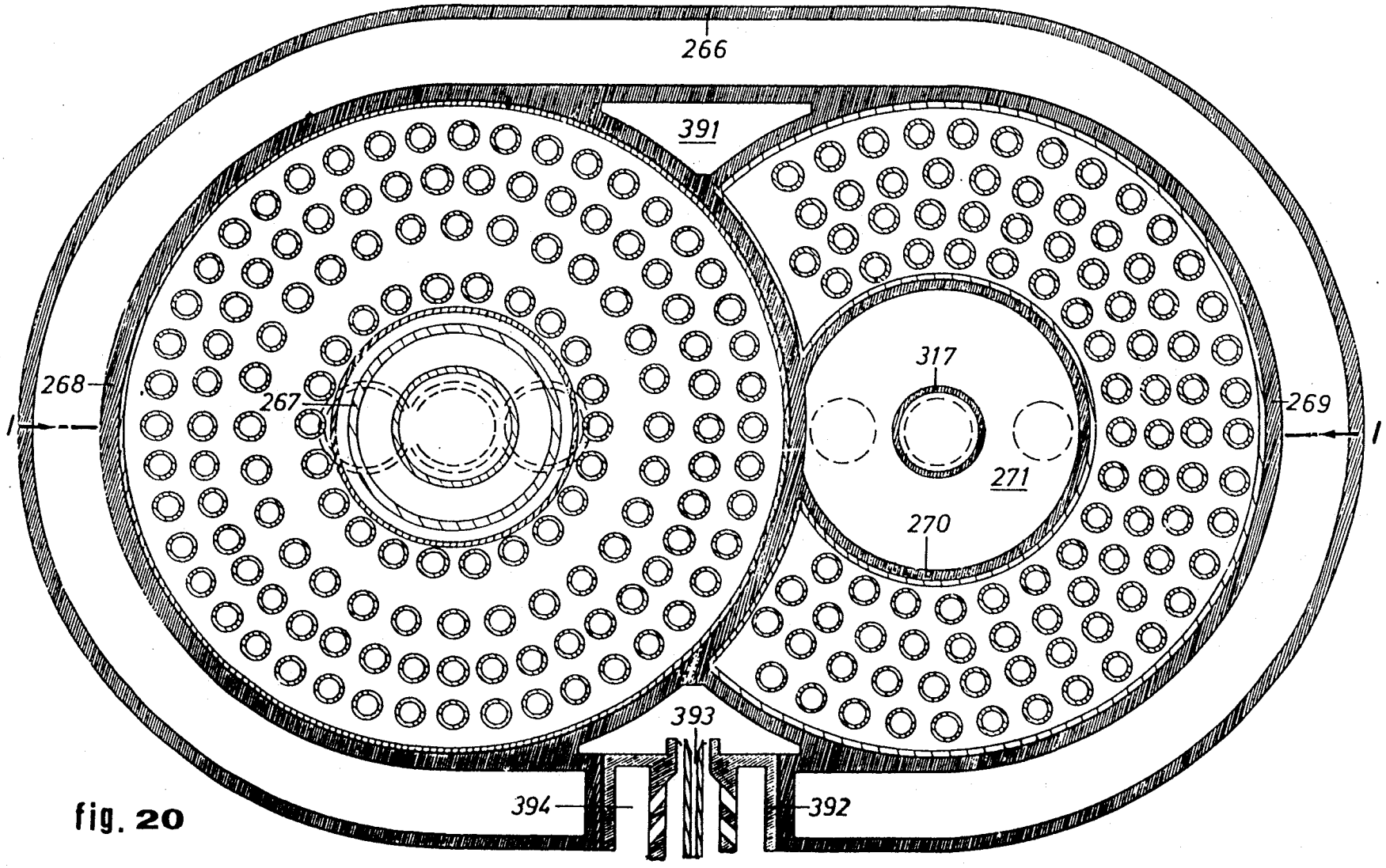
FIG. 20 represents in section along line II—II of FIG. 19 a steam-operated MME in a fourth embodiment with its own boiler.

Another important detail is represented by the timing of the explosion of the air-fuel mixture compressed in the upper enceinte of the steam injector 271 by its free piston, forced toward its TDP by the thrust exercised by the compressed saturated steam against its lower surface. The explosion is triggered by the achievement of a preselected compression ratio which, according to a rough calculation at a speed of 3000 RPM should occur every 3½ seconds. The aim of the explosion is to force the saturated steam accumulated under the piston 318 through the valve 327 into the superheated steam compartment 328. For the purpose a high MEP must prevail in the upper part of the steam injector 271 until the piston 318 is forced to descend to its BDP, thus to drive the total of the saturated steam into the superheated steam compartment 328. This should be achieved either by several consecutive explosions or by a single fuel injector with prolonged action which should eliminate both respective valves 359,361 and their associated combustion chambers 362,363. The solution illustrated in the drawings FIGS. 15 and 17 is taken by way of example as a simple and cheap mechanical device. It can be repalced by an electronic processor operating magnetic or hydraulic valves responding at more precise time intervals. A similar more up-to-date solution can be applied in other regulating devices of the MME as for example in those concerning the regulation of steam circulation speed, the pressure in the fire place of the boiler etc. by replacing them with modern electronic devices sensitive to the pressure and temperatures prevailing in all parts of the engine.

Nevertheless, if the MME executed in the fourth variant has to be used as a stationary engine with or without its own boiler, the entire construction becomes less sophisticated because the rapid regeneration of steam can be achieved by the simple increase of the heating surface.

I claim:

1. A heat engine, comprising:

a cylinder block;

a cylinder-block casing enclosing said cylinder block and defining therewith an upper part of a crankcase;

a cylinder member received in said cylinder block and formed with:

an inner working cylinder, an outer cylinder surrounding said inner cylinder and spaced therefrom by a spacing, an annular constricting shoulder extending inwardly from said inner working cylinder, and a common bottom for said inner working cylinder and said outer cylinder;

a cylinder block head mounted on said casing above said cylinder member;

another cylinder suspended from said cylinder block head and extending into said working cylinder and defining an internal cylinder motor within said other cylinder;

a piston member slidable in said working and other cylinders and comprising an outer piston received between said other cylinder and said working cylinder and delimiting at least one air compressor with at least one of said cylinders and an inner piston received in said other cylinder and delimiting said internal cylinder motor at said end of said piston member, and a bottom at an opposite end of said piston member common to both said inner and outer pistons;

at least one pair of oil filters received in said cylinder member between said working cylinder and said outer cylinder and communicating between said crankcase and said head;

at least one pair of air filters received in said cylinder member between said working cylinder and said outer cylinder, connected to an air intake and communicating with said motors and with said compressors through bores formed in said working cylinder;

respective valves for selectively blocking and unblocking said bores;

a camshaft in said head provided with cams for operating at least some of said valves;

means for connecting said piston member to a crankshaft whereby, in an upper dead position, said inner piston defines in said internal cylinder motor an upper expansion chamber;

a first tappet valve opening into said upper expansion chamber and operated by said camshaft;

means in said other cylinder above said tappet valve defining a secondary chamber communicating with said upper expansion chamber upon opening of said first tappet valve;

means in said other cylinder defining a preliminary chamber above said secondary chamber and communicating with said secondary chamber upon opening of a second tappet valve coaxial with said first tappet valve and controlled by said camshaft; and a compressed air distributor connected with said compressor and communicating with said preliminary chamber through a third tappet valve coaxial with said first and second tappet valves and controlled by said camshaft.

2. A heat engine, comprising:

a cylinder block;

a cylinder-block casing enclosing said cylinder block and defining therewith an upper part of a crankcase;

a one-piece cylinder member received in said cylinder block and formed with:

an inner working cylinder, an outer cylinder surrounding said inner cylinder and spaced therefrom by a spacing, an annular constricting shoulder extending inwardly from said inner working cylinder, and a common bottom for said inner working cylinder and said outer cylinder;

a cylinder block head mounted on said casing above said cylinder member;

another cylinder suspended from said cylinder block head and extending into said working cylinder and subdividing said working cylinder into:

an internal cylinder motor within said other cylinder, and an outer cylinder motor externally of said other cylinder and between said other cylinder and said working cylinder;

a piston member slidable in said working and other cylinders and comprising:

an outer piston received between said other cylinder and said working cylinder and delimiting said outer cylinder motor at one end of said piston member, said outer piston delimiting with said constricting shoulder a first air compressor between said inner piston and said working cylinder, an inner piston received in said other cylinder and delimiting said internal cylinder motor at said end of said piston member, and a bottom at an opposite end of said piston member common to both said inner and outer pistons delimiting with a lower end of said other cylinder between said pistons a lower cylinder motor and delimiting with said constricting shoulder between said outer piston and said working cylinder a second air compressor connectable with said lower cylinder motor;

at least one pair of oil filters received in said cylinder member between said working cylinder and said outer cylinder and communicating between said crankcase and said head;

at least one pair of air filters received in said cylinder member between said working cylinder and said outer cylinder, connected to an air intake and communicating with said motors and with said compressors through bores formed in said working cylinder;

respective valves for selectively blocking and unblocking said bores;

a camshaft in said head provided with cams for operating at least some of said valves; and means for connecting said piston member to a crankshaft 3. A heat engine, comprising:

a cylinder block;

a cylinder-block casing enclosing said cylinder block and defining therewith an upper part of a crankcase;

a one-piece cylinder member received in said cylinder block and formed with:

an inner working cylinder, an outer cylinder surrounding said inner cylinder and spaced therefrom by a spacing, an annular constricting shoulder extending inwardly from said inner working cylinder, and a common bottom for said inner working cylinder and said outer cylinder;

a cylinder block head mounted on said casing above said cylinder member;

another cylinder suspended from said cylinder block head and extending into said working cylinder and subdividing said working cylinder into:

an internal cylinder motor within said other cylinder, and an outer cylinder motor externally of said other cylinder and between said other cylinder and said working cylinder; a piston member slidable in said working and other cylinders and comprising:

an outer piston received between said other cylinder and said working cylinder and delimiting said outer cylinder motor at one end of said piston member, said outer piston delimiting with said constricting shoulder a first air compressor between said inner piston and said working cylinder, an inner piston received in said other cylinder and delimiting said internal cylinder motor at said end of said piston member, and a bottom at an opposite end of said piston member common to both said inner and outer pistons delimiting with a lower end of said other cylinder between said pistons a lower cylinder motor and delimiting with said constricting shoulder between said outer piston and said working cylinder a second air compressor connectable with said lower cylinder motor;

at least one pair of oil filters received in said cylinder member between said working cylinder and said outer cylinder and communicating between said crankcase and said head;

at least one pair of air filters received in said cylinder member between said working cylinder and said outer cylinder, connected to an air intake and communicating with said motors and with said compressors through bores formed in said working cylinder;

respective valves for selectively blocking and unblocking said bores;

a camshaft in said head provided with cams for operating at least some of said valves;

means for connecting said piston member to a crankshaft whereby, in an upper dead position, said inner piston defines in said internal cylinder motor an upper expansion chamber;

a first tappet valve opening into said upper expansion chamber and operated by said camshaft;

means in said other cylinder above said tappet valve defining a secondary chamber communicating with said upper expansion chamber upon opening of said first tappet valve;

means in said other cylinder defining a preliminary chamber above said secondary chamber and communicating with said secondary chamber upon opening of a second tappet valve coaxial with said first tappet valve and controlled by said camshaft; and a compressed air distributor connected with at least one of said compressors and communicating with said preliminary chamber through a third tappet valve coaxial with said first and second tappet valves and controlled by said camshaft.

4. The heat engine defined in claim 3 wherein:

said other cylinder is shorter than said inner working cylinder and said outer cylinder;

said outer piston has a ring-shaped body having piston rings sliding against an inner wall of said working cylinder;

said valves for selectively blocking and unblocking said bores include an automatic inertial valve received in a lower part of said outer piston at said bottom of said piston member;

said space between said working cylinder and said outer cylinder is subdivided into two pairs of opposite vertical compartments respectively receiving said oil filters and said air filters;

said oil filters are permanently connected by upper oil passages with respective oil collectors disposed above said casing and in said head, one of said oil collectors feeding excess oil into said air filters, and said oil filters communicating at lower ends with said crankcase at a lower part thereof, said head being formed in the region of said crankshaft with a main oil reservoir interconnected by vertical tubes in said head with at least one of said collectors;

said head is formed with an air duct provided with an intake valve for feeding air directly into said internal cylinder motor and said outer cylinder motor and into said air filters;

said preliminary chamber constitutes a precombustion chamber and is provided with means for injecting fuel into same;

said secondary chamber is a secondary combustion chamber provided with means for injecting fuel into same;

said head is provided with an intake combustion chamber communicating with said upper expansion chamber and with an exhaust combustion chamber communicating with at least one of said secondary and upper expansion chambers and scavenged with air from at least one of said compressors;

said exhaust combustion chamber is provided with at least one tappet exhaust valve controlled by said cam shaft;

said head is provided with means for cooling at least some of said tappet valves with water; and said head is formed with a plurality of suspended cylinders surrounding parts of said tappet valves and bathing same with oil.

5. The heat engine defined in claim 3 wherein said piston member is formed at its bottom with a compressed air receptacle and an upper and a lower disk valve alternately connecting said compressed air receptacle with said first and second air compressors and said inner piston includes an annular body having piston rings sliding along an inner wall of said other cylinder and provided with a tube-shaped upper connecting rod connecting same to the bottom of said piston member, said tube-shaped upper connecting rod being provided with at least one upper opening and at least one lower opening constituted by cutouts in a wall of said tube-shaped upper connecting rod and forming respective slots, said valves including automatic sliding inertia valves alternately opening and closing said upper and lower openings for enabling alternate filling with air and compression of air in said air compressors, said piston member and said cylinder member further defining outer air compressors externally of said piston member.

6. The heat engine defined in claim 1 wherein said piston member is formed with means for forced circulation of lubricating oil through vertical slots formed in said piston member.

7. The heat engine defined in claim 3 whereby said preliminary chamber is constructed and arranged to maintain a longlasting multistroke combustion enabling a substantial constant volume precombustion in said preliminary chamber, said secondary chamber and an exhaust combustion chamber communicating said secondary chamber in an external combustion system exerting a common thrust against said piston member during a power stroke concurrently with a thrust derived from explosion chambers formed by said motors in an internal combustion system.

8. The heat engine defined in claim 7 wherein said other cylinder has a thick wall and is provided with water tubes and compressed air ducts to form a multimedia heat exchanger for delivery of compressed air to said external combustion system.

9. The heat engine defined in claim 7 wherein air from an air intake is divided between said internal and external combustion systems in predetermined proportions by vertical compressed air ducts formed in a wall of said other cylinder and connected to the respective said compressors by at least one ring-shaped disk valve.

10. The heat engine defined in claim 3, further comprising means for injecting respective fuels into said motors and said chambers and including at least one injector having a cam on said camshaft.

11. The heat engine defined in claim 3 wherein said air compressors are operated in a two-stroke cycle and said motors are operated in a four-stroke cycle.

12. The heat engine defined in claim 3 wherein said air compressors are operated in a two-stroke cycle and said motors are operated in a six-stroke cycle.

13. The heat engine defined in claim 3, further comprising means for outputting surplus compressed air whereby said engine forms a self-sufficient air compressor delivering compressed air for nonengine uses.

14. The heat engine defined in claim 3 wherein said piston member includes a further connecting rod in addition to said first-mentioned connecting rod and constituting a double-connecting rod therewith reducing vibration of said piston member and piston ring friction.

15. The heat engine defined in claim 3, further comprising means in said first tappet valve for metering water into said upper expansion chamber.

* * * * *